US011203831B2

(12) United States Patent
Dunsbergen et al.

(10) Patent No.: US 11,203,831 B2
(45) **Date of Patent: *Dec. 21, 2021**

(54) LAUNDRY TREATING APPLIANCE WITH INTERNAL HOUSING

(71) Applicant: WHIRLPOOL CORPORATION, Benton Harbor, MI (US)

(72) Inventors: Kirk Dunsbergen, Stevensville, MI (US); Ricardo Schiesser, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/835,746

(22) Filed: Mar. 31, 2020

(65) Prior Publication Data

US 2020/0248374 A1 Aug. 6, 2020

Related U.S. Application Data

(62) Division of application No. 15/228,596, filed on Aug. 4, 2016, now Pat. No. 10,655,264.

(60) Provisional application No. 62/200,706, filed on Aug. 4, 2015, provisional application No. 62/345,072, filed on Jun. 3, 2016.

(51) Int. Cl.

| | |
|---|---|
| ***D06F 39/02*** | (2006.01) |
| ***D06F 39/08*** | (2006.01) |
| *D06F 39/12* | (2006.01) |
| *D06F 35/00* | (2006.01) |

(52) U.S. Cl.
CPC ..... *D06F 39/022* (2013.01); *D06F 39/02* (2013.01); *D06F 35/006* (2013.01); *D06F 39/088* (2013.01); *D06F 39/12* (2013.01)

(58) Field of Classification Search
CPC ..... D06F 39/02; D06F 39/022; D06F 39/12; D06F 39/088; D06F 34/28; D06F 35/006; D06F 2202/02; D06F 2204/088
See application file for complete search history.

(56) References Cited

U.S. PATENT DOCUMENTS

| | | | |
|---|---|---|---|
| 2,789,510 | A | 4/1957 | Meynig |
| 3,085,715 | A | 4/1963 | Douglas |
| 3,176,883 | A | 4/1965 | Davis, Jr. |
| 3,372,846 | A | 3/1968 | Berkus |
| 3,547,560 | A | 12/1970 | Miller |
| 4,087,024 | A | 5/1978 | Martin et al. |
| 4,141,467 | A | 2/1979 | Augustijn et al. |
| 4,424,829 | A | 1/1984 | Millington et al. |
| 4,651,907 | A | 3/1987 | Thomas |

(Continued)

FOREIGN PATENT DOCUMENTS

| | | | |
|---|---|---|---|
| CN | 202629196 | U | 12/2012 |
| DE | 2611493 | A1 | 9/1977 |

(Continued)

*Primary Examiner* — Joseph L. Perrin
(74) *Attorney, Agent, or Firm* — McGarry Bair PC

(57) ABSTRACT

A laundry treating appliance, such as a clothes washer, either vertical or horizontal axis, can have a bulk dispenser capable of dispensing multiple doses of treating chemistry from a reservoir of treating chemistry. A housing fluidly couples a supply of water and the treating chemistry for supplying both to a treating chamber within the laundry treating appliance.

20 Claims, 59 Drawing Sheets

(56) References Cited

U.S. PATENT DOCUMENTS

| | | | |
|---|---|---|---|
| 4,809,524 | A | 3/1989 | Sickert et al. |
| 4,967,936 | A | 11/1990 | Bingler |
| 5,110,013 | A | 5/1992 | Clark et al. |
| 5,435,157 | A | 7/1995 | Laughlin |
| 5,582,039 | A | 12/1996 | Mueller et al. |
| 5,628,430 | A | 5/1997 | Barbe |
| 5,743,432 | A | 4/1998 | Barbe |
| 5,743,442 | A | 4/1998 | Barbe |
| 5,870,906 | A | 2/1999 | Denisar |
| 6,058,743 | A | 5/2000 | Fujii et al. |
| 6,109,480 | A | 8/2000 | Monsrud et al. |
| 6,149,034 | A | 11/2000 | Amberg et al. |
| 6,185,774 | B1 | 2/2001 | Tubman |
| 6,206,058 | B1 | 3/2001 | Nagel et al. |
| 6,241,378 | B1 | 6/2001 | Amberg et al. |
| 6,269,666 | B1 | 8/2001 | Whah et al. |
| 6,874,656 | B2 | 4/2005 | Rohr et al. |
| 6,877,626 | B2 | 4/2005 | Sherrod |
| 7,111,762 | B2 | 9/2006 | Saunders et al. |
| 7,313,932 | B2 | 1/2008 | Ryohke et al. |
| 7,493,781 | B2 | 2/2009 | Ooe |
| 7,921,578 | B2 | 4/2011 | McAllister et al. |
| 7,934,403 | B2 | 5/2011 | Cho et al. |
| 8,083,055 | B2 | 12/2011 | Simonian et al. |
| 8,141,700 | B2 | 3/2012 | Simonian et al. |
| 8,166,781 | B2 | 5/2012 | Lee et al. |
| 8,196,441 | B2 | 6/2012 | Hendrickson et al. |
| 8,388,695 | B2 | 3/2013 | Hendrickson et al. |
| 8,397,328 | B2 | 3/2013 | Hendrickson et al. |
| 8,397,544 | B2 | 3/2013 | Hendrickson |
| 8,438,881 | B2 | 5/2013 | Ihne et al. |
| 8,549,887 | B2 | 10/2013 | Reid et al. |
| 8,555,678 | B2 | 10/2013 | Lee et al. |
| 8,628,024 | B2 | 1/2014 | Dunsbergen et al. |
| 8,733,136 | B2 | 5/2014 | Chung et al. |
| 8,950,608 | B2 | 2/2015 | Dejong et al. |
| 8,985,360 | B2 | 3/2015 | Chen |
| 9,085,844 | B2 | 7/2015 | Hill et al. |
| 9,121,123 | B2 | 9/2015 | Song |
| 9,133,576 | B2 | 9/2015 | Lee et al. |
| 9,200,399 | B2 | 12/2015 | Kim et al. |
| 9,273,424 | B2 | 3/2016 | Lee et al. |
| 2002/0134800 | A1 | 9/2002 | Johnson et al. |
| 2006/0117811 | A1 | 6/2006 | Kinnetz |
| 2006/0186076 | A1 | 8/2006 | Shiloni |
| 2007/0261177 | A1 | 11/2007 | Risen et al. |
| 2008/0028802 | A1 | 2/2008 | Jordan et al. |
| 2008/0229517 | A1 | 9/2008 | Amarillas et al. |
| 2009/0126123 | A1 | 5/2009 | Kim et al. |
| 2009/0288453 | A1 | 11/2009 | Lee et al. |
| 2010/0000264 | A1 | 1/2010 | Luckman et al. |
| 2010/0000581 | A1 | 1/2010 | Doyle et al. |
| 2010/0139328 | A1 | 6/2010 | Favaro |
| 2012/0006077 | A1 | 1/2012 | Mun et al. |
| 2012/0060302 | A1 | 3/2012 | Hanau et al. |
| 2012/0096901 | A1 | 4/2012 | Zattin et al. |
| 2012/0159997 | A1 | 6/2012 | Del Pos et al. |
| 2012/0266389 | A1* | 10/2012 | Ihne ..... D06F 39/028 8/137 |
| 2013/0092704 | A1 | 4/2013 | Tincher et al. |
| 2013/0180293 | A1 | 7/2013 | Huerth et al. |
| 2014/0158708 | A1 | 6/2014 | Freudenberg et al. |
| 2014/0158709 | A1 | 6/2014 | Freudenberg et al. |
| 2014/0158716 | A1 | 6/2014 | Freudenberg et al. |
| 2014/0259441 | A1 | 9/2014 | Fulmer et al. |
| 2014/0259450 | A1 | 9/2014 | Alexander et al. |
| 2014/0298867 | A1 | 10/2014 | Rodrigues et al. |
| 2015/0114046 | A1 | 4/2015 | Jeong et al. |
| 2015/0360848 | A1 | 12/2015 | Parsons et al. |
| 2017/0167068 | A1 | 6/2017 | Bao et al. |
| 2017/0268151 | A1 | 9/2017 | Leibman et al. |
| 2017/0298560 | A1 | 10/2017 | Leibman |
| 2017/0306552 | A1 | 10/2017 | Leibman et al. |
| 2017/0327991 | A1 | 11/2017 | Leibman et al. |

FOREIGN PATENT DOCUMENTS

| | | | |
|---|---|---|---|
| DE | 2808898 | A1 | 9/1979 |
| EP | 1444394 | B1 | 7/2007 |
| EP | 1939347 | A1 | 7/2008 |
| EP | 2070462 | A1 | 6/2009 |
| EP | 2295624 | A1 | 3/2011 |
| EP | 2405052 | A1 | 1/2012 |
| EP | 2441373 | A1 | 4/2012 |
| GB | 2037880 | A | 7/1980 |
| GB | 2468342 | A | 9/2010 |
| JP | 7227495 | A | 8/1995 |
| JP | 2002282587 | A | 10/2002 |
| KR | 20120004208 | A | 1/2012 |
| WO | 2011149501 | A1 | 12/2011 |

* cited by examiner

LAUNDRY TREATING APPLIANCE WITH INTERNAL HOUSING

CROSS-REFERENCE TO RELATED APPLICATIONS

This application is a divisional of U.S. patent application Ser. No. 15/228,596, filed Aug. 4, 2016, now U.S. Patent No. 10,655,264, issued May 19, 2020, which claims the benefit of U.S. Provisional Patent Application No. 62/200,706, filed Aug. 4, 2015, and U.S. Provisional Patent Application No. 62/345,072, filed Jun. 3, 2016, all of which are incorporated herein by reference in their entirety.

BACKGROUND

Laundry treating appliances, such as clothes washers, refreshers, and non-aqueous systems, can have a configuration based on a rotating drum that defines a treating chamber in which laundry items are placed for treating. Historically, residential or home-use versions of these appliances have single dose dispensers, with provided compartment or cups, typically in a drawer or under a cover, in which the user of the appliance would fill with a dose of treating chemistry that was sufficient for the cycle of operation to be selected. Recently, bulk dispensers, i.e. dispensers holding multiple doses of a treating chemistry, have become more common, yet with single dose dispensers still being dominate.

The bulk dispensers can be more convenient in that they relieve the user from having to fill the single dose dispenser for every cycle. However, the particular implementation of current bulk dispensers has created its own inconvenience. In some implementations, the bulk dispenser relies on a proprietary cartridge, which some users find inconvenient. In some implementations, the bulk dispenser was integrated with the traditional single dose dispenser, which limited the bulk dispenser to hold only a few doses of treating chemistry, which failed to fully realize the convenience and benefit that can be provided by a bulk dispenser.

Furthermore, user dosing of treating chemistry is typically inaccurate based upon load size or soil level. A user will arbitrarily add an amount of treating chemistry or a single dose of treating chemistry, which is typically more or less chemistry than what is needed to properly clean the laundry items. As such, a typical user can waste a large amount of treating chemistry in an attempt to properly dose the laundry.

BRIEF DESCRIPTION

According to an aspect of the present disclosure a bulk dispensing system for a laundry treating appliance, the bulk dispensing system including a housing defining at least one treating chemistry conduit that is fluidly separate from the at least one water conduit, with at least one pump mount provided on the housing and at least one pump mounted to the housing at the at least one pump mount and having a water inlet fluidly coupled to the at least one water conduit, a treating chemistry inlet fluidly coupled to the at least one treating chemistry conduit, and a wash liquid output emitting a mixture of the water and the treating chemistry to form a wash liquid.

DETAILED DESCRIPTION

Embodiments of the invention relate to a laundry treating appliance having a bulk dispenser with a treating chemistry reservoir in the form of an off-the-shelf, container of treating chemistry. Using the off-the-shelf container makes the container independent of the bulk dispenser, unlike proprietary containers that are dependent on a particular dispensing system, while providing a much greater number of treating chemistry doses, which increases the time between refills of the system.

While the embodiments of this description are primarily in the environment of a horizontal axis clothes washer, embodiments of the description can be implemented in any laundry treating appliance that performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

It should be understood that as used herein, the term "treating chemistry" can include any type of additive for dispensing into a laundry appliance to treat or otherwise affect a load of laundry during a cycle of operation. Such treating chemistry can include detergents, bleach, fabric softener, or stain treatments in non-limiting examples. It should be understood that where one treating chemistry is described, such a description is non-limiting and can include any alternative treating chemistry. In some cases it can include water alone.

Figure 1:
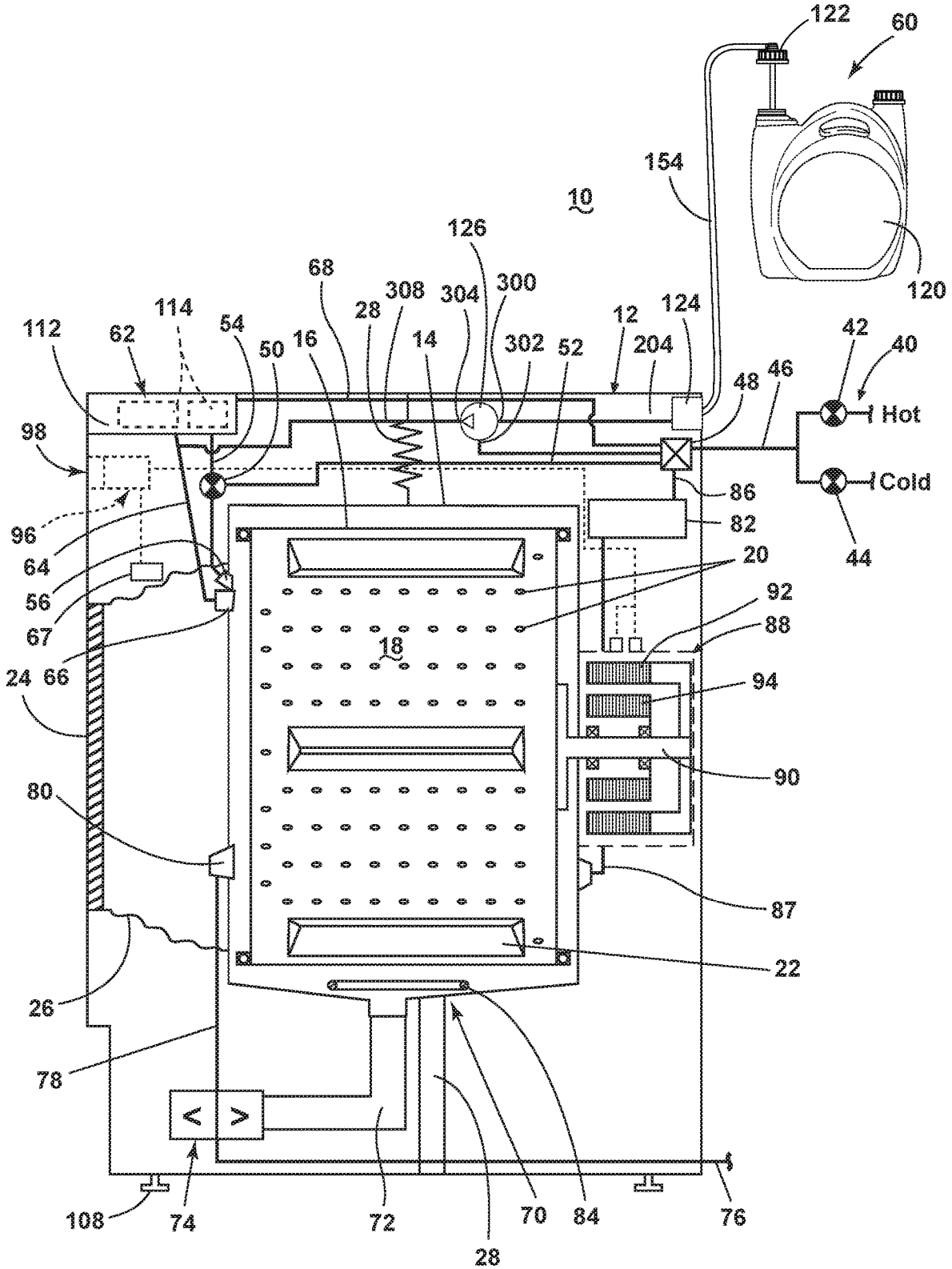
FIG. 1 is a schematic view of a laundry treating appliance in the form of a washing machine and a bulk dispenser according to a first embodiment of the invention.

FIG. 1 illustrates a first embodiment of a laundry treating appliance having a bulk dispenser in the form of a washing machine 10, which can include a structural support system comprising a cabinet 12 which defines a housing within which a laundry holding system resides. The cabinet 12 can be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and an imperforate container or drum 16 provided within the tub 14, the drum 16 defining at least a portion of a treating chamber 18. The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It is also within the scope of the invention for the laundry holding system to comprise only a tub with the tub defining the laundry treating chamber 18.

The laundry holding system can further include a door 24 which can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14.

The washing machine 10 can further include a suspension system 28 for dynamically suspending the laundry holding system within the structural support system.

The washing machine 10 can further include a liquid supply system for supplying liquid to the washing machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a nozzle 56 configured to spray the flow of liquid into the tub 14. In this manner, water from the household water supply 40 can be supplied directly to the tub 14.

The washing machine 10 can also be provided with a dispensing system for dispensing treating chemistry to the treating chamber 18 for use in treating the laundry according to a cycle of operation. The dispensing system can include both a bulk dispenser 60 and an optional single use dispenser 62, either of which can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the single use dispenser 62 from the supply conduit 52 by directing the diverter mechanism 50 to direct the flow of water to a dispensing supply conduit 68. While only a single nozzle 66 is illustrated, multiple nozzles 66 may be used, with each of the bulk dispenser 60 and single use dispenser 62 having a dedicated nozzle 66 or using the same nozzle 66.

The single use dispenser 62 is illustrated as a traditional drawer-type single use dispenser 110 having a drawer 112 in which are provided one or more cups or recesses 114 in which treating chemistry is added for each cycle of operation. Water from the supply conduit 52 is then used to flush the cups 114, along with the treating chemistry residing within the cup, out of the relevant cup, with the resulting mixture of water and treating chemistry flowing down the outlet conduit 64, out of the nozzle 66 and into the treating chamber 18.

The bulk dispenser 60 includes a bulk container 120, container adapter 122, a liquid interface 124, and a pump 126, which has an output fluidly coupled to the outlet conduit 64. In treating chemistry flow order, the container adapter 122 is configured to mount to the bulk container 120 and establish fluid communication with the contents of the bulk container 120. The liquid interface 124 fluidly couples the container adapter 122 and the pump 126 to establish fluid communication from the container adapter 122 to the pump 126 via the liquid interface 124.

The pump 126 can be any suitable pump. However, as illustrated, the pump 126 is a water pressure pump as described in U.S. patent application Ser. No. 14/302,529, filed Jun. 12, 2014, now U.S. Publication No. 20150360848, published Dec. 17, 2015, and entitled "PRESSURE-DRIVEN METERED MIXING DISPENSING PUMPS AND METHODS", whose disclosure is incorporated by reference. The water pressure pump of the '529 application is beneficial in that it does not require electricity and delivers small quantities of treating chemistry, which are pre-mixed with water prior to delivery to the outlet conduit 64 and nozzle 66. The small quantities of treating chemistry delivered by the water pressure pump enables fine control over the dispensing of the total amount of treating chemistry. The pre-mixing by the water pressure pump is also great enough that the shear forces acting on the treating chemistry during the pre-mixing are great enough to break about the bonds of the different components of the treating chemistry.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The bulk dispenser 60 may also include a dedicated switch 67 located adjacent the nozzle 66. The switch 67 can be used to actuate the bulk dispenser when the door 24 is opened. In this manner, the user can provide spot treatment of a laundry item by holding the portion of the laundry item desired to be treated below the nozzle 66 and then actuation the switch 67 to cause the bulk dispenser to deliver treating chemistry to the desired portion of the laundry item.

The washing machine 10 can also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the washing machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

Additionally, the liquid supply and recirculation and drain system can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction. Feet 108 can be used to balance the washing machine 10 upon a surface such as the floor.

The washing machine 10 also includes a control system for controlling the operation of the washing machine 10 to implement one or more cycles of operation. The control system can include a controller 96 located within the cabinet 12 and a user interface 98 that is operably coupled with the controller 96. The user interface 98 can include one or more knobs, dials, switches, displays, touch screens and the like for communicating with the user, such as to receive input and provide output. The user can enter different types of information including, without limitation, cycle selection and cycle parameters, such as cycle options.

The controller 96 can include the machine controller and any additional controllers provided for controlling any of the components of the washing machine 10. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
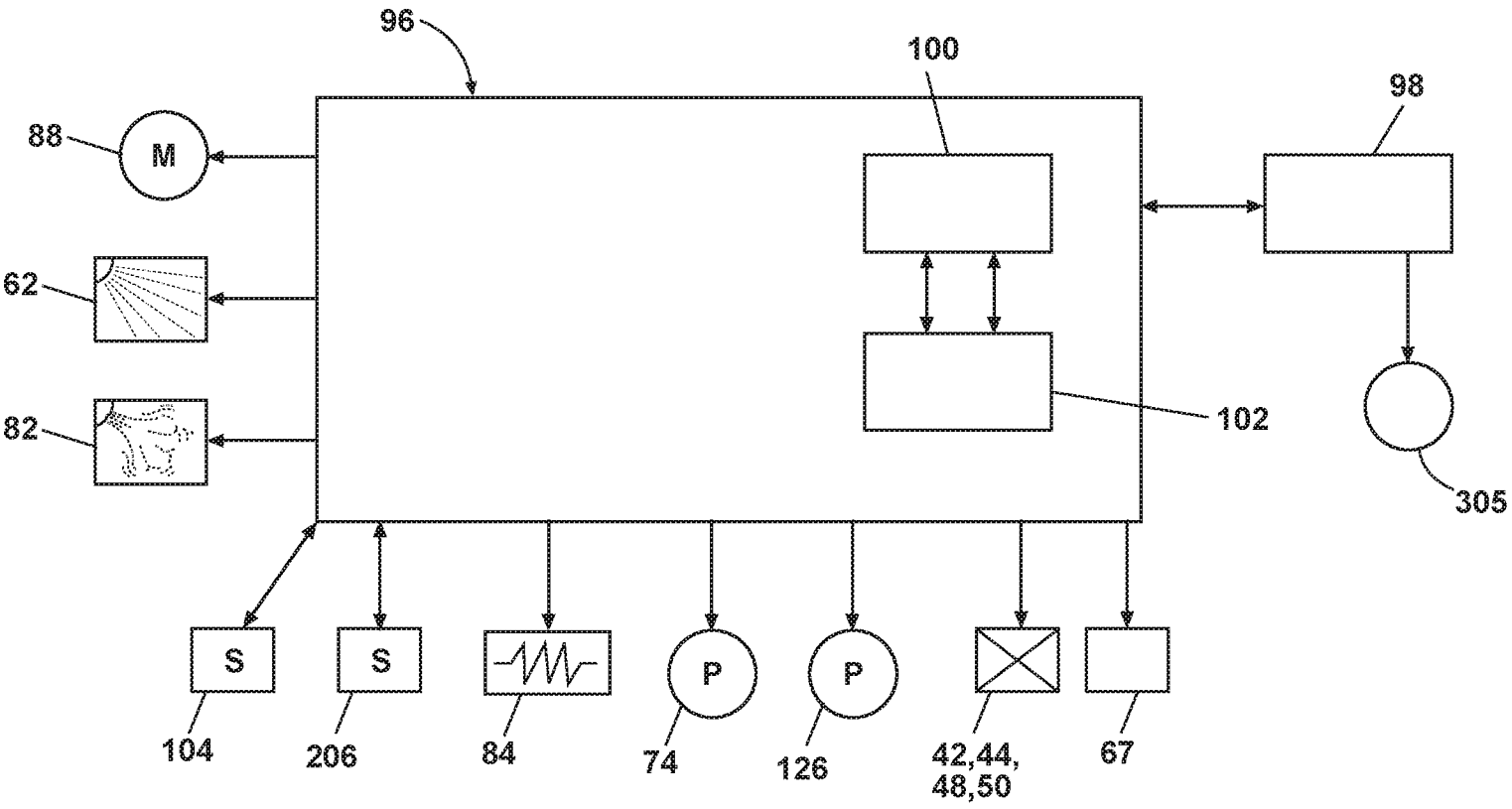
FIG. 2 is a schematic of a control system of the laundry treating appliance of FIG. 1 according to the first embodiment of the invention.

As illustrated in FIG. 2, the controller 96 can be provided with a memory 100 and a central processing unit (CPU) 102. The memory 100 can be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 can also be used to store information, such as a database or table, and to store data received from one or more components of the washing machine 10 that can be communicably coupled with the controller 96. The database or table can be used to store the various operating parameters for the one or more cycles of operation, including factory default values for the operating parameters and any adjustments to them by the control system or by user input.

The controller 96 can be operably coupled with one or more components of the washing machine 10 for communicating with and controlling the operation of the component to complete a cycle of operation. For example, the controller 96 can be operably coupled with the motor 88, the pump 74, the single use dispenser 62, the steam generator 82 and the sump heater 84 to control the operation of these and other components to implement one or more of the cycles of operation.

The controller 96 can also be coupled with one or more sensors 104 provided in one or more of the systems of the washing machine 10 to receive input from the sensors, which are known in the art and not shown for simplicity. Non-limiting examples of sensors 104 that can be communicably coupled with the controller 96 include: a treating chamber temperature sensor, a moisture sensor, a weight sensor, a chemical sensor, a position sensor and a motor torque sensor, which can be used to determine a variety of system and laundry characteristics, such as laundry load inertia or mass.

With the overview of the washing machine 10 and bulk dispenser now complete, the details of the bulk dispenser 60 will be described with respect to FIGS. 3 to 19. Beginning with FIG. 3, a schematic is shown of a shelf 118 in a contemporary retail store, with the shelf holding a sampling of currently available off-the-shelf, bulk containers 120, intended for home or residential use, with one of the off the-shelf bulk containers enlarged for detail. The bulk containers 120 are suitable for use as a treating chemistry reservoir for the bulk dispenser 60. Looking now at the enlarged bulk container 120, it comprises a body 130 having a threaded collar 132 encircling a manually-actuable valve 134, and a vent 136. The valve 134 and vent 136 are provided on opposite ends of the body 130, with an integrally formed handle 138 in between. The body 130 defines an interior 140, which is in fluid communication with the valve 134 and the vent 136. A threaded cap 142 is initially provided with the bulk container 120 to protect the valve 134.

The contemplated use for the bulk container 120 is to fill single dose dispensers, like single use dispenser 62. In its intended single dose implementation, the bulk container 120 is typically stood on its side with the valve 134 down and the vent 136 up. In this manner, the valve 134 can be manually actuated to release treating chemistry from the interior 140 through the valve 134 while air enters the vent 136 to replace the released treating chemistry, and prevent a vacuum lock during dispensing.

While the bulk container 120 is intended to refill single dose dispensers, embodiments of the current invention utilize the bulk container as a treating chemistry reservoir for a bulk dispenser. The illustrated bulk container 120 is just one of many possible off-the-shelf treating chemistry containers that could be used as treating chemistry reservoir for the bulk dispenser 60. As illustrated, the bulk containers 120 are standard detergent containers for well-known brands, which can be from the same or different manufactures. Exemplary brands include CHEER®, GAIN®, ERA®, TIDE®, DOWNY®, ALL®, SUN®, ULTRA®, SNUGGLE®, XTRA®, ARM & HAMMER®, PUREX®, and PERSIL®, to name a few.

One difficulty of using off-the-shelf containers is that each manufacture independently selects and controls the shape of the bulk container 120, including the size of the collar 132 and the pitch of the threads. While a subset of many of the current off-the-shelf bulk containers 120 do have a common diameter of 40.5 mm and thread pitch of 4.4 mm, the diameter and pitch thread do vary. Thus, any bulk dispensing system 60 that is based on using an off-the-shelf bulk container 120 will find it beneficial to be able to accommodate the different size collars and thread pitch of the different manufacturers.

Figure 4:
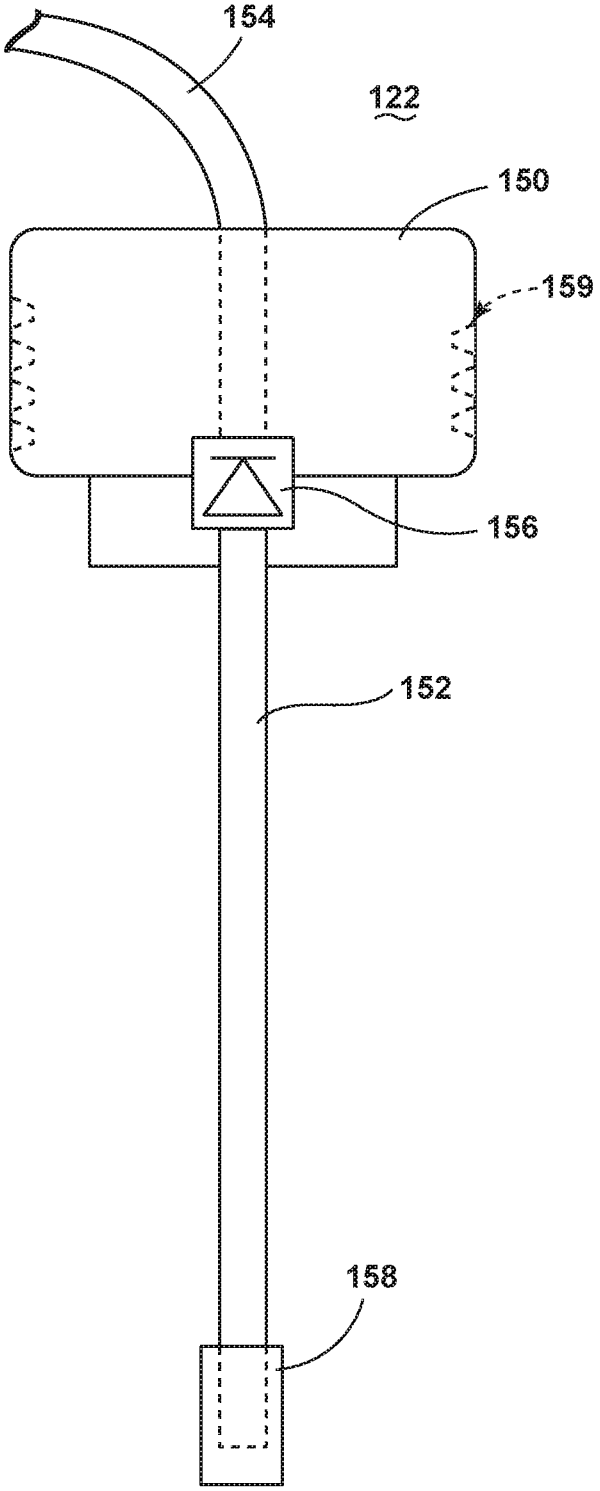
FIG. 4 is a schematic view of a container adapter for coupling the bulk container of FIG. 3 to the bulk dispenser.

FIG. 4 is a schematic of the container adapter 122, which can adapt the off-the-shelf bulk container 120 for use in the bulk dispensing system 60. The container adapter 122 has a threaded cap 150 from which depends a straw 152 and outwardly from which extends a hose 154. A check valve 156 fluidly couples the straw 152 and hose 154. A filter 158 can be provided on or integrated with the straw 152. A decorative sleeve can be provided to cover the hose 154 for those users who prefer a different aesthetic than an exposed hose 154.

The threaded cap 150 has threads 159 that match the threads of the threaded cap 142 of the bulk container 120 to provide for a simple mounting of the container adapter 122 to the bulk container 120. When the cap 150 is threaded onto the bulk container 120, the straw 152 is received within the bulk container 120.

The straw 152 can bend, flex, deflect and/or be made of multiple independently movable segments to enable the straw 152 to bend after insertion into the bulk container 120. The ability of the straw 152 to change configuration provides the functionality of the straw being capable of being inserted within an otherwise shorter container and still function without kinking, which might negatively impact the flow of treating chemistry.

The hose 154 can be any type of tube extending from the cap 150. The hose 154 can be press-fit within a corresponding opening in the cap, as illustrated, or the cap 150 can have a dedicated fitting for the hose 154. The hose 154 can also be integrally formed with the cap 150. The hose 154 can be of any degree of transparency, including opaque, but it is contemplated that the hose 154 will be transparent to aid in the visual and sensor inspection of the treating chemistry passing through the hose 154.

The dimensions of the hose 154 can be helpful in ensuring the proper flow of treating chemistry from the bulk container 120, especially when using the water pressure driven pump. The dimensions for a suitable hose 154 for the water pressure pump are 8 mm OD (outer diameter) and 5 mm ID (inner diameter).

The check valve 156 can be mounted to or integrated with the threaded cap 150. It is contemplated that the check valve is integrally formed with the cap 150. In this sense, the cap 150 can have a recess or fitting in which the check valve 156 is received, with the straw 152 being received within the same recess or fitting, but upstream of the check valve 156.

Figure 5:
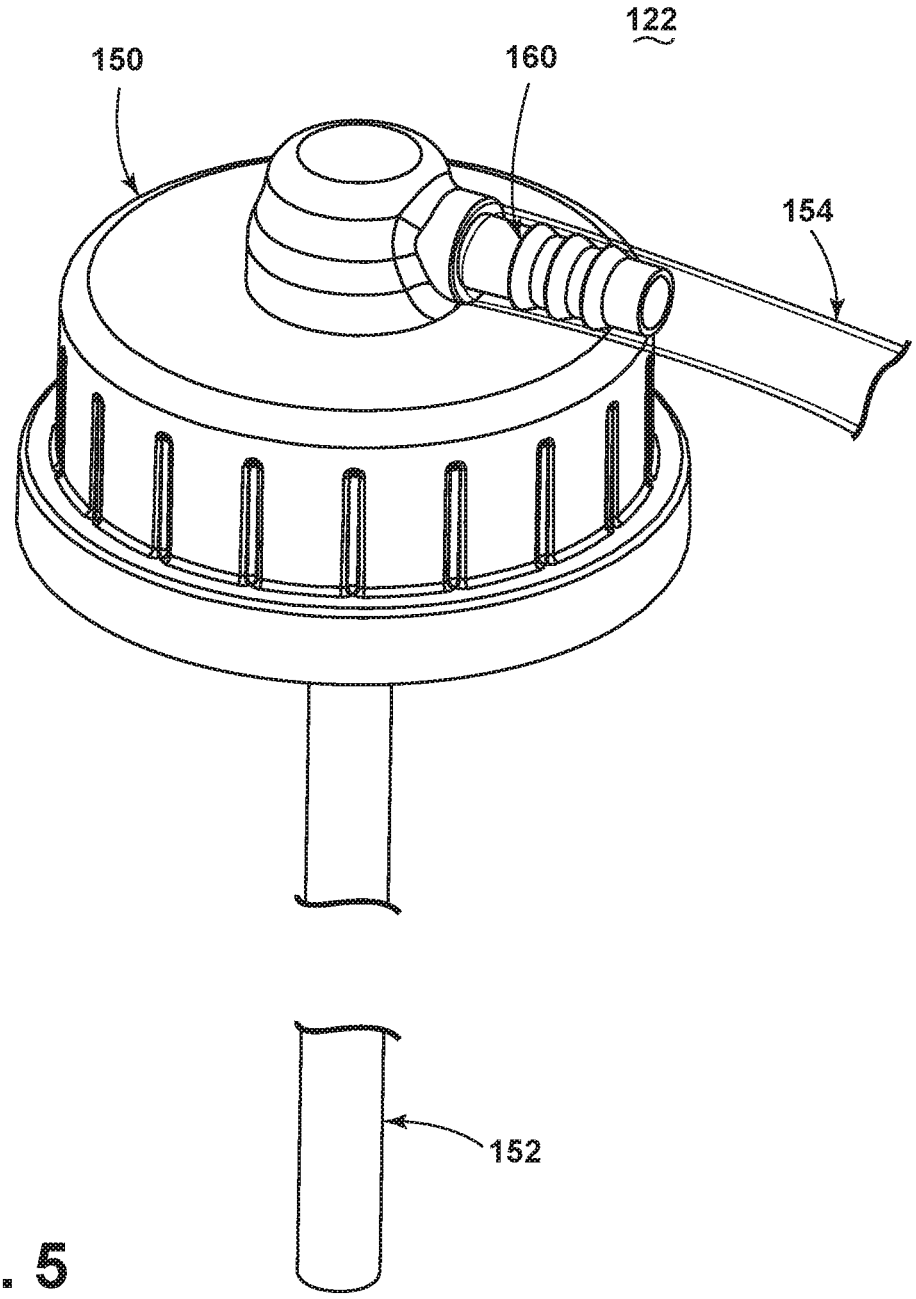
FIG. 5 is a perspective view of one implementation of the container adapter of FIG. 4.
Figure 6:
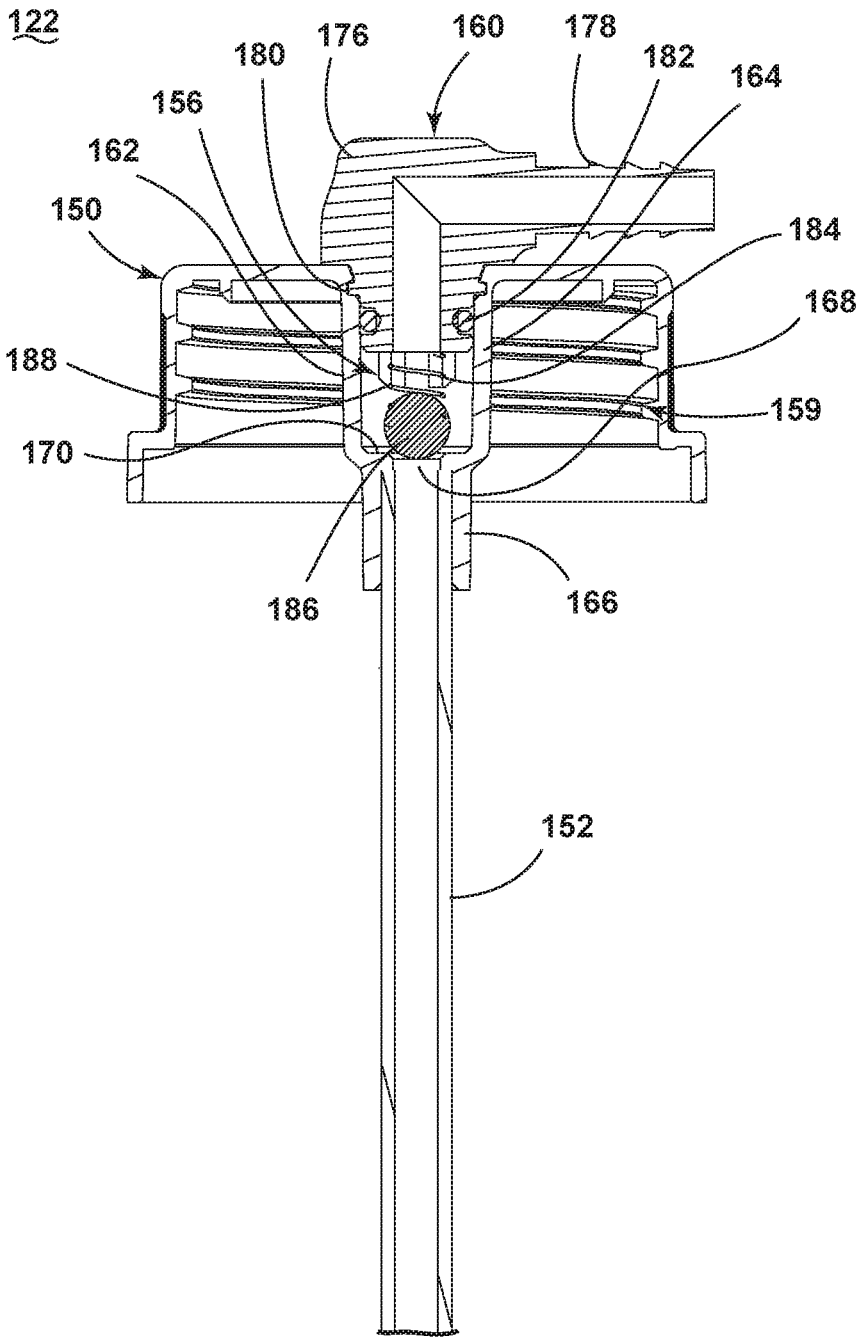
FIG. 6 is a sectional view of the container adapter of FIG. 5.

FIG. 5 illustrates one example of a container adapter 122 having a cap 150, straw 152, transparent hose 154, and check valve 156 (FIG. 6). A fitting 160 is provided on the top of the cap 150 to connect the hose 154 to the cap 150.

The details of the check valve 156 and fitting 160 are best seen in FIG. 6, which is a sectional view of the container adapter 122 of FIG. 5. The cap 150 has a centrally located stepped collar 162 having an upper collar 164 defining a recess open to the top of the cap 150 and a lower collar 166 defining a through passage 168. At the junction of the upper collar 164 and lower collar 166 is a step 170. The fitting 160 is received within the upper collar 164 while the straw 152 is received within the lower collar 166.

The fitting 160 comprises an elbow 176 from which extends a nipple 178 over which the hose 154 is received. The elbow 176 includes a tip 180 that is received within the upper collar 164 and includes a seal 182, illustrated as an O-ring, which seals the tip 180 relative to the upper collar 164. The tip 180 and stepped collar 162 can have co-operating structures and be made of suitable material that permit a press-fit or snap-fit connection.

The check valve 156 comprises a spring 184 and a ball 186 located within the upper collar 164 between the elbow 176 and the step 170. The spring 184 biases the ball 186 against the step 170, which functions as a valve seat for the ball 186, to close the passage 168. A guide pin 188 can extend from the tip 180 when the spring 184 is a coil spring to aid in preventing the coil spring from buckling. Treating chemistry flowing from the straw 152 to the hose 154 is controlled by the check valve 156. Other types of check valves than a ball/spring type can be used and include, for example, umbrella check valves and flapper check valves.

In operation, for the treating chemistry to pass through the straw 152 and out the hose 154, the treating chemistry must pass through the check valve 156. Thus, the suction pressure by the pump 126 must be great enough to overcome the force of the spring 184 to unseat the ball 186 and open the check valve 156. Once the suction pressure from the pump 126 is relieved, the spring 184 biases the ball 186 against the seat to close the check valve 156.

Figure 7:
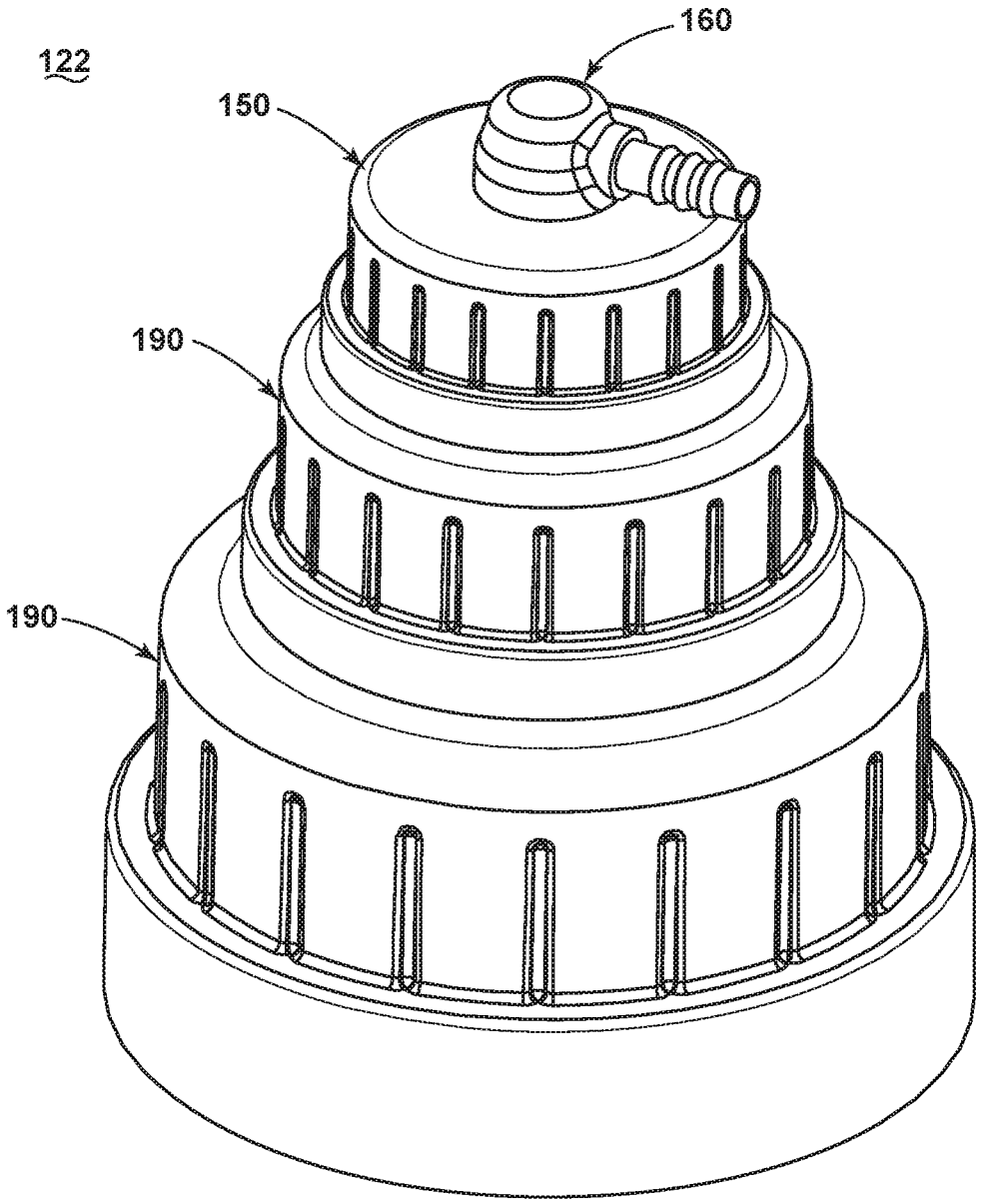
FIG. 7 is a perspective view of the container adapter of FIG. 5 within optional sizing rings.

Referring to FIG. 7, the container adapter 122 can be provided with optional sizing caps 190. The sizing caps 190 are similar to cap 150 and have increasing diameters, which results in each of the sizing caps having a larger diameter thread, which permits the cap 150 to be indirectly mounted to bulk containers 120 having different diameter thread sizes than the cap 150.

Figure 8:
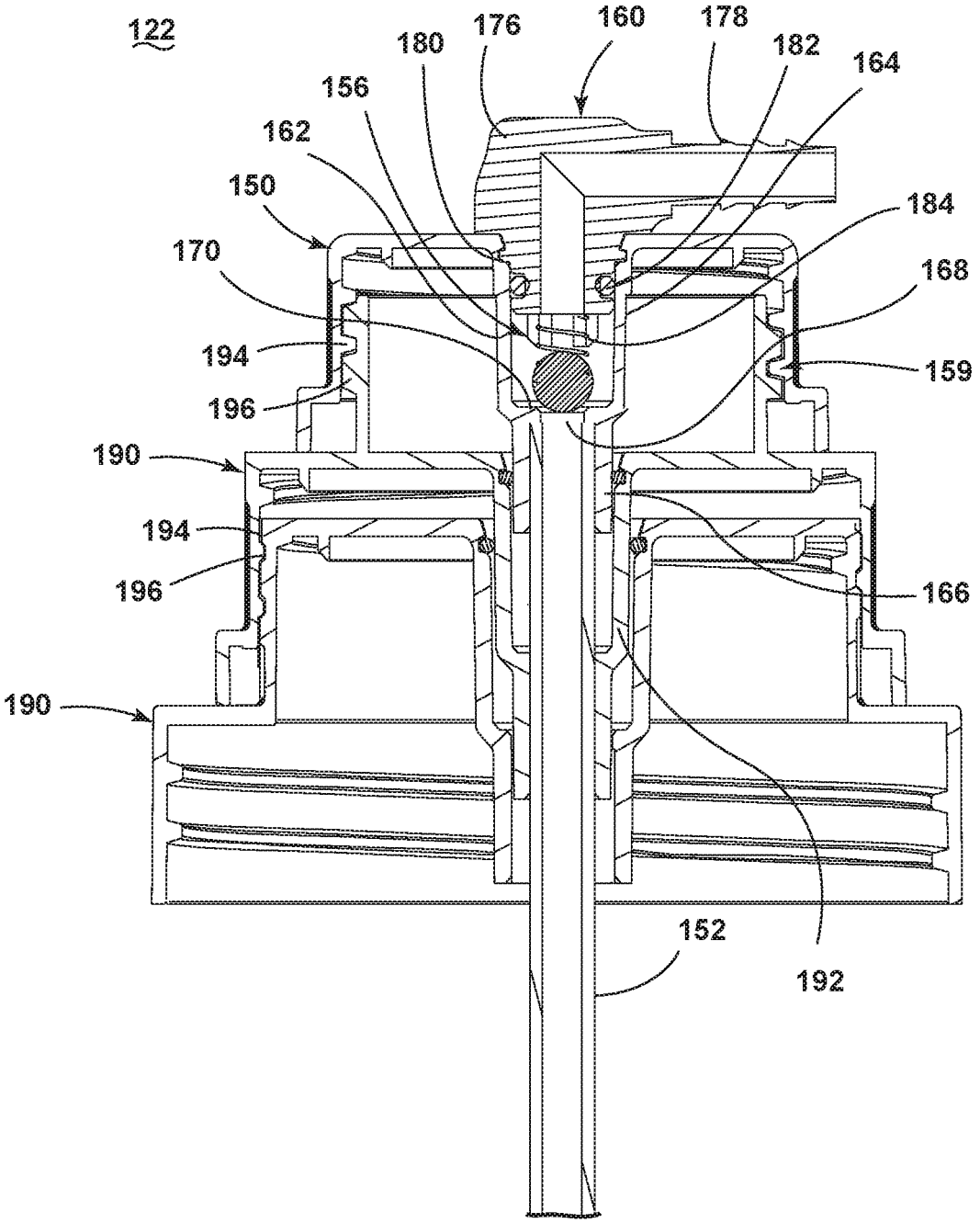
FIG. 8 is a sectional view of the container adapter of FIG. 7.

As best seen in FIG. 8, which is a cross section of FIG. 7, each of the sizing caps 190 are arranged in a nested relationship of increasing size. The sizing caps 190 have a corresponding stepped collar structure 192 similar to the upper collar 164 of the cap 150, but with increasing diameters. The sizing caps 190 also have external threads 194 as well as internal threads 196, with the cap 150 threading onto the external threads 194 of one sizing cap 190 and the internal threads 196 threading onto the external threads 194 of the other sizing cap 190. While only two sizing caps 190 are illustrated in FIGS. 7 and 8, any number of sizing caps 190 can be used.

The sizing caps 190 need not always have an increased diameter and be for the purpose of accommodating different size openings on the bulk containers 120. In some cases the bulk container 120 may have a different thread pitch than the cap 150. In such circumstances, the sizing cap 190 would have internal threads 196 with a pitch suitable for the bulk container 120 while the external threads 194 would match the internal threads of the cap 150. In this way, the sizing caps 190 can be used to accommodate different thread pitches.

It is also contemplated that the sizing caps 190 can be press-fit to each other and/or to the cap 150, instead of being threaded. The sizing caps 190 do not have to be threaded to each other or the cap 150. While the threaded connection of the sizing caps 190 and/or the cap 150 is often more secure than press-fit, the likely environment of a home laundry room may not need a more secure connection than what is obtainable from a press fit.

Figure 9:
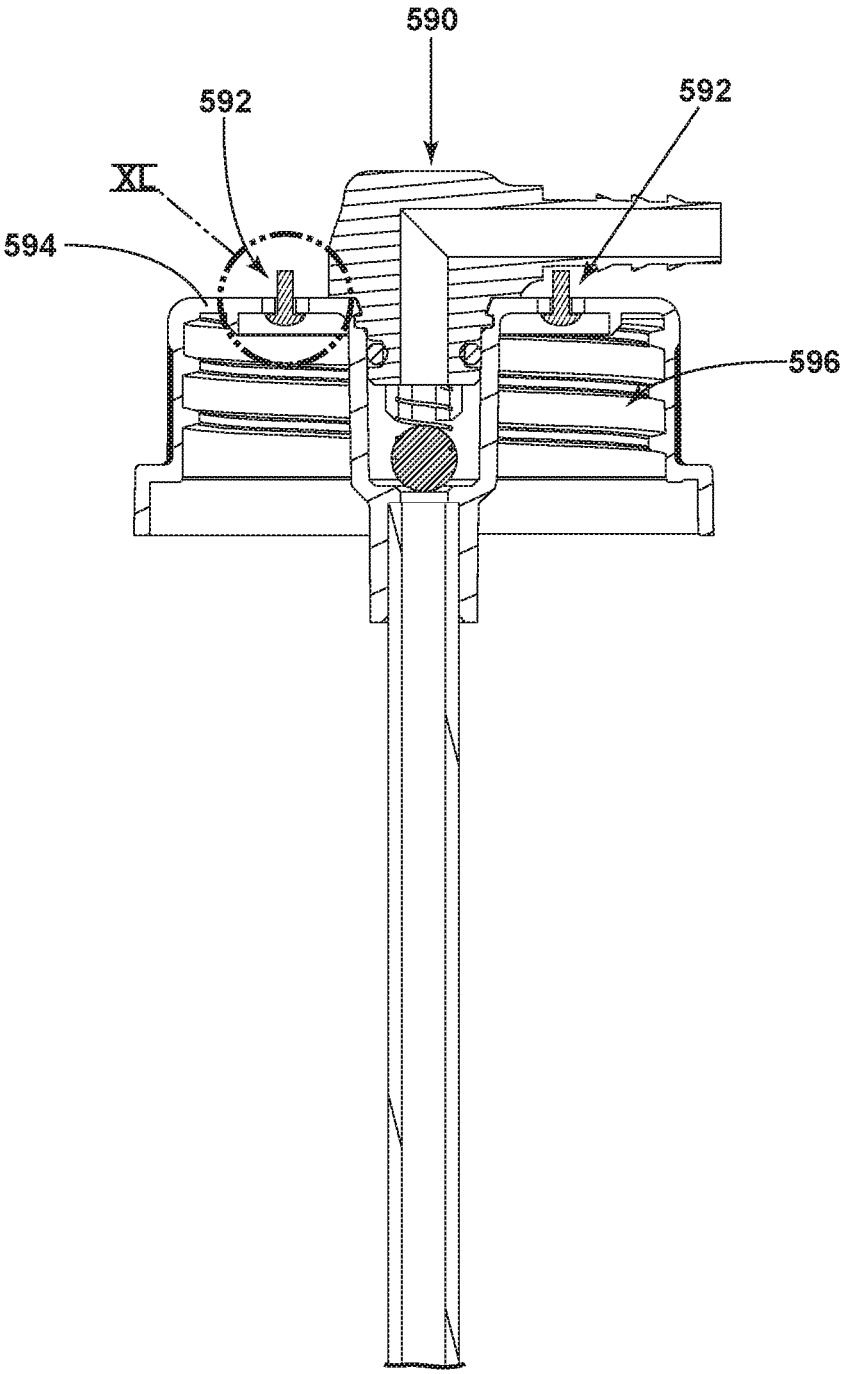
FIGS. 9-11 illustrate an umbrella seal for drawing ambient air into a bulk container.
Figure 10:
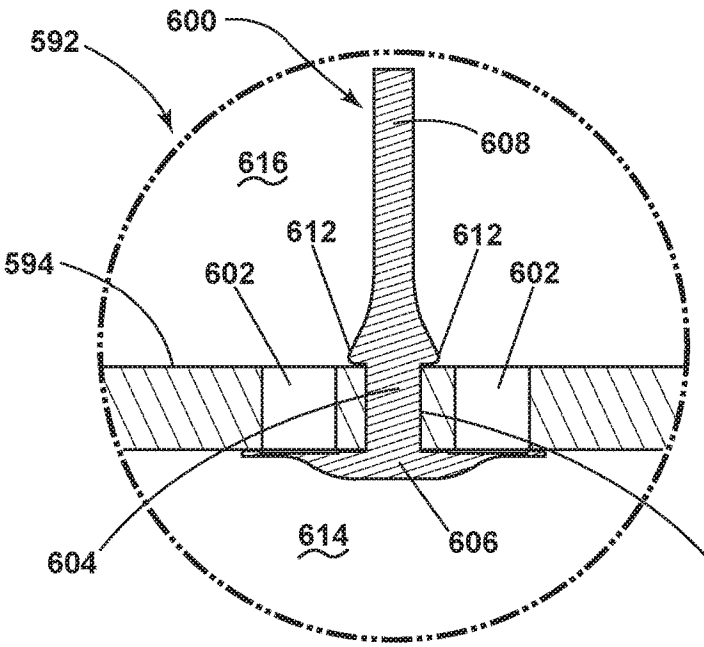
Figure 11:
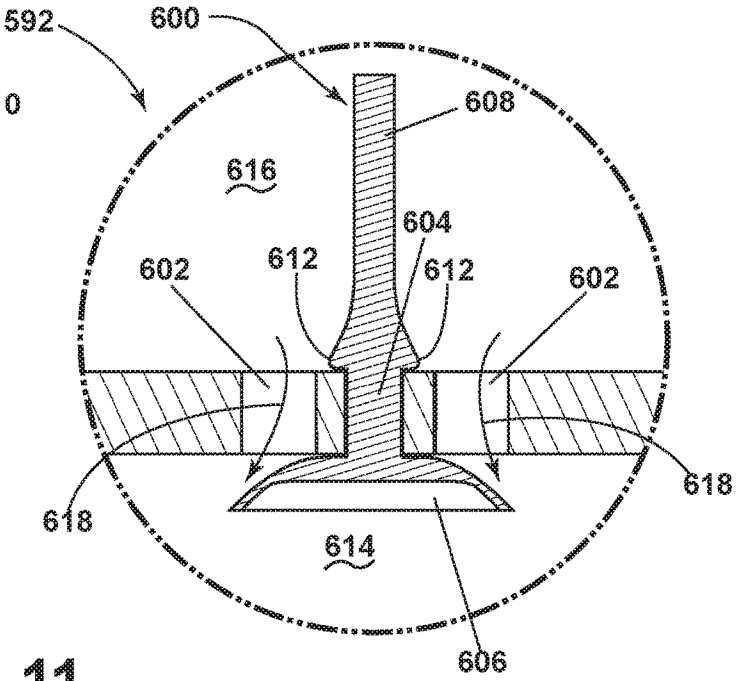

FIGS. 9-11 illustrate a cap with a vent for preventing a vacuum from forming within a bulk dispenser 60. Referring to FIG. 9, a cap 590, which can be the cap of FIGS. 4-8 in non-limiting examples, can include a vent 592. The vent 592 can be placed at the top 594 of the cap 590, above a threaded portion 596 of the cap 590. The cap 590 can be coupled to a bulk dispenser 60 such as an off-the-shelf bulk dispenser 60 (FIG. 3) in one example. While only two vents 592 are shown, as few as one, or any number of vents 592 can be utilized in the cap 590.

FIG. 10 illustrates an enlarged view of the vent 592. The vent 592 includes a seal 600 and two openings 602, while any number of openings 602 is contemplated. The seal 600 has a body 604, a valve 606 and a tail 608. An aperture 610 in the cap 590 holds the seal 600 at the body 604. A lip 612 having a diameter greater than the aperture 610 secures the seal 600 at the aperture 610 opposite of the valve 606. The top 594 defines an interior 614 and an exterior 616 of the cap 590, with the valve 606 disposed in the interior 614. The valve 606 is illustrated as an umbrella valve, but is not so limited and can be any other suitable valve to permit the flow of air between the interior 614 and exterior 616 of the cap 590.

FIG. 10 illustrates the umbrella valve 606 in the closed position and FIG. 11 illustrates the umbrella valve 606 in the open position. During operation, a pump or similar force draws a volume of treating chemistry from a bulk dispenser or container to which the cap 590 mounts. Drawing a portion of the treating chemistry from the bulk dispenser creates a vacuum within the bulk dispenser. Such a vacuum creates a force that opposes the pump in drawing additional treating chemistry from the bulk dispenser. As more treating chemistry is drawn, the greater the force of the vacuum. Eventually, the force of the vacuum could be great enough to cause the bulk container to partially implode or deform, which can cause leaking or improper placement of the cap 590 for drawing additional treating chemistry. Furthermore, the force created by the vacuum can prevent a pump from accurately drawing a volume of treating chemistry tailored to the particular cycle of operation.

Thus, the umbrella valve 606 is shaped to deform due to the vacuum force. The umbrella valve 606 can be made of a resilient material, such as formed rubber, permitting the umbrella valve 606 to deform and then return to its natural shape. For example, the umbrella valve 606 is naturally shaped as is shown in FIG. 10. As a vacuum force develops, the force draws the umbrella valve 606 into the position shown in FIG. 11. In this position, the openings 602 permit air 618 to be drawn from the exterior 616 of the cap 590 to the interior 614. Drawing the air 618 eliminates the vacuum force, balancing the air pressure between the interior 614 and exterior 616 of the bulk dispenser, preventing the negative effects of the vacuum. Once the air pressures have substantially equalized, the umbrella valve 606 returns to the position shown in FIG. 10 to seal the interior 614 of the cap 590. As the treating chemistry is continuously drawn, the process repeats as is necessary to continuously eliminate the vacuum.

Figure 12:
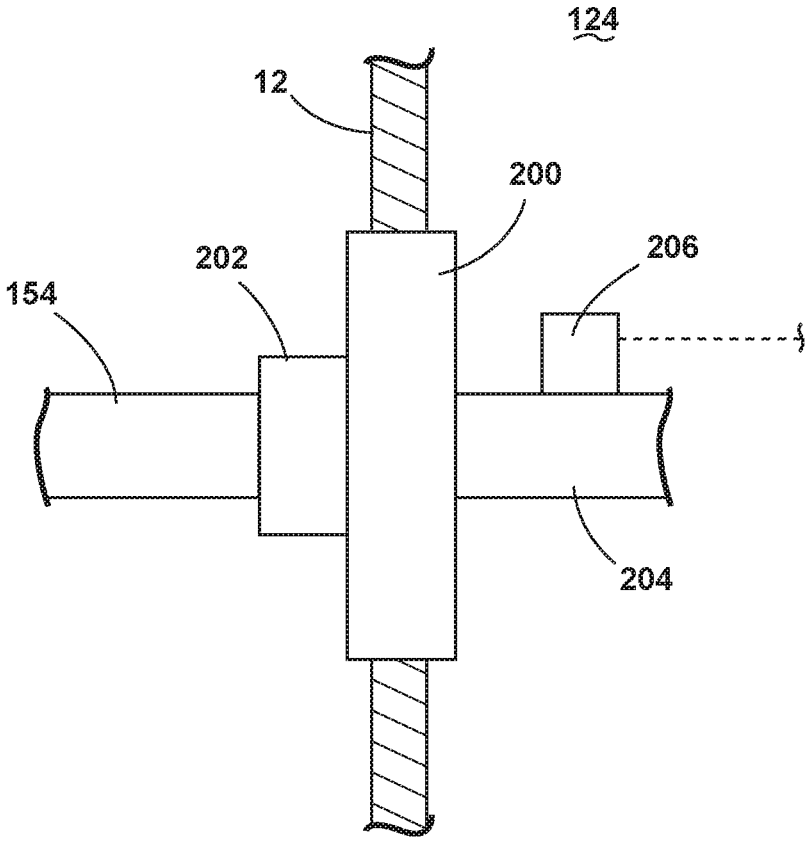
FIG. 12 is a schematic of the liquid interface.

The output from the container adapter 122 is provided to the liquid interface 124, which is illustrated in more detail in FIG. 12. The liquid interface 124 includes a body 200, which can be a housing or a frame, for example, which is mounted to the cabinet 12 of the washing machine 10. A hose coupling 202 located on an exterior of the body 200 provides for coupling the hose 154 to the liquid interface 124. A pump supply line 204 is located on an interior of the body 200 and is fluidly coupled to the pump 126. A sensor 206 is located in proximity to the pump supply line 204 and senses characteristics of the treating chemistry passing through the pump supply line 204. While the sensor 206 is shown as being located on the pump supply line 204, it could as easily be located on the hose 154, hose coupling 202 or body 200.

The hose coupling 202 can be any type of coupling suitable for connecting to the hose 154, such as press-fit, snap-fit, bayonet, quick-release, etc. The hose coupling 202 is fluidly coupled with the pump supply line 204 such that treating chemistry passing through the hose 154 flows into the pump supply line 204.

The container adapter 122 and/or sizing caps 190 can be provided with the clothes washer 10 and/or sold with the bulk container 120. In one example, a standard container adapter 122 could be provided with the clothes washer 10 and each bulk container 120 could be provided with a corresponding sizing cap 190. In this manner, the container adapter 122 could have a standardized cap 150 and threads 159, with the sizing cap 190 configured to mate to the standardized cap 150 and threads 159. Alternatively, a container adapter 122 unique to the particular bulk container 120 could be provided with the bulk container 120. The container adapter 122, when provided with the bulk container 120, can be already installed on the bulk container 122 or just packaged with the bulk container 120.

The pump supply line 204 can be any suitable conduit capable of carrying the treating chemistry to the pump 126. The pump supply line 204 can be any degree of transparency, including opaque. It is contemplated that the pump supply line 204 is transparent so that the sensor 206 can optically inspect the treating chemistry as it flows through the pump supply line.

While the pump 126 is primarily described as a water pressure-driven pump, the pump can also be a traditional electrical pump. Any suitable electric pump can be used. One such pump is a piston-type electrical pump.

The sensor 206 can be any sensor, including any of the previously described sensors 104, suitable for sensing one or more characteristics of the treating cases. It is contemplated that the sensor 206 is an optical sensor that can determine reflectance, color, etc. of the treating chemistry. The sensor 206 may also emit light, visible or non-visible, onto the treating chemistry and then sense an optical characteristic of the reflected light, such as, without limitation, intensity, color, wavelength, reflectance, etc. The received characteristic may be used to determine one or more characteristics of the treating chemistry, such as, without limitation, type of treating chemistry (detergent, softener, bleach etc.) or concentration of treating chemistry, such as concentration of surfactants in a detergent.

Specific examples of suitable sensors for determining characteristics of the treating chemistry, and methods of operation, are found in U.S. Pat. No. 8,628,024, entitled Removable Component For A Consumable With Identifying Graphic, filed Mar. 25, 2013, and issued Jan. 14, 2014, and U.S. Publication No. 20140259450, entitled "Methods and Compositions for Treating Laundry Items", published Sep. 18, 2014, and, both of which are incorporated by reference. Other suitable sensors, especially for detecting bubbles in tubing, include photo resistors (visible infrared and ultraviolet light), photo transistors, and ultrasonic sensors (used in intravenous lines and intravenous pumps).

The sensor 206, more specifically an infrared sensor coupled to the controller, can also be used to determine whether the pump supply line 204 and by extension, the hose 154, is full or empty of treating chemistry. As the bulk container 120 starts to empty, air bubbles are introduced into the straw 152 and ultimately work their way to the sensor 206. The detection of the air bubbles can be used to determine the empty status of the bulk container 120. As an extension, when a bulk container 120 is replaced, air bubbles will be present for a period of time until the hose 154 is full again. Also, when a container is first installed, air will be in the pump supply line 204.

The detection of air bubbles in the pump supply line 204 can be used by the controller 96 to implement several special, non-treating, cycles of operation. For example, upon the first use of the washing machine 10, the controller can presume that a bulk container 120 is being installed for the first time. A special "priming" cycle can be carried out, which includes activating the pump 126 until the sensor 206 no longer detects air bubbles or for some other standard that would typically fill the hose 154 and the pump supply line 204 with treating chemistry. The controller can store a flag indicating that the initial fill has already occurred. Thus, any subsequent determination of air bubbles can be interpreted as the present bulk container 120 being empty or that the present bulk container 120 was replaced, and a suitable pumping cycle is implemented until the air bubbles are eliminated.

In all of the above scenarios, the controller 96 can provide an alert to the user via the user interface 98. The alert can be audible, visual, or both. If the washing machine 10 is connected to either a wired or wireless network, it can provide the alert to the user's computer or wireless device. The alert can be a notification to the user or it can be a request for information to help the controller determine what special cycle to run. For example, the controller can prompt the user as to whether the bulk container was replaced or not. The controller can also alert the user that the bulk container 120 is empty or near empty.

Figure 13:
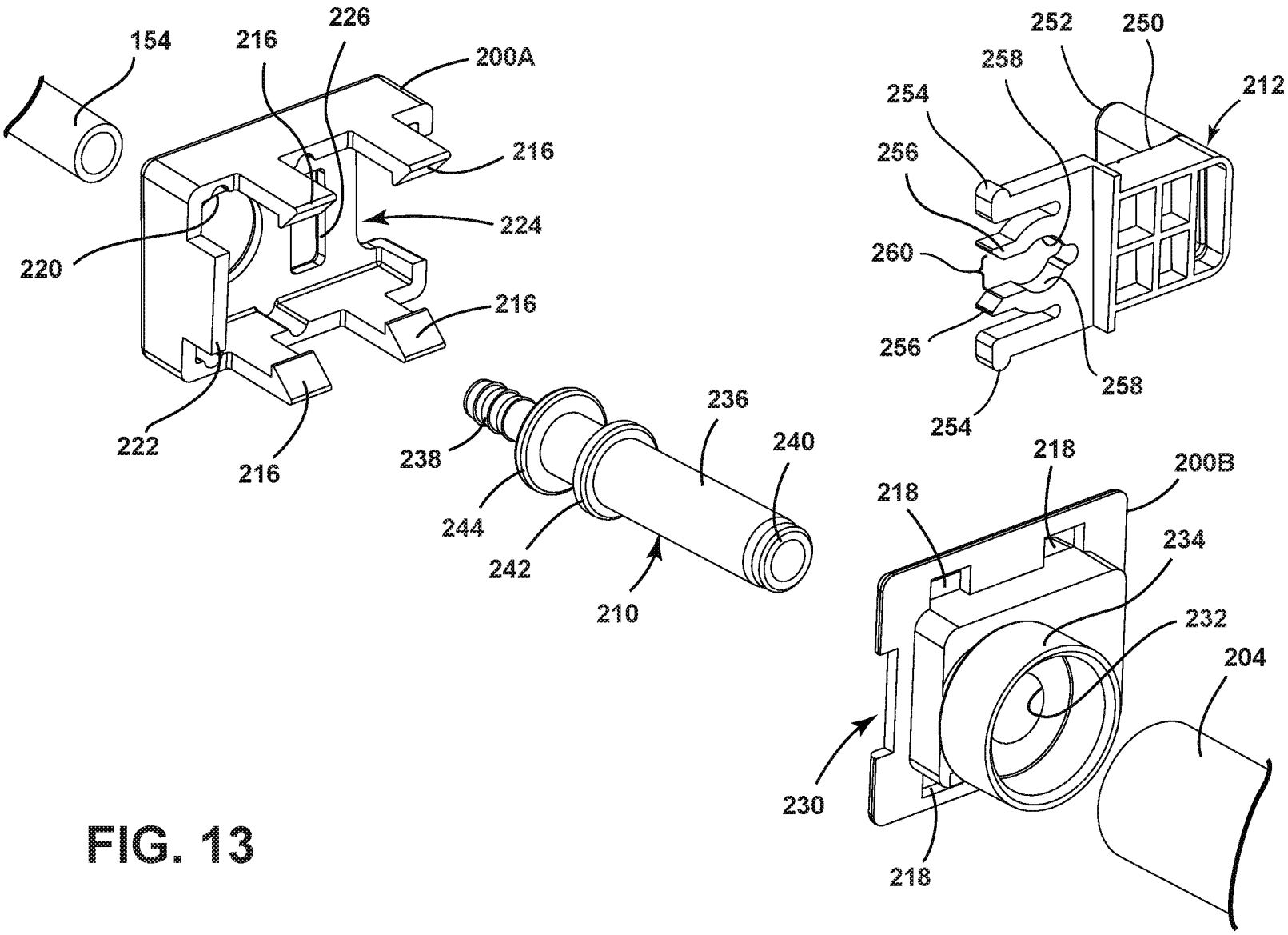
FIG. 13 is an exploded view of one implementation of the liquid interface of FIG. 12.

FIG. 13 illustrates one implementation of the liquid interface 124, which has a body 200 comprising first body portion 200A and second body portion 200B. A tube fitting 210 couples to the hose 154 and is received within the body 200. A clip 212 snaps onto the tube fitting 210 and retains the tube fitting to the body 200.

The first and second body portions 200A, 200B have complementary spring fingers 216 and apertures 218. The spring fingers 216 are sized to be received within the apertures 218 in a snap-fit connection to connect the first and second body portions 200A, 200B.

The first body portion 200A comprises a tube opening 220 into which the tube fitting 210 can be inserted. A key 222 is located on one side of the first body portion 200A. A clip opening 224 is located on another side of the first body portion 200A and is sized to receive the clip 212. A release opening 226 is located on a face of the first body portion 200A.

The second body portion 200B includes a keyway 230 sized to receive the key 222, which collectively provide an index for aligning the first and second body portions 200A, 200B. A seal opening 232 is located within the interior of the second body portion 200B and is sized to receive the tube fitting 210 in a liquid tight seal. A collar 234 encircles the seal opening 232 and defines a recess in which the pump supply line 204 is received.

The tube fitting 210 includes a body 236 terminating at one end with a nipple 238, sized to be received within the hose 154, and at an opposing end in a seal structure 240 sized to be snap-fit within the seal opening 232. First and second shoulders 242, 244 are provided in spaced relationship on the body 236, with the spacing being great enough to receive the clip 212.

The clip 212 comprises a handle 250 with a pull 252 extending from one end of the handle 250. A pair of spaced retaining fingers 254 extend from the handle 250. A pair of spring fingers 256 extend from the handle 250 and are located between the retaining fingers 254. The retaining fingers 254 can be temporarily inwardly sprung to fit within the clip opening 224 to permit the sliding of the clip 212 by use of the pull 252 in and out of the clip opening 224, with the outer range of movement being limited by the tips of the retaining fingers 254 contacting the first body portion 200A defining the clip opening 224.

The pair of spring fingers 256 include an arcuate portion 258 that conforms to the curvature of the body 236 between the first and second shoulders 242, 244 of the tube fitting 210. The tips of the spring fingers 256 define a gap 260, which is less than the diameter of the body 236 between the first and second shoulders 242, 244 of the tube fitting 210. With this configuration, when the spring fingers 256 are slid over the body 236 between the shoulders 242, 244, the spring fingers must first deflect until the body 236 is received within the arcuate portions 258, leading to the spring fingers "snapping" around the body 236 and provide tactile feedback to the user.

To assemble and operate the liquid interface 124 into a condition ready for operation, in no particular order, the retaining fingers 254 are inserted through the clip opening 224 such that the tips of the retaining fingers lie within the body 200. The spring fingers 216 are inserted into the apertures 218 to secure together the body portions 200A, 200B. The pump supply line 204 is press-fit within the collar 234. The nipple 238 of the tube fitting 210 is inserted into the hose 154. The assembled body 200 is then mounted to the cabinet 12. With the body 200 mounted to the cabinet 12, the body 236 is inserted into the tube opening 220 until the seal structure 240 seals with respect to the seal opening 232. The user can move the clip 212 by applying a sliding force to the pull 252 to move the clip between an unlocked position and a locked position, where the spring fingers 256 snap over the body 236 between the shoulders 242, 244 to retain the tube fitting 210 within the body 200.

Figure 14:
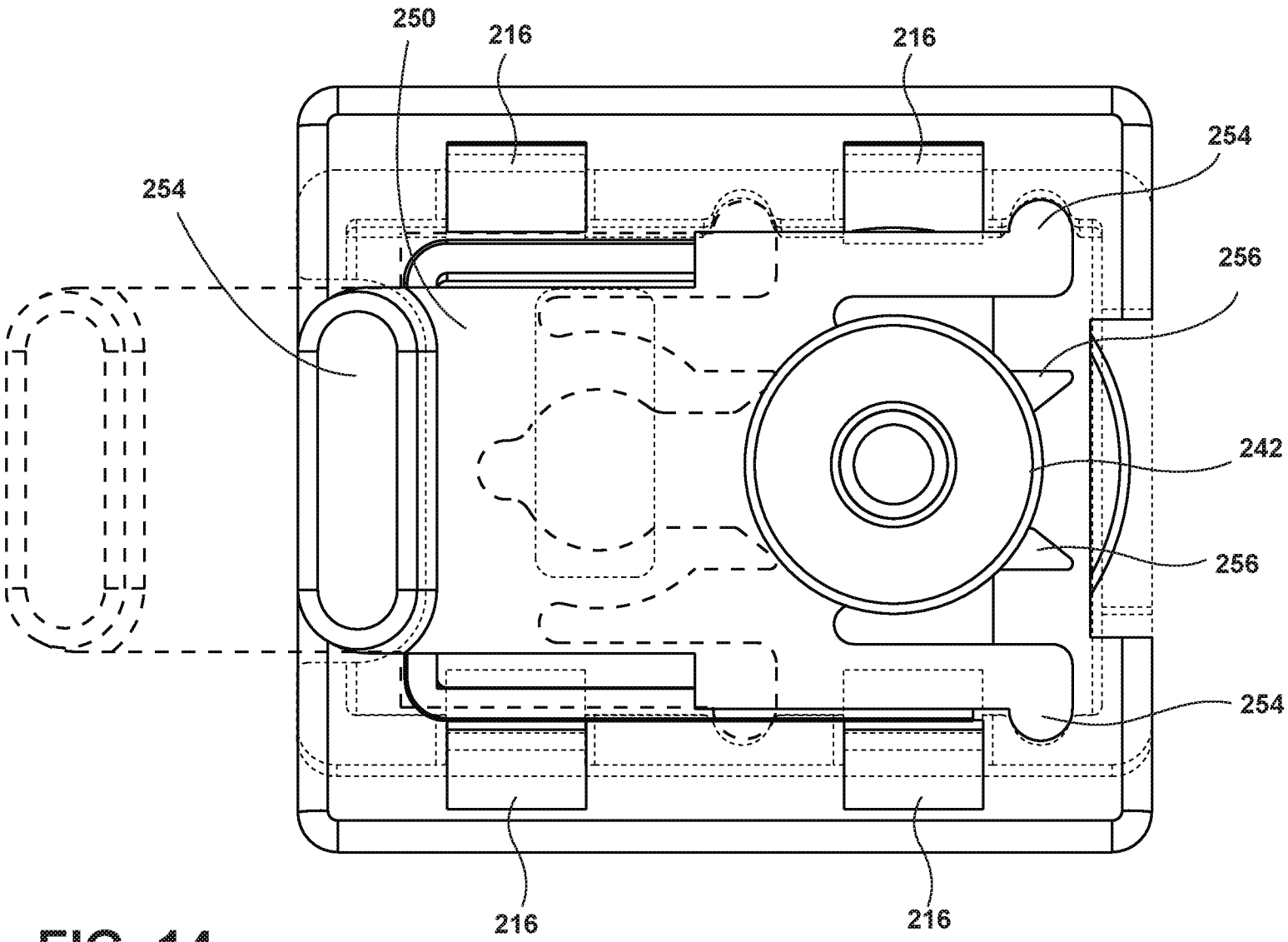
FIG. 14 is a perspective view illustrating the operational positions of the liquid interface of FIG. 13.

FIG. 14 illustrates the operation positions of the liquid interface 124 as the clip 212 is slid between the unlocked (dotted lines) and locked (solid lines) positions. In the unlocked position, the spring fingers 256 are remote of the body 236 of the tube fitting, which enables the insertion and removal of the body 236 through the tube opening 220. In the locked position (solid lines), the clip 212 is slid laterally to snap the spring fingers 256 over the body 236 until the body 236 is received within the arcuate portions 258. In this position, the inherent resiliency of the spring fingers 256 maintains the clip 212 in the locked position and the tube fitting 210 cannot be withdrawn from the tube opening without unclipping the clip 212 by sliding the clip 212 back to the unlocked position.

Figure 15:
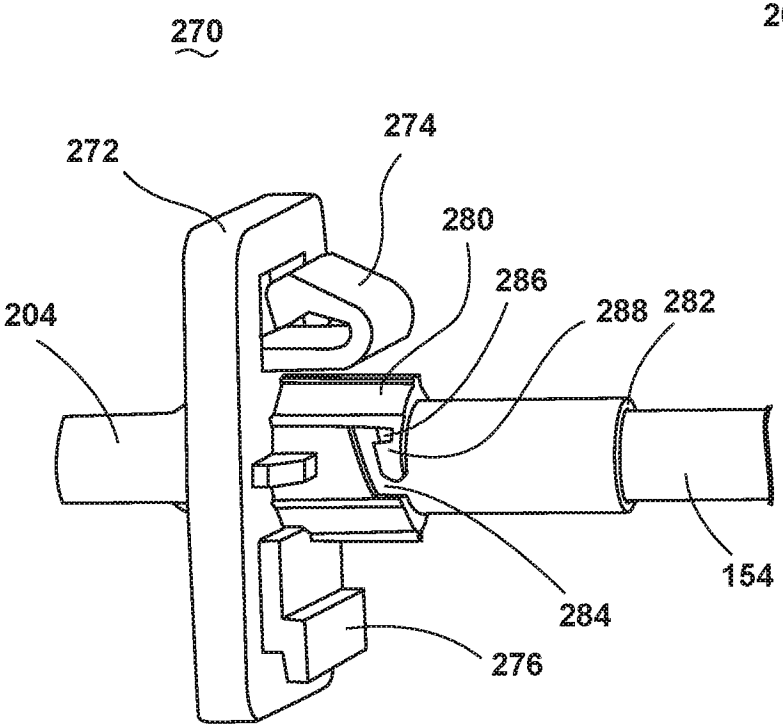
FIG. 15 is a perspective view illustrating another implementation of the liquid interface of FIG. 12.

Another implementation of the liquid interface 124 is illustrated in FIG. 15. The second implementation liquid interface 270 comprises a body 272 from which extends a spring finger 274 and a tab 276, which couple the body 272 to the cabinet 12. A bayonet mount in the form of a receiver 280 extending from the body 272 and an insert 282 secured to the hose 154 couples the hose 154 to the body 272. The receiver 280 has a least one channel 284 and the insert 282 has at least one pin 286. The pin 286 is received in the channel 284 and the insert 282 is rotated to drive the pin 286 to the end of the channel 284, where the pin is received in a detent 288 formed in the channel 284. The pump supply line 204 is fluidly coupled to the body 272 and in fluid communication with the hose 154 once connected to the body 272 by the bayonet connection.

Figure 16:
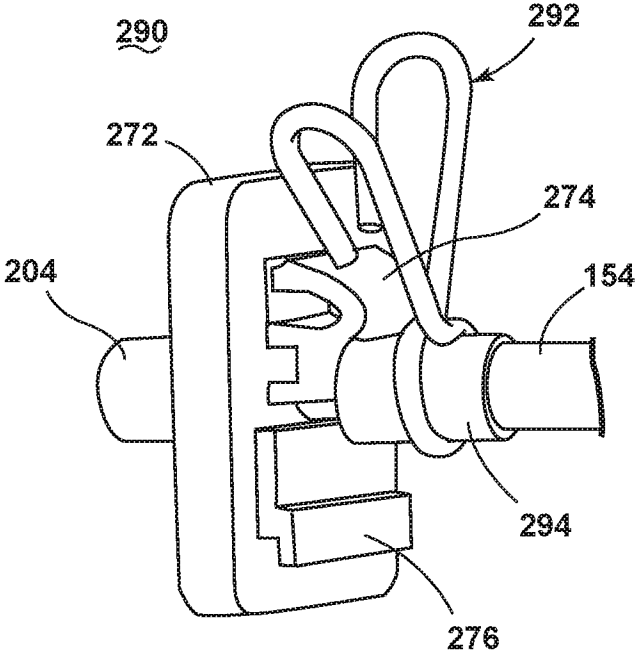
FIG. 16 is a perspective view illustrating another implementation of the liquid interface of FIG. 12.

Another implementation of the liquid interface 124 is illustrated in FIG. 16. The third implementation liquid interface 290 is similar to the second implementation 270 except that the bayonet mount is replaced with a traditional spring clip 292 located about a collar 294 forming a terminal end of the hose 154.

The pump 126, as previously stated, can be any suitable pump capable of drawing treating chemistry from the bulk container 120. As illustrated, the pump is a water pressure driven mixing pump 126 having a first inlet 300 fluidly coupled to the pump supply line 204, a second inlet 302 fluidly coupled to the supply conduit 52, and an outlet 304 fluidly coupled to the dispensing outlet conduit 64, via line 308, which emits through the nozzle 66. This configuration enables the pump 126 to drawing in treating chemistry from the bulk container 120 via the container adapter 122 and liquid interface 124 along with water from the household water supply via supply conduit 52, mix the treating chemistry and water within the pump 126, and dispense the mixture to the treating chamber 18 via the dispensing outlet conduit 64 and the nozzle 66.

The pump 126 is beneficial in that it pumps in response to water pressure from the household water supply 40 and does not require electricity. Not only does this reduce costs and complexity, but it also provides substantial design freedom on where the pump 126 may be located.

That the pump 126 pre-mixes the treating chemistry and the water prior to dispensing to the treating chamber 18 is further beneficial in that the pre-mixing tends to yield a more evenly distributed concentration of treating chemistry, which avoids treating chemistry "hot spots" of high concentrations. The more evenly distributed concentration makes it safer to directly introduce the mixture into the treating chamber 18 without concern for concentration effects on the laundry within the treating chamber. The pre-mixing is further beneficial in that the mixing from the pump 126 is sufficiently great enough to break up the vesicle of amalgamated treating chemistry. The mixing within the pump 126 produces sufficient shear forces to break of the vesicles into the individual molecules, which promotes a more even distribution of the treating chemistry within the mixture.

The pump 126 is further beneficial in that it outputs small doses of treating chemistry, on the order of a few milliliters per discharge. Thus, it is possible to dispense very accurate and well controlled volumes of treating chemistry at very accurate and well controlled concentrations. In one implementation, a dedicated switch 305 (FIG. 2) can be provided on the user interface to provide for the addition of a larger than normal dose of treating chemistry when the user feels the laundry needs additional detergent or cleaning. The switch could be labeled "turbo" or some other similar indicia to provide the user with suitable notice for the selection.

If the concentration of the mixture provided by the pump is too high for the selected cycle of operation, the mixture can be diluted by adding water directly to the treating chamber 18 from the household water supply 40. One method of implementing the dilution is to dispense the mixture from the pump 126 into the tub 14, and then supply water to the tub from the household water supply 40 to create the diluted mixture, which can then be recirculated into the treating chamber 18 using the recirculation and drain system.

Figure 17:
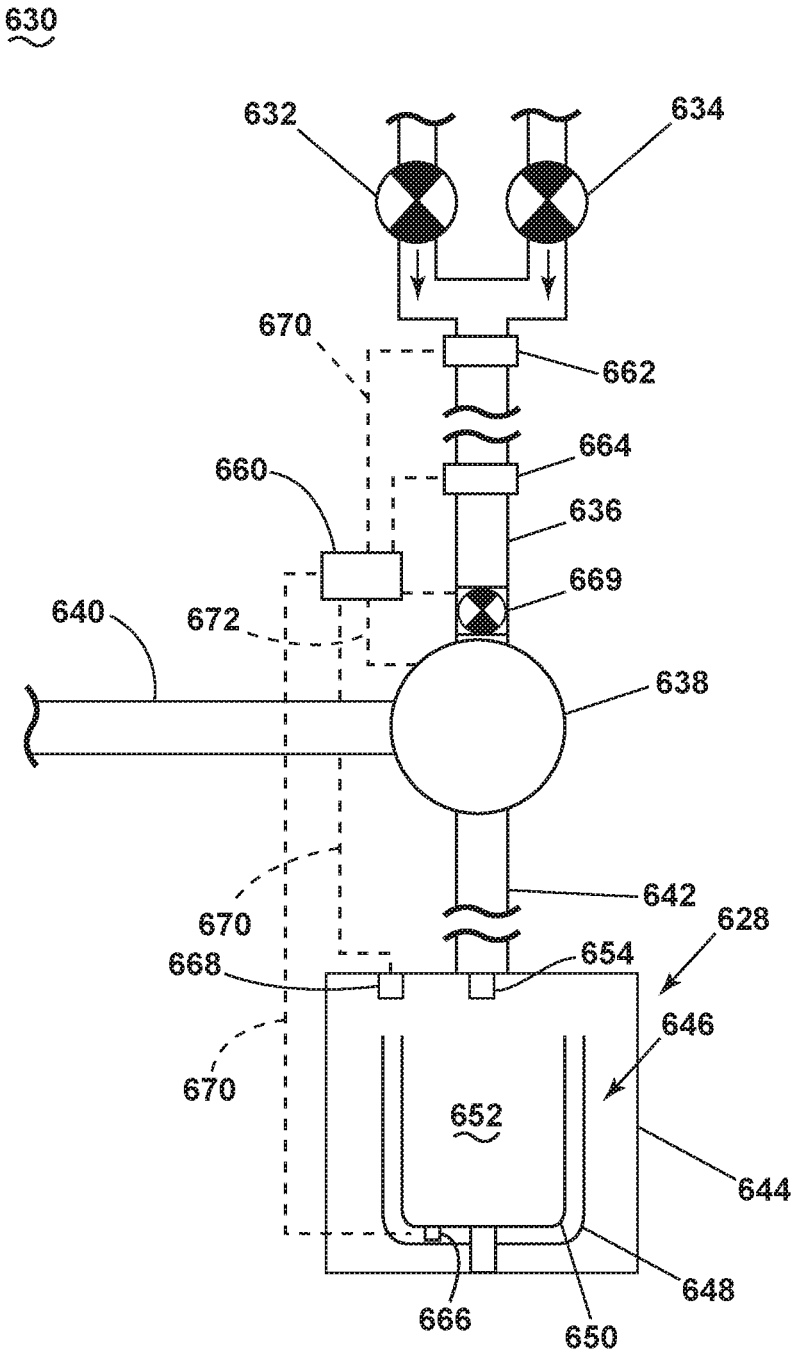
FIGS. 17, 18A, and 18B illustrate a pump system and example pumps for providing a volume of treating chemistry from a bulk container to a water conduit.
Figure 18A:
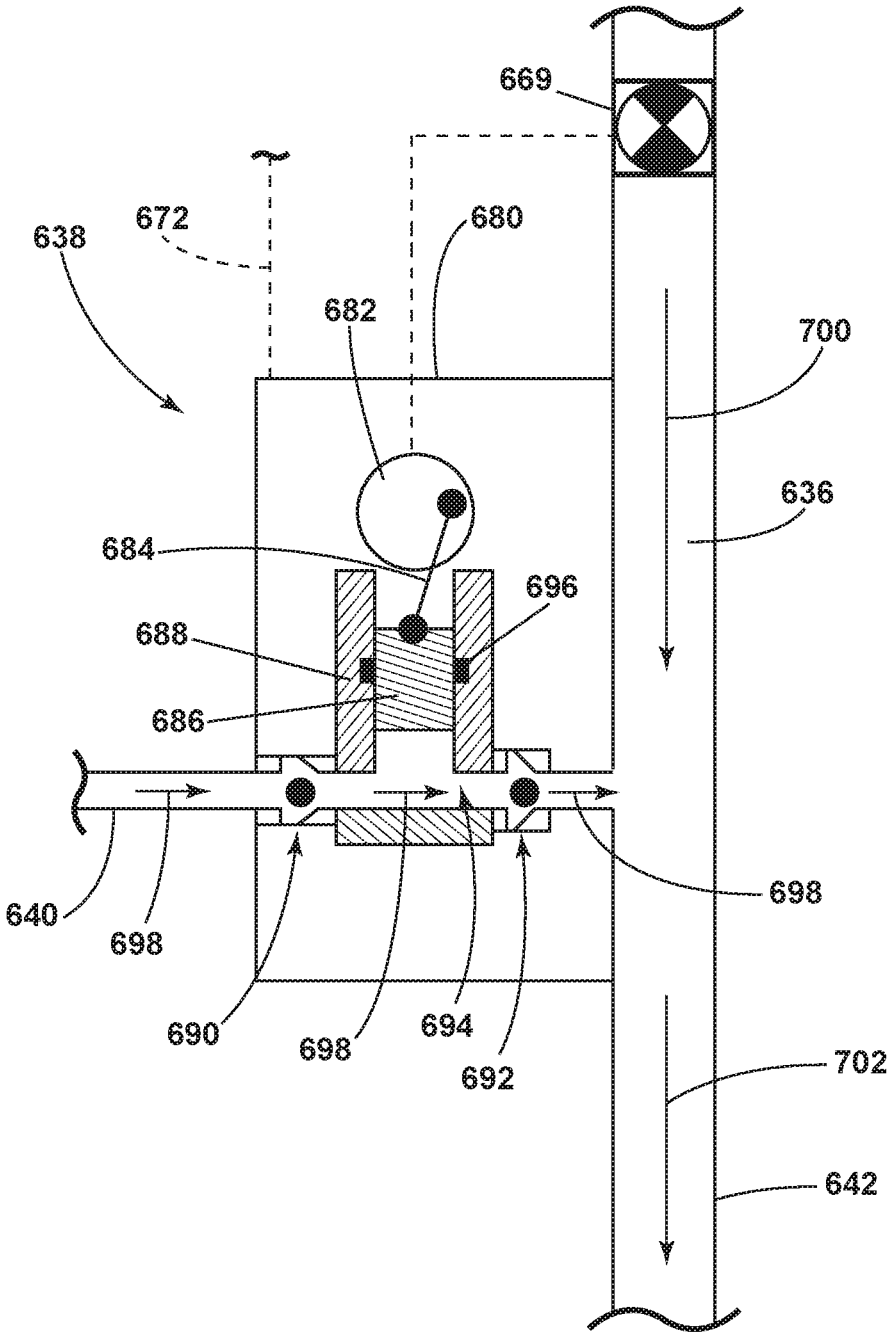
Figure 18B:
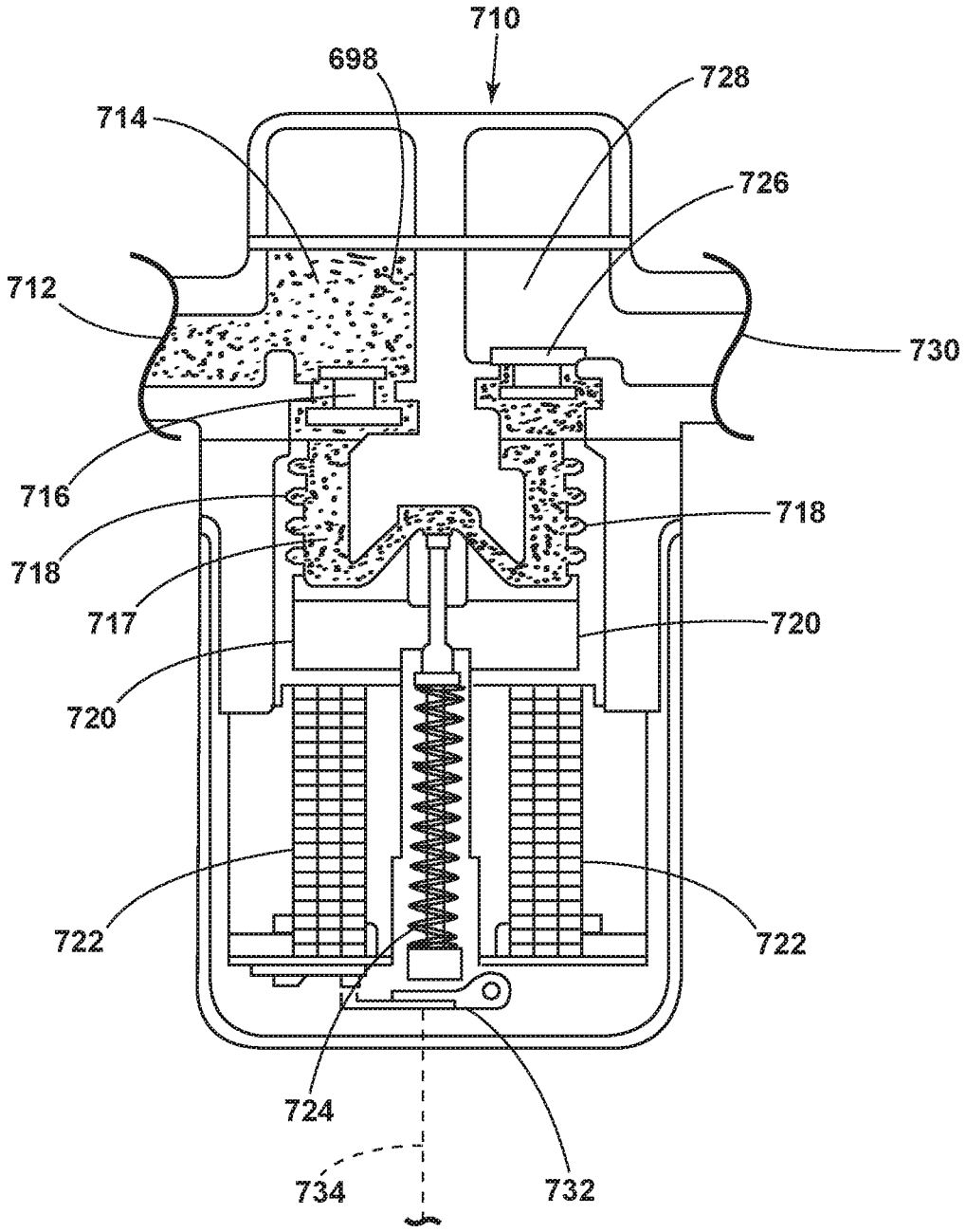
Figure 19:
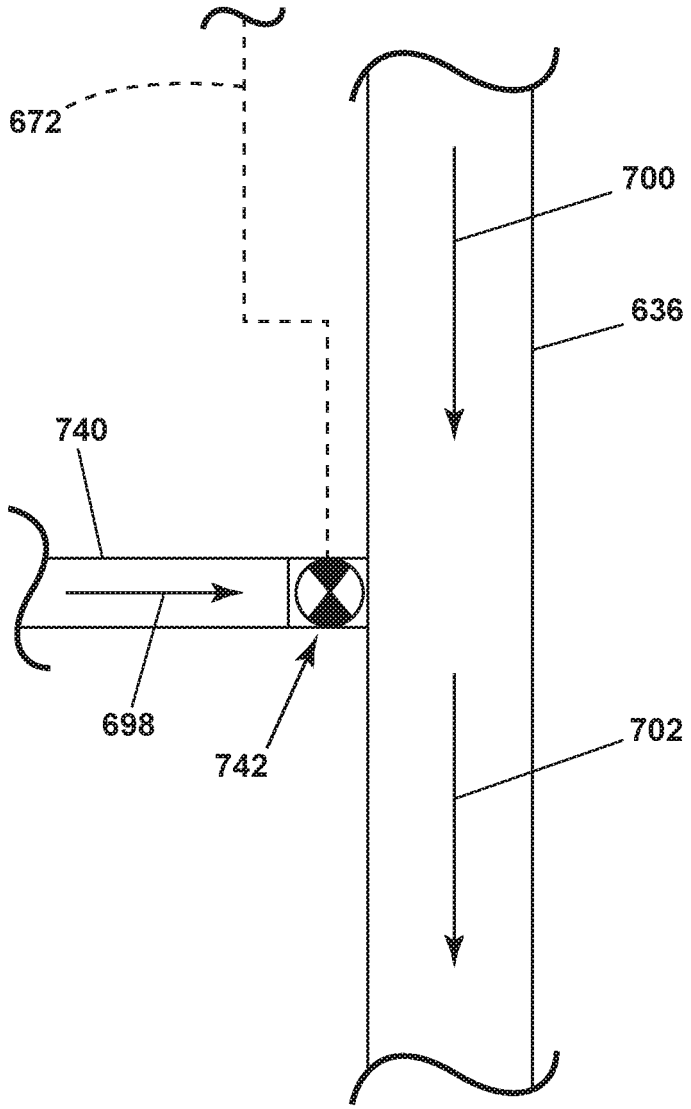
FIG. 19 illustrates a venturi for providing a volume of treating chemistry from a bulk container to the water conduit.

FIGS. 17-19 illustrate a pump system 630 for providing a volume of treating chemistry from a bulk dispenser or a bulk container to a washing machine 628, which can be any washing machine as described herein. Referring to FIG. 17, a pump 638 can be a water pressure pump as described in U.S. Publication No. 20150360848, published Dec. 17, 2015, and entitled "PRESSURE-DRIVEN METERED MIXING DISPENSING PUMPS AND METHODS", whose disclosure is incorporated by reference. The washing machine 628 can be any washing machine described herein, and is illustrated as a vertical axis washing machine, for example. The pump system 630 includes a hot water inlet 632 and a cold water inlet 634. A water conduit 636 is in fluid communication with the hot and cold water inlets 632, 634. The pump 638 couples to the water conduit 636. A chemistry conduit 640 also couples to the pump 638. A mixed conduit 642 extends from the pump 638 to the washing machine 628.

The pump 638, as a water pressure pump, utilizes a flow of water from the water conduit 636 to draw a volume of treating chemistry from the chemistry conduit 640. The drawn treating chemistry is mixed with the flow of water to provide a mixture of treating chemistry and water into the mixed conduit 642, which can be provided to the washing machine 628 during a cycle of operation.

The washing machine 628 can be any suitable washing machine 628, such as a vertical or horizontal axis washing machine. As shown, the washing machine 628 is a vertical axis washing machine 628 having a housing 644 to define an interior 646. A tub 648 and a basket 650 are disposed in the interior 646. A treating chamber 652 is defined within the basket 650 for treating a load of laundry. An outlet 654 can fluidly couple the mixed conduit 642 to the treating chamber 652.

The pump system 630 can further include a controller 660. The controller 660, for example, can be the controller of FIG. 2. One or more sensors can be disposed in the pump system 630. As illustrated, a pressure sensor 662 can be disposed on the water conduit 636, a flow meter 664 can be disposed on the water conduit 636, a weight sensor 666 can be disposed on the basket 650, and a load sensor 668 can be disposed on the housing 644. A communication conduit 670 can communicatively couple each sensor to the controller 660. The pressure sensor 662 can determine the water pressure provided from the hot and cold water inlets 632, 634. The flow meter 664 can determine the volume of water provided by the hot and cold water inlets 632, 634 over time to determine a flow rate. The weight sensor 666 can determine the weight of the water added to the treating chamber 652. The load sensor 668 can determine the volume of laundry and liquid in the treating chamber 652. It should be appreciated that the sensors as shown and described are not limiting. More, less, or different sensors can be included in the pump system 630. In a preferred embodiment, only a single sensor is utilized to provide flow information to the controller 660.

A valve 669 can be disposed in the water conduit 636. The valve 669 can be communicatively coupled with the controller 660. The controller 660 can selectively open and close the valve 669. As such, opening and closing the valve 669 can selectively draw a desired volume or rate of treating chemistry provided from the chemistry conduit 640 by controlling the flow of water provided to the pump 638.

The sensors provide different ways for measuring a volume of water over a period of time or a water pressure. The sensors provide such information to the controller 660. The controller 660 can communicatively couple to the pump 638 over a communication conduit 672. The controller 660 controls the pump 638 based upon information relating to the water flow rates or pressures from the sensors. Based upon a signal from the controller 660, the pump 638 can control the volume, rate, or combination thereof of treating chemistry provided by the pump 638 to the mixed conduit 642. Thus, the pump 638 can provide the appropriate amount of treating chemistry to the water being provided to the treating chamber 652. The appropriate amount can be representative of a dilution, such as a ratio of treating chemistry to water to effectively treat a load.

The pump 638, in one example, can provide treating chemistry by toggling the pump 638 on for a set period time and off for a set period time, representing a duty cycle for the pump 638. Such toggling of the pump 638 can be accomplished by opening and closing the valve 669. One dose of treating chemistry can be represented as a number of duty cycles. The dose can be altered by varying the number or rate of the duty cycles in order to provide the appropriate amount of treating chemistry. Such an amount can be determinative of sensor information provided to the controller 660, which, in turn, controls the pump 638 or the valve 669. The duty cycle can vary between 7-20 actuations of the pump 638, for example, representing a volume of treating chemistry for the particular cycle of operation. Such a volume of treating chemistry can be based upon, for example, measurements from the sensors, a user selected cycle of operation, load size, load type, wash temperature, or multiple other factors dependent upon the particular load or cycle of operation.

Additionally, the volume, rate, ratio, or other value of treating chemistry can be injected by the pump according to a Dose Algorithm. A Dose Algorithm can be a set of instructions for operating the pump 638. Such instructions can be based upon measurements by the sensors 662, 664, 666, 668, as well as other input communicated to the controller 660, such as a cycle of operation entered at a user interface by a user, in one non-limiting example. The Dose Algorithm can be used to control the duty cycle of the pump 638 to provide a preferred amount of treating chemistry into the water at a preferred rate in order to minimize overall chemistry usage, while improving wash quality.

The controller 660 can particularly utilize the information related to the flow rate or water pressure from the sensors to optimize the duty cycle for the pump 638 or valve 669. The pumps shown in FIGS. 18A and 18B can be alternative pumps to the water pressure pump as described above, such as a piston-style or electric pump that are operated by water pressure or resultant of a water pressure or flow. Referring to FIG. 18A, illustrating one alternative, exemplary pump 638, the pump 638 can be a piston style pump and includes a housing 680. The pump 638 further includes a cam 682, an arm 684, a piston 686, and a head 688. An inlet valve 690 and an outlet valve 692 enclose an interior 694 of the pump 638. A seal 696 is disposed between the piston 686 and the head 688.

In operation, the cam 682 can be driven by a flow of water or by an electric signal from the controller representative of the flow of water, or a rate or pressure thereof. The cam 682 drives the arm 684 to reciprocate the piston 686. As the piston 686 reciprocates outwardly, a volume of treating chemistry is drawn through the inlet valve 690 and into the interior 694. As the piston 686 reciprocates inwardly, the volume of treating chemistry 698 is pushed through the outlet valve 692 where the treating chemistry 698 can combine with water 700 to create a mixture 702 of water 700 and treating chemistry 698 in the mixed conduit 642.

The rate of reciprocation of the piston 686 by the cam 682 can control the volume and rate at which the treating chemistry 698 is provided to the water conduit 636. Such a rate can also be determined by the size of the interior 694 and the distance the piston 686 travels.

Such rates and volumes can be utilized by the controller 660 based upon the flow rate or pressure of the water conduit 636 to determine a pump duty cycle and apply the appropriate amount of treating chemistry 698 to the water flow 700. For example, the valve 669 of FIG. 17 can be selectively opened or closed to provide a flow of water to the pump 638. Such a flow of water can drive the cam 682 to provide a volume of treating chemistry to the mixed conduit 642. Thus, it should be appreciated that the pump 638 can provide a volume of treating chemistry as a function of the flow of water. Such a function can be based upon measurements of the sensors to control a duty cycle of the pump 638.

In another example, such information can be utilized as a Dose Algorithm operating as a program within the controller. The Dose Algorithm can be representative of the flow rates and volumes of the water supply and the treating chemistry. The Dose Algorithm can utilize the flow rates or pressures to minimize pump actuation, thus minimizing the duty cycle of the pump 638 and improving cycle times while minimizing treating chemistry usage. In a specific example, the Dose Algorithm can take the measure flow rates or pressures to selectively control the valve 669 to control the duty cycle of the water pressure pump providing an optimized amount of treating chemistry to the washing machine.

FIG. 18B illustrates another alternative pump as an electric bellows pump 710. The bellows pump 710 includes an inlet 712, an inlet chamber 714, an inlet valve 716, a bellows 718, an armature 720, a coil 722, a spring 724, an outlet valve 726, an outlet chamber 728, and an outlet 730. The bellows defines an interior 717 of the bellows pump 710. During operation, a volume of treating chemistry 698 is drawn in the inlet 712 and passes through the inlet chamber 714 and passes through the inlet valve 716. The armature 720 reciprocates via the coil 722 and the spring 724 to increase and decrease the volume of the interior 717. The treating chemistry 698 fills the interior 717 during an inlet stroke. During an outlet stroke, the armature 720 closes, decreasing the volume of the interior 717 and pushes the treating chemistry out the outlet valve 726, into the outlet chamber 728 and exits through the outlet 730.

The coil 722 is a solenoid that drives the spring 724 to actuate the armature 720 to operate the bellows pump 710. A contact arm 732 can be in communication with a controller, such as the controller 660 of FIG. 17, via a communication conduit 734. The contact arm 732 can be selectively opened and closed to provide electricity to the solenoid coil 722 to selectively actuate the armature 720 to control the flow rate of the pump 710. Such control of the contact arm 732 can be maintained by the controller 660, which can be determined by information provided to the controller 660 by the sensors of FIG. 17. As such, the current provided to the coil 722 can control the rate at which the pump 710 provides treating chemistry or to selectively operate the pump 710.

In one example, operation of the bellows pump 710 can be based upon the Dose Algorithm. The rate at which treating chemistry is provided by the bellows pump 710 can minimize the duty cycle of the strokes and the operation of the pump 710, as well as improving cycle time and optimizing treating chemistry usage. The controller 660 can utilize water pressure or flow rate information to optimize the operation of the bellows pump 710 input into the Dose Algorithm.

FIG. 19 illustrates another method for providing a volume of treating chemistry 698 to the water conduit 636. A venturi conduit 740 can couple to the water conduit 636 providing fluid communication between the treating chemistry 698 and the water supply 700. During operation, water 700 flows through the water conduit 636. As the water 700 passes by the venturi 740, a vacuum is created within the venturi conduit 740 as well as the reservoir, such as a bulk container or dispenser, to which the venturi conduit 740 couples. Such a vacuum draws a volume of treating chemistry 698 into the water conduit 636. The venturi conduit 740 can be designed to draw treating chemistry at a predetermined rate. For example, the cross-sectional area of the venturi conduit 740 can be predetermined to draw the treating chemistry 698 at a predetermined rate relative to the flow rate of the water 700 through the water conduit 636. Additionally, the venturi 740 can include a valve 742 in communication with the controller 660. The controller 660 can selectively open the valve via the communication conduit 672 to provide treating chemistry 698 at predetermined times. The controller 660 can be in communication with sensors, such as those of FIG. 17, to determine an appropriate rate for dispensing treating chemistry from the venturi conduit 740. Such a rate can be determined based upon a duty cycle operated through opening and closing the valve 742. Additionally, such an operation of the valve 742 can be determined by a Dose Algorithm controlled by the controller 660. For example, during a wash cycle, the valve 742 can be opened to provide treating chemistry 698, but during a rinse cycle, the valve 742 can be closed to prevent treating chemistry from entering the water conduit 636.

Figure 20:
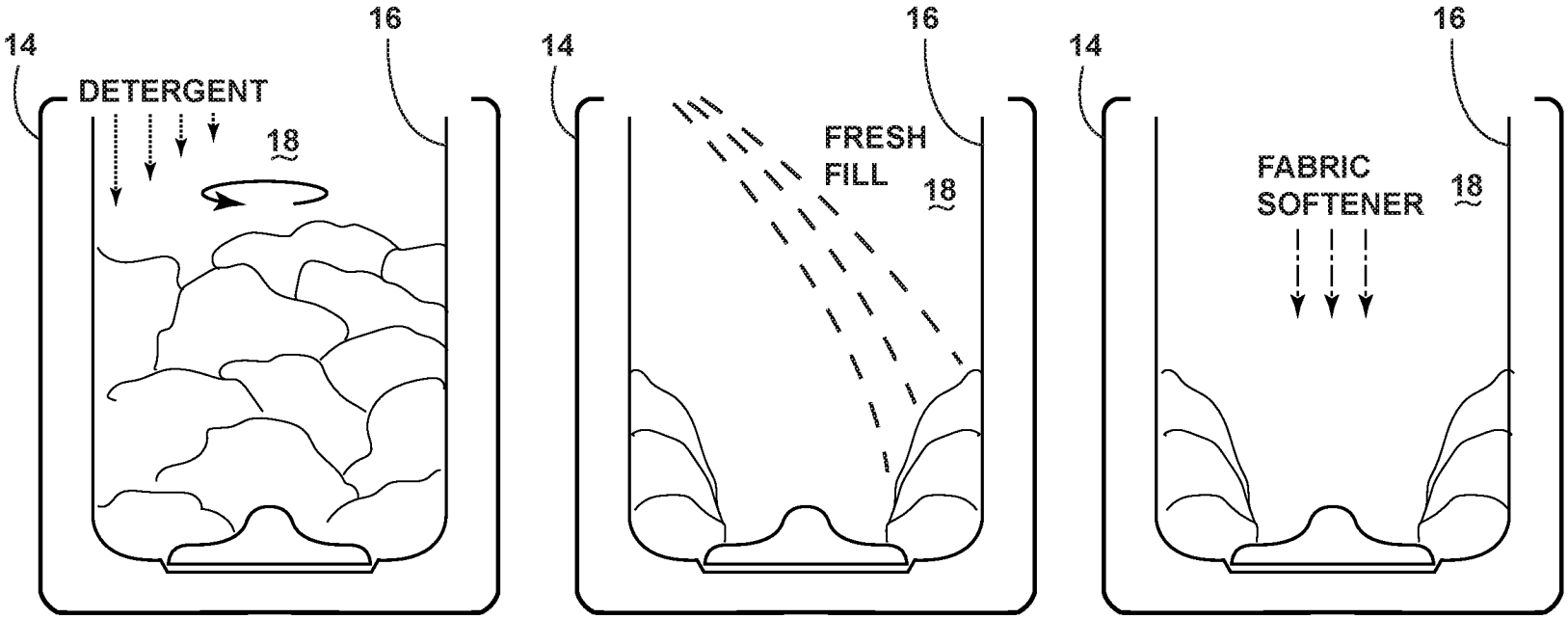
FIG. 20 is a schematic illustrating different treating chemistry supply approaches.

As illustrated in FIG. 20, in the environment of a vertical axis washing machine having a tub 14 and a drum 16 in the form of a basket, a few of the treating chemistry supply scenarios for exemplary treating chemistries of detergent, fresh fill water, and fabric softener. The mixture of water and detergent outputted by the pump 126 can be sprayed from the nozzle 66 generally directly down and along a side of the basket while the basket is being rotated. The fresh fill water can be sprayed across the basket from the nozzle 56 after the laundry has been spun into an annulus, with or without the spraying occurring during rotation of the basket. Fabric softener can be sprayed directly from the pump 126 into the center of the basket, especially after the laundry has been spun in an annulus.

To implement the different spray scenarios in FIG. 20, it is contemplated that a different nozzle 66 may be used for each of the different spray patterns. The different nozzles 66 may be connected to the dispensing outlet conduit 64 by a valve, which is controlled by the controller 96 to select the appropriate nozzle.

Figure 21:
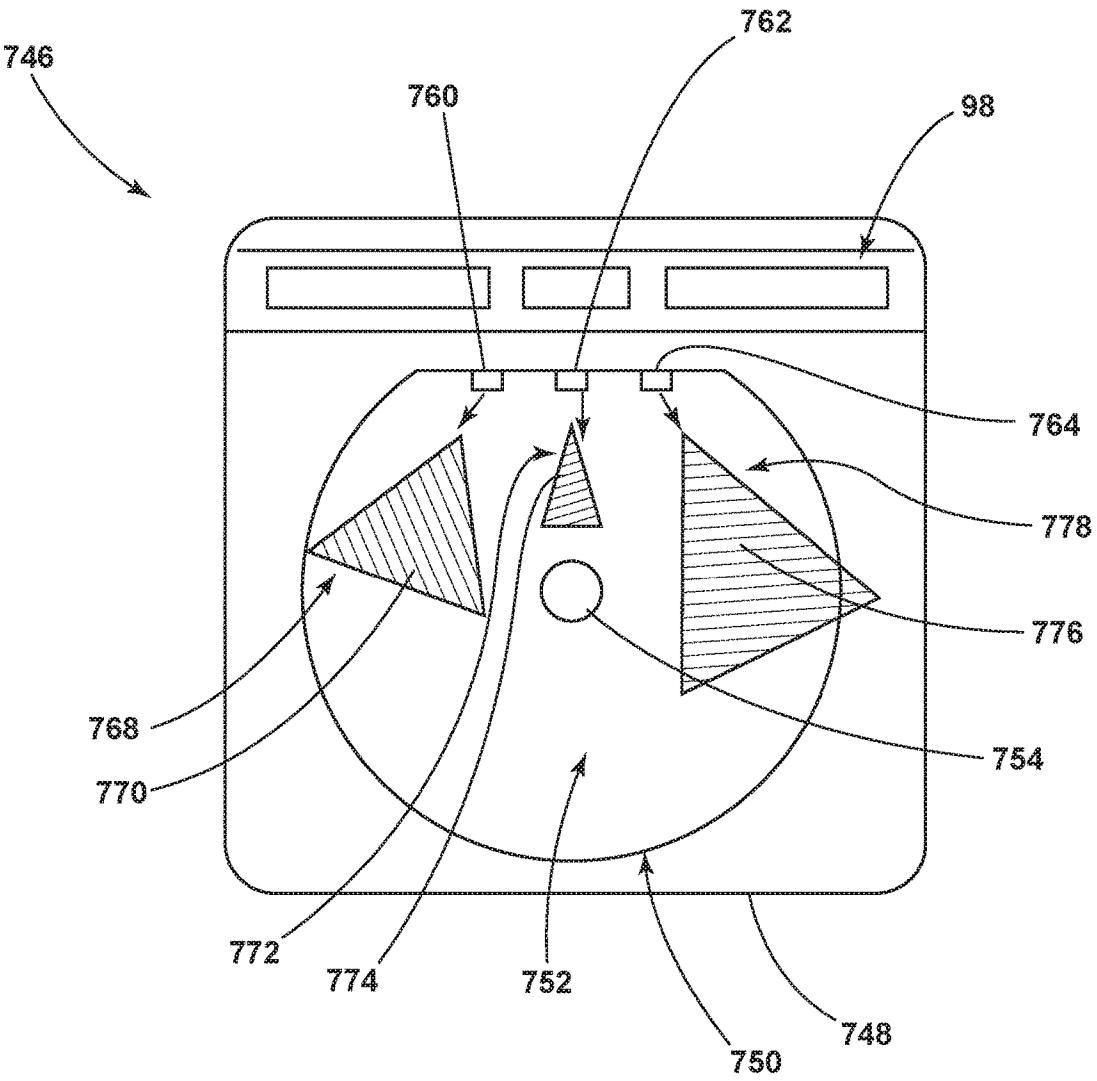
FIGS. 21-23 illustrate spray patterns for dispensing treating chemistry into a washing machine.

FIGS. 21-26 illustrate different spray patterns for providing treating chemistry to a washing machine 746 and nozzles for providing the treating chemistry at such spray patterns. FIG. 21 illustrates a top view of the washing machine 746 having a cabinet 748. The washing machine 746 is a vertical axis washing machine, having an access opening 750, a basket 751 defining a treating chamber 752, and a clothes mover 754. The user interface 98 is disposed on the top of the washing machine 746 behind the access opening 750, but can be at other locations. The washing machine 746 can further include one or more nozzles, illustrated as a detergent nozzle 760, a softener nozzle 762, and a water nozzle 764. It should be understood that the nozzles as shown are non-limiting, and more, less, or different nozzles are contemplated.

Figure 45:
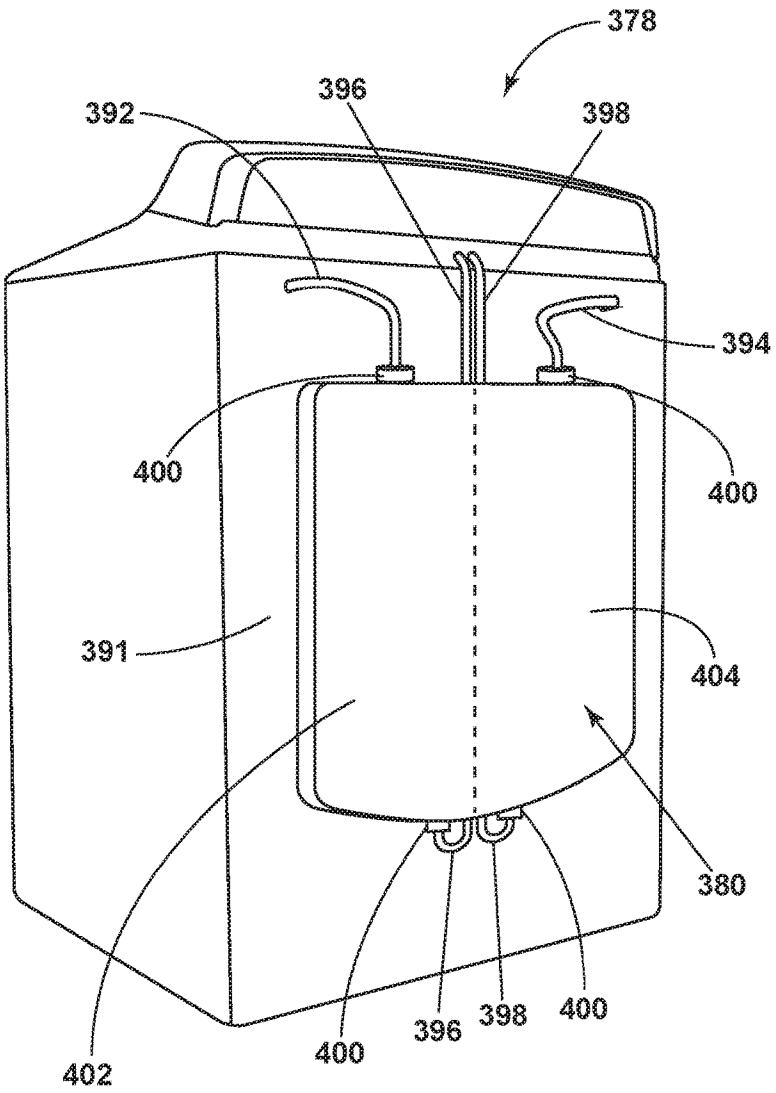
FIGS. 44-46 illustrate a bulk container mounted to the rear of the washing machine having inlets disposed beneath a lid.

The detergent nozzle 760 can spray a detergent mixture 770 toward one side of the basket 751. The detergent mixture 770 can be a mixture of water and detergent treating chemistry. The mixture 770 is sprayed in a fanned pattern 768 in order to extend between the basket 751 and the clothes mover 754. During spraying of the mixture 770, the basket 751 can be rotated at an initial speed. Such a rotation, for example, can be about 20 revolutions per minute (rpm). By rotating the basket 751 and spraying the detergent mixture 770 at the fanned pattern 768, a flat spray is provided to the load and the detergent mixture 770 can be evenly applied to a load of clothing within the treating chamber 752. The fanned pattern 768 can provide a thin, flat curtain of the detergent mixture 770 across the load. The fanned pattern 768 can be designed to apply more detergent mixture to the area of the load that has the most laundry. For example, if the majority of the load is disposed in the radially outer two-thirds of the drum, the fanned pattern 768 can provide the majority of the detergent to that area. Twenty rpms is well below a "spin" speed, which is the rotational speed at which the centrifugal force on the inner surface of the drum is 1 g or greater. A spin speed for the wash of FIG. 45 is typically in the range of 60-90 rpm, depending on the diameter of the basket.

Typical washing machines can dispense detergent into the sump or into the load in a concentrated dose. Such dispensing results in uneven distribution of detergent. Utilizing the detergent nozzle 760 to spray the detergent mixture 770 at the fanned pattern 768 while rotating provides even distribution of the detergent across the load to provide a consistent cleaning to the load.

The softener nozzle 762 can spray a softener mixture 772 at a cone-shaped pattern 774, which is narrower than the fanned pattern 768, having a somewhat circular splash pattern. The softener mixture 772 can be a mixture of fabric softener treating chemistry and water. The softener mixture 772 can be sprayed at the cone-shaped pattern 774 at the clothes mover 754 after the basket has been rotated closer to or greater than a spin speed to form the laundry into an annulus about the clothes move, and when there is liquid at a level in the basket. Thus the cone-shaped pattern 774 will be directed into the liquid within the annulus of the laundry and will not directly contact the laundry. This provides for a uniform distribution of the softener, which is able to disperser through the water first before coming into contact with the load, which also prevents "hot spots" of softener on the load, which is not desirable with fabric softener. It should be understood that the cone-shaped pattern 774 is exemplary, and any shaped pattern can be used to spray the softener into the basket without contacting the laundry. However, since a spin cycle typically moves the clothes radially outward along the basket, it is preferable to spray the softener mixture 772 in a cone-shaped pattern 774 toward the clothes mover 754 to avoid direct application to the laundry.

The water nozzle 764 can spray water 776 at another streamed pattern 778 onto the load across the basket 751. The streamed pattern 778 can be a thick, flat flow of liquid extending across a portion of the load between the basket 751 and the clothes mover 754. The streamed pattern 778 can be designed to provide a majority of the liquid where the load will be during the high speed spin portion of the cycle. The extended distance of the water 776 in the streamed pattern 778 results in an even distribution of water among the load rather than soaking a portion of the load and relying on the water to pass among the rest of the load. During such a spray of water 776, the basket 751 can be rotated, such as at least 1 g, where g=gravitational acceleration, or above 65 rpm for typical basket diameters. The rpm can be higher and heightened rotational speed can help to reduce the amount of water needed to rinse the load, however, such a rotational speed needs to be balanced between improved cleaning and reduce water requirements with the tendency of the spray water 776 to splash out at a higher rpm. Additionally, spraying the water at the basket 751 can wash away any remaining detergent to clean the basket 751 during the cycle of operation. As such, proper detergent removal from the load during rinse is facilitated while maintaining a clean basket 751.

It should be appreciated that the organization of the nozzles and the resultant spray pattern can evenly distribute treating chemistries, a mixture of treating chemistries and water, water, or any other treatment or combination in treatments in an effective manner to provide even distribution among a wash load.

Figure 22:
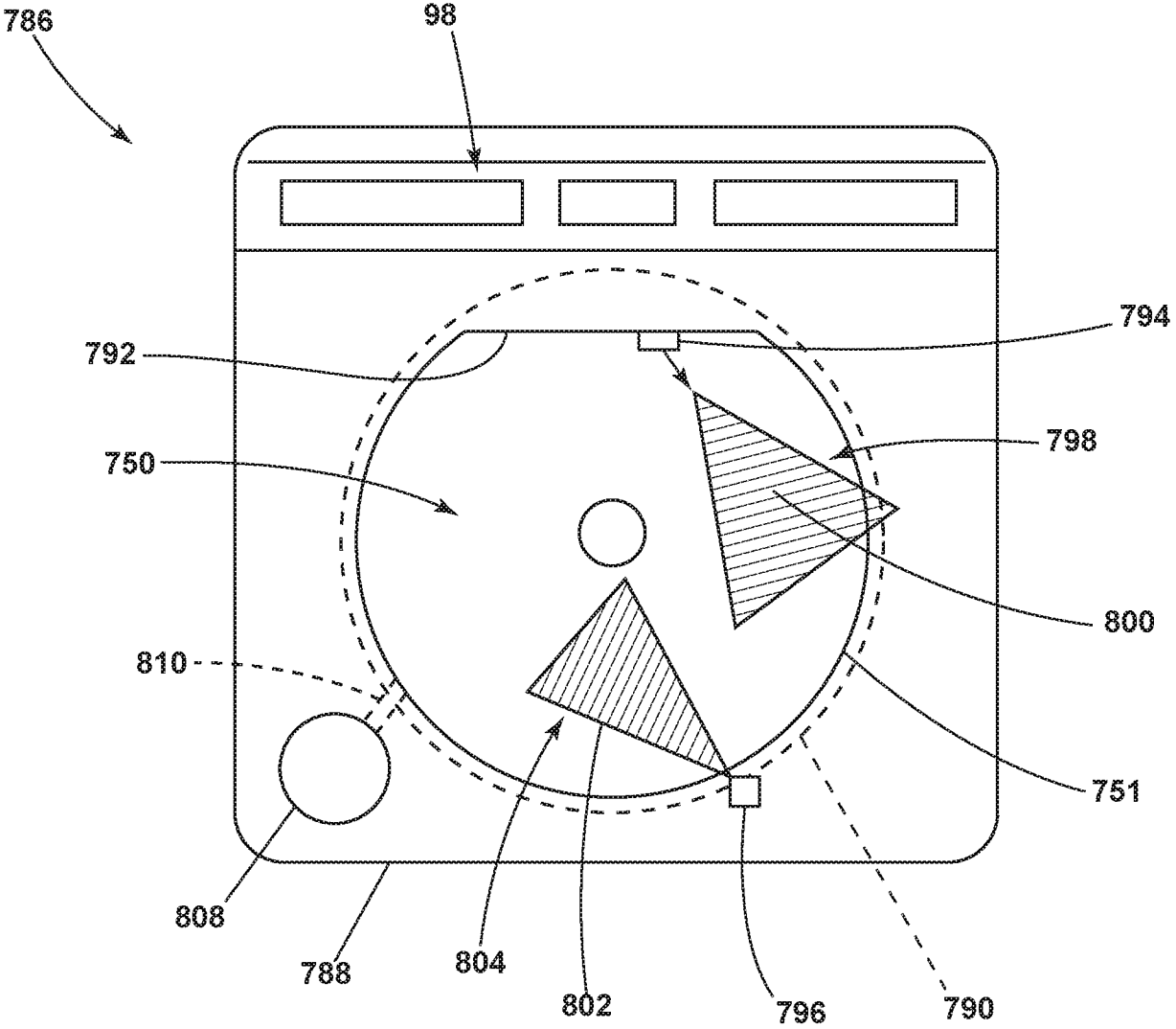

FIG. 22 illustrates an alternative embodiment for a washing machine 786 having a cabinet 788. The washing machine 786 can be substantially similar to the washing machine 746 of FIG. 21 and similar numerals will be used to describe similar elements. The washing machine 786 can have a tub 790 disposed around the basket 751. A bezel or fascia 792 can mount to the access opening 750. A first nozzle 794 can mount to the fascia 792 and a second nozzle 796 can mount to the tub 790 opposite of the fascia 792. The fascia 92 can include indicia, such as stickers, to indicate the washing machine 786 is bulk enabled, beneficial to informing a consumer about the bulk features of the washing machine 786 on a showroom floor.

The first nozzle 794 can be similar to the water nozzle 764 of FIG. 21. The first nozzle 794 can spray a volume of water 800 in a first pattern 798. The first pattern 798 can be defined by spraying the water 800 across the basket 751 to evenly distribute the water 800 among the load and to rinse the wash basket 751. Additionally the load can be slowly spun during adding the water 800, such as at 20 rpm.

The second nozzle 796 can be disposed between the tub 790 and the basket 751. The second nozzle 796 can spray a low concentration dose of detergent or fabric softener 802 at a second pattern 804. The low concentration dose can be a mixture of water and detergent or fabric softener to dilute the detergent or fabric softener as initially provided by the user to the washing machine. Spraying the low concentration detergent or fabric softener 802 between the basket 751 and the tub 790 can indirectly provide the detergent, fabric softener 802 or other treating chemistry to the load, where direct application can be detrimental to cleaning effectiveness, or non-uniform among the entire load.

The second nozzle 796 can alternatively be a recirculation nozzle 796. The recirculation nozzle 796 can provide recirculation of liquid from the sump back into the basket. For example, a detergent mixture that has drained from the load and the basket to the tub, can pass to the sump where it can be recirculated and reapplied to the load. As such, the load can receive increased interaction with the treating chemistry or detergent, requiring a lesser amount of treating chemistry per cycle. Additionally, the second nozzle 796 as a recirculation nozzle can be sprayed at the load while the basket is spinning to provide a more uniform coverage of the recirculated mixture.

In another example, where the second nozzle 796 is a recirculation nozzle during a rinse cycle, the water can be recirculated from the sump to the load to remove a greater portion of detergent or treating chemistry form the load. As such, a lesser volume of water is required during the rinse cycle. Such a lesser water volume can make the washing machine 786 more economical as well as advantageous in areas where water availability is diminished.

Additionally, the washing machine 786 can include a top wall 806 having the access opening 750 to provide access to the treating chamber 752. The top wall 806 can include an aperture 808. A conduit 810 can couple the aperture to the treating chamber 752. The aperture 808 can be used for adding additional treating chemistry to the treating chamber 752. For example, bleach can be added via the aperture 808, without intermixing the bleach with the nozzles for the other treating chemistry. Additionally, a supply of water can be provided to the aperture 808 or conduit 810 to dilute the treating chemistry provided through the aperture 808. Furthermore, a cap or cover can be provided to close the aperture 808 when not in use. Providing the bleach to the aperture 808 prevents direct disposal onto the load, facilitating even distribution of the bleach or other treating chemistry. It should be appreciated that other treating chemistries beyond bleach are contemplated, such as stain treatments in one non-limiting example. Additionally, a cap or cover can be provided to close the aperture 808 when not in use.

Figure 23:
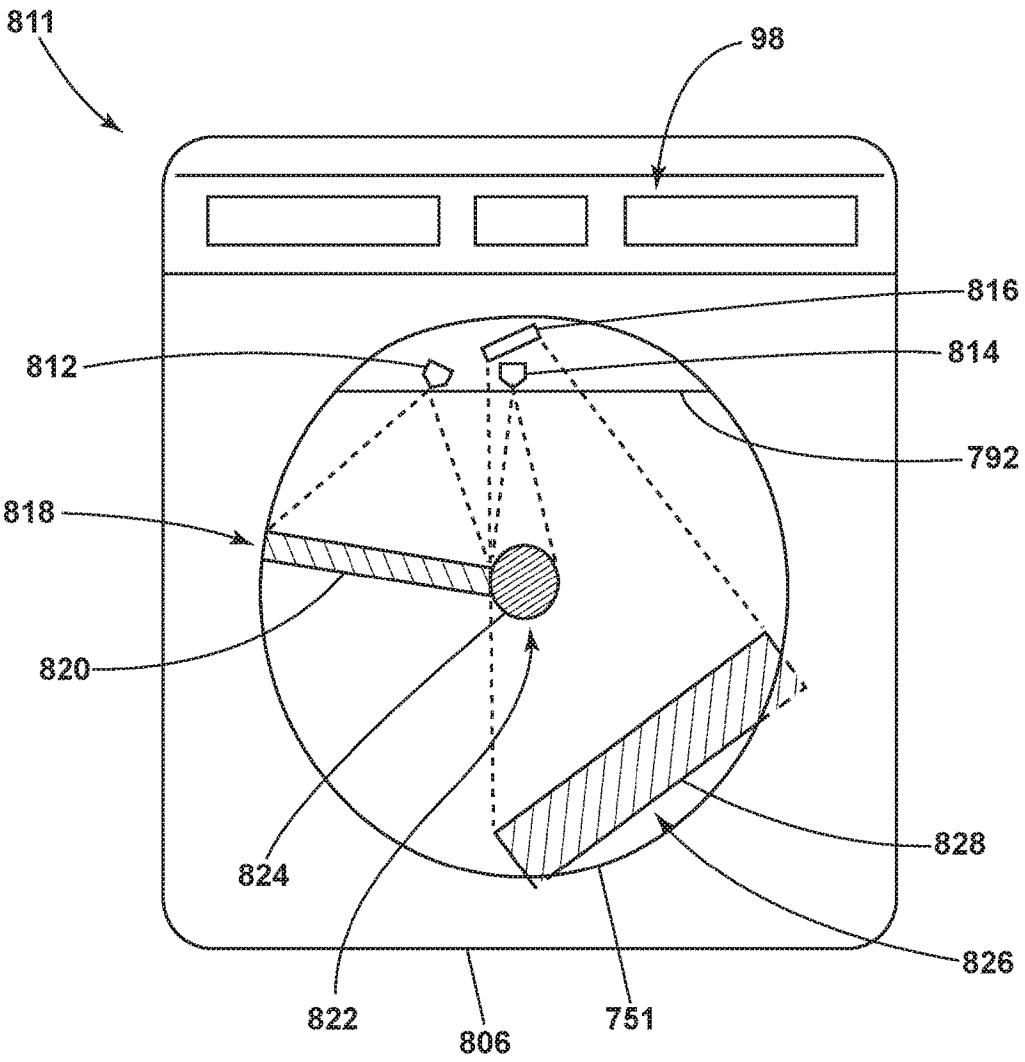

FIG. 23 illustrates another embodiment for including nozzles in a washing machine 811 having spray patterns for treating a load. FIG. 23 can be substantially similar to FIGS. 21 and 46, and similar numbers will be used to describe similar elements. The fascia 792 can house or cover three nozzles, being a detergent nozzle 812, a fabric softener nozzle 814, and a water nozzle 816. Alternatively, the nozzles can be housed in a nozzle housing (see FIGS. 29-32, for example) attached to the fascia 792 or the top wall 806. The detergent nozzle 812 can spray a detergent mixture 818 in a wide pattern 820. The basket 751 can be rotated while supplying the detergent mixture 818 to evenly treat the load as it is rotated. The wide pattern 820 can be a line or rectangular pattern that evenly covers the load between the clothes mover 754 and the basket 751. The fabric softener nozzle 814 can spray a fabric softener mixture 822 at a pattern 824 similar to that of the fanned pattern 774 of FIG. 21. The water nozzle 816 can be a wide nozzle, spraying a wide, heavy flow 826 in a linear pattern 828 against the wash basket 751 opposite of the fascia 792. Such a spray can be sprayed over the clothes mover 754 to hit the basket 751.

Figure 24:
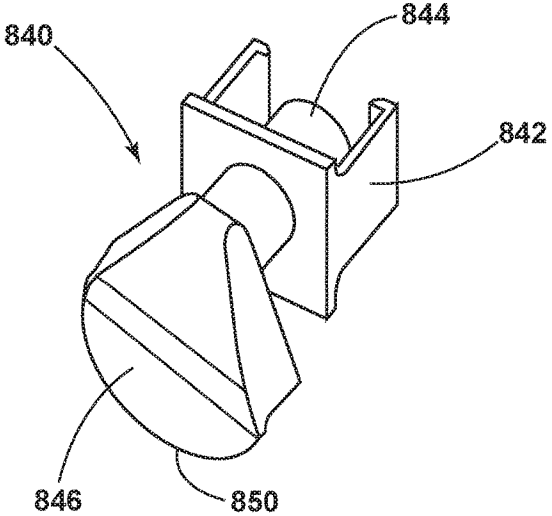

FIG. 24 illustrates a nozzle 840, which can be the detergent nozzles 760, 812 of FIGS. 21 and 23. The nozzle 840 includes a bracket 842, a conduit 844, and a head 846. The bracket 842 can mount to the washing machine 10. The mounted bracket 842 positions the conduit 844 to receive a volume of liquid, such as a mixture of detergent and water, from the washing machine 10. The conduit 844 provides the liquid to the head 846. The head 846 can be shaped to spray the mixture at the patterns 768, 820 seen in FIGS. 21 and 23. The head 846 can be diverging and have a wide mouth 850 to provide the wide spray pattern. The nozzle 840 is preferably targeted at the bottom of the basket 751 at the 9:00 position when looking at the vertical axis washing machine 10 from the front.

Figure 25:
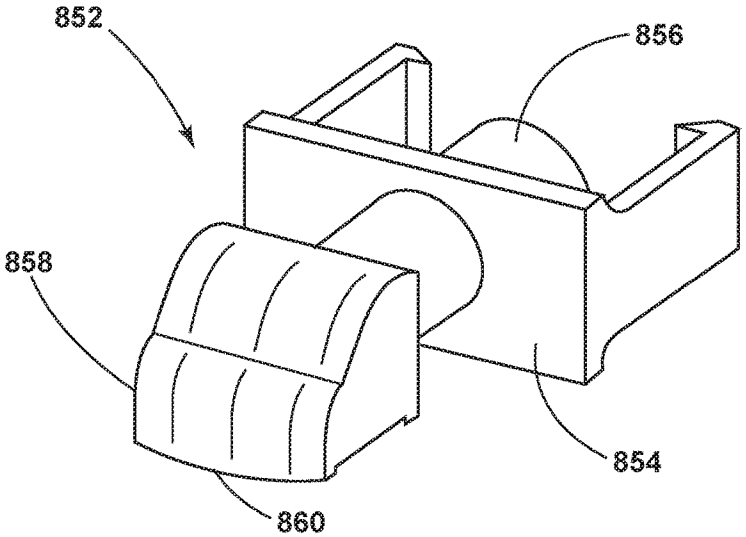
FIGS. 24-26 illustrate nozzles for dispensing treating chemistry into the washing machine in the patterns of FIGS. 21-23.

FIG. 25 illustrates a nozzle 852, which can be the softener nozzles 762, 814 of FIGS. 21 and 23. The nozzle 852 includes a bracket 854, a conduit 856, and a head 858, similar to the nozzle 840 of FIG. 24. The bracket 854 provides for mounting the nozzle 852 to the washing machine 10 and aligning the conduit 856 to receive a supply of liquid, such as a mixture of fabric softener and water. The conduit 856 can provide the supply of liquid to the head 858 for spraying in a pattern, such as the fanned pattern 774, 824 of FIGS. 21 and 23. A mouth 860 can direct the supply of liquid toward the clothes mover 754 at the bottom of the basket 751 as is shown in FIGS. 21 and 23.

Figure 26:
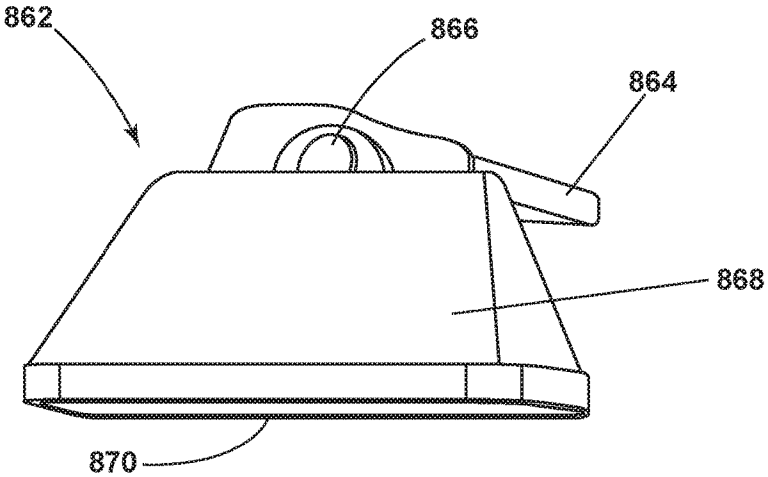

FIG. 26 illustrates yet another nozzle 862, which can be the water nozzles 764, 816 of FIGS. 21 and 23. Similar to the nozzles 840, 852 of FIGS. 24 and 25, the nozzle 862 can include a bracket 864, a conduit 866, and a head 868. The bracket 864 provides for mounting the nozzle 862 to the washing machine 10 and aligning the conduit 866 to receive a flow of liquid, such as water, to be provided to the head 868. The mouth 870 is wide to provide a wide spray pattern, such as the patterns 778, 826 of FIGS. 21 and 23. The size of the conduit 866 or the water pressure supplied from the conduit 866 can be sufficient to cover the large pattern. Additionally, the head 868 is diverging to provide for a widened spray. The water can be provided to the wall of the basket 751 or onto the load, while the basket 751 is rotated, to evenly provide a supply of liquid to the load.

Additionally, the nozzles as described in FIGS. 21-26 are organized to permit simultaneous use, without interfering with one another. As such, a treating chemistry can be applied to the load at the same time as water for filling the basket 751 without sacrificing the benefits of providing the treating chemistry evenly among the load.

Typical nozzles in the industry are made of rubber or flexible material to prevent breaking. The nozzles extend at least partially into the treating chamber, exposing them to the user where loading laundry can damage the nozzles.

Figure 27:
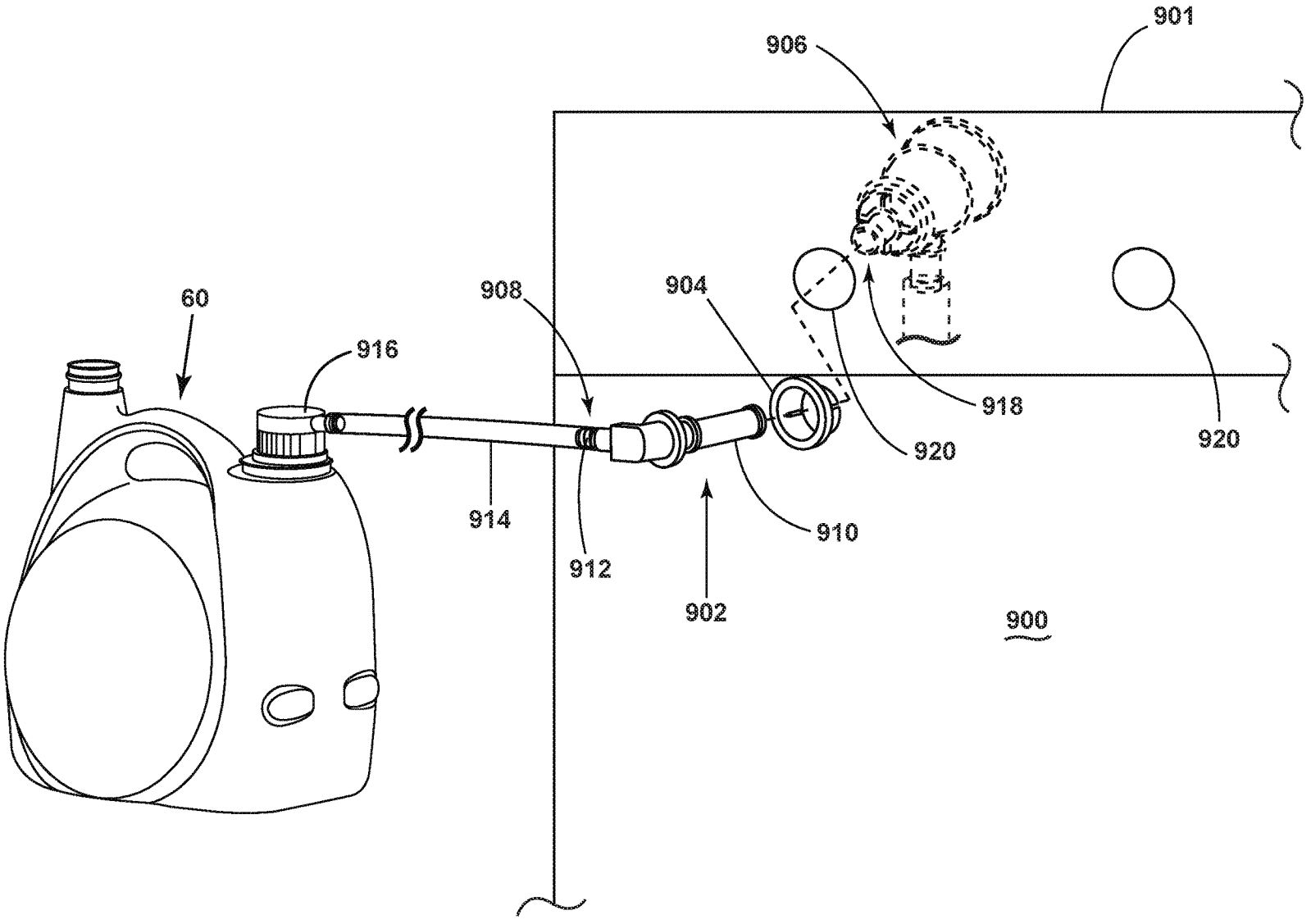
FIGS. 27-28 illustrate a system for coupling a bulk container to a water pressure pump in the washing machine.
Figure 28:
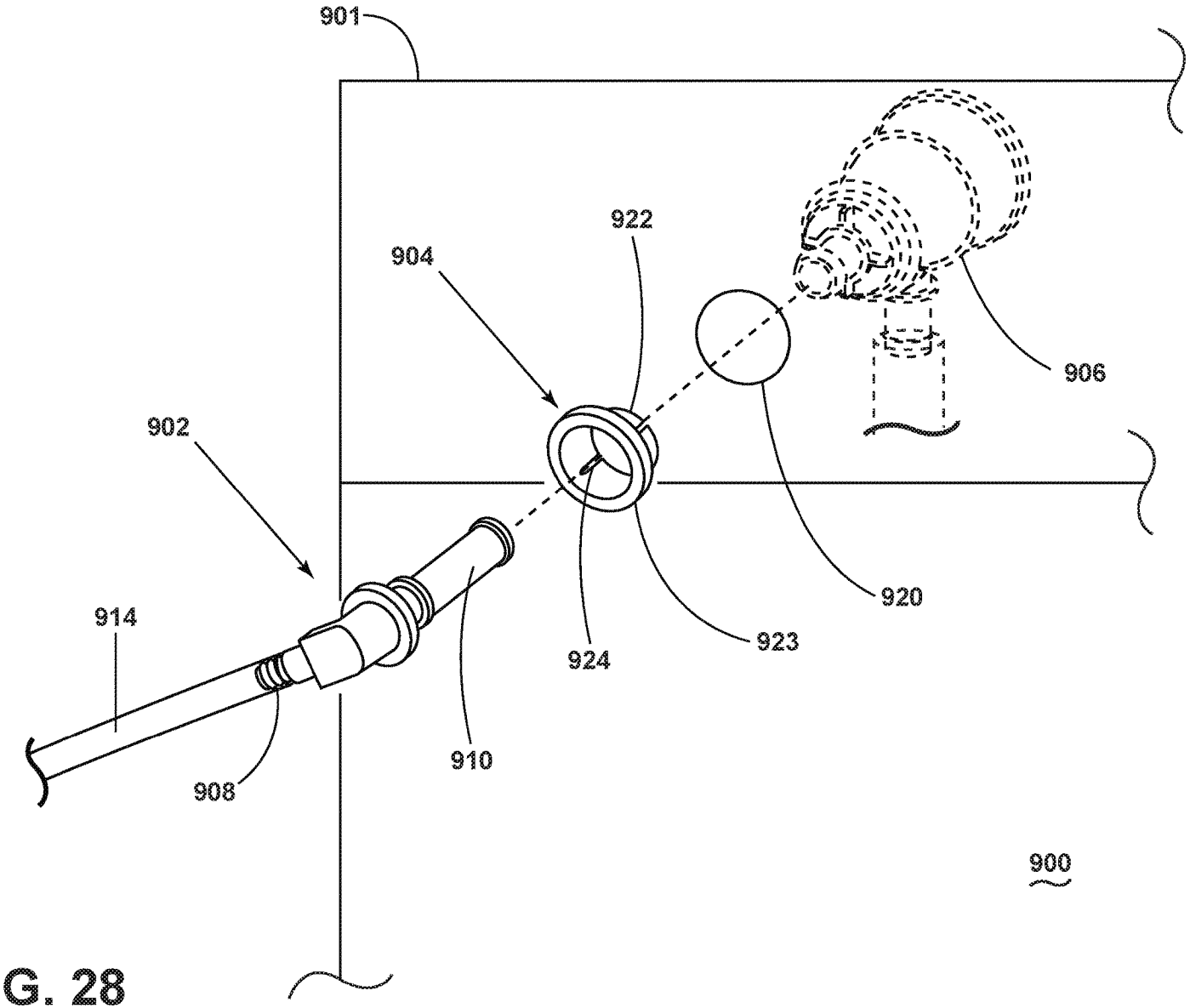
Figure 29:
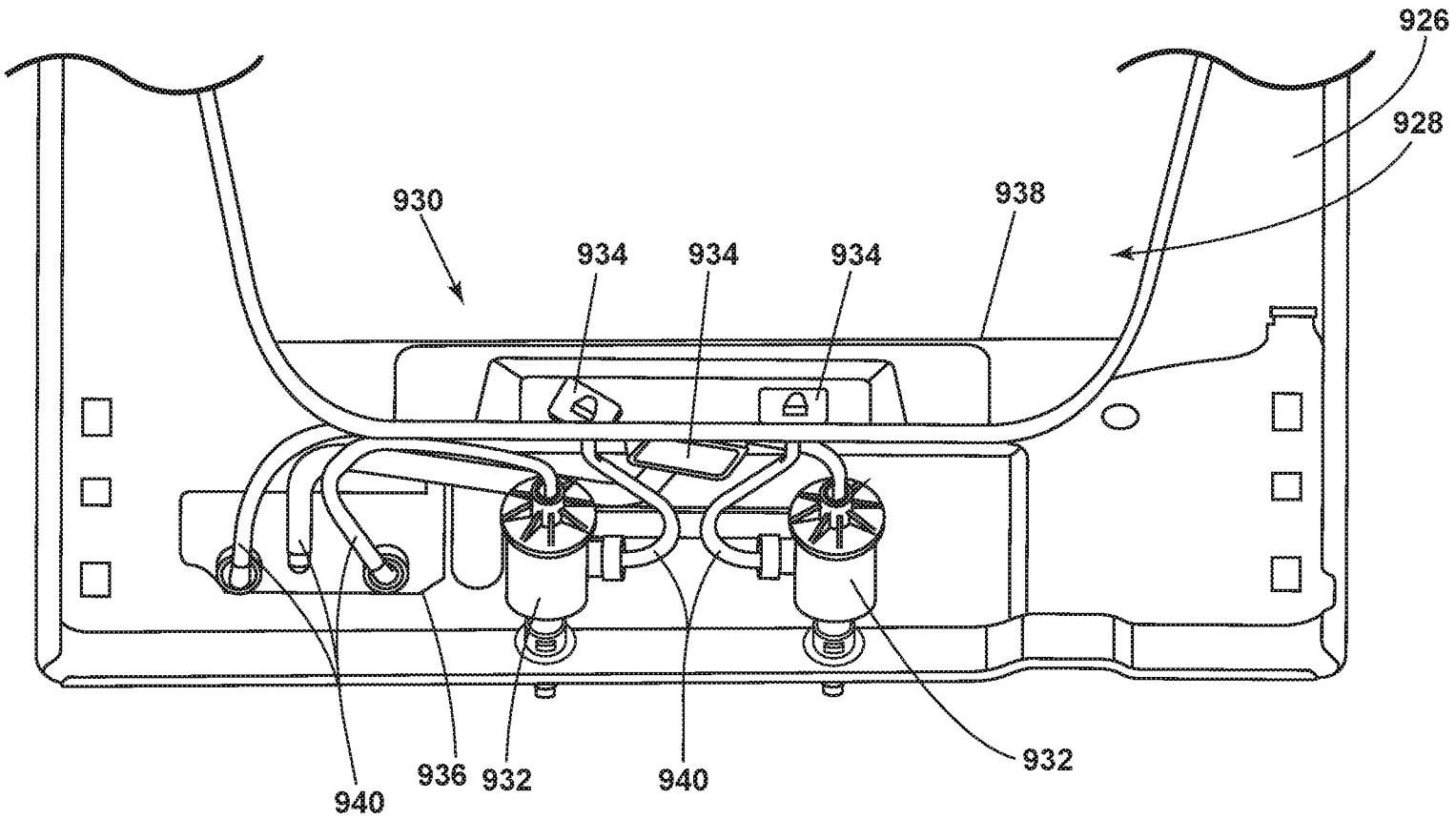
FIG. 29 illustrates a dispensing system for providing treating chemistry to the washing machine from two water pressure pumps of FIGS. 27-28.

FIGS. 27-29 illustrate a connection system 900 for coupling a bulk dispenser or a bulk container to a washing machine 901. The connection system 900 includes a spigot 902, a ring 904, and a pump 906. The spigot 902 includes an inlet 908 and an outlet 910. The inlet 908 has a male connector 912 for inserting into a conduit 914. The conduit 914 can couple the spigot 902 to the bulk dispenser 60, such as those of FIG. 3 in one example. Such a conduit 914 can be coupled to a cap 916, which can be any cap described herein, such as the cap of FIGS. 4-11. Thus, the spigot 902 can receive a volume of treating chemistry from a bulk dispenser 60, such as the bulk dispenser of FIG. 3.

The pump 906 can be any pump described herein, such as the pump of FIGS. 17-19, and can be located within the washing machine 901. While only one pump 906 is shown, the washing machine 901 can have multiple pumps 906. A female receptacle 918 can be disposed on one end of the pump 906. The female receptacle 918 can couple to the outlet 910 of the spigot 902 to fluidly couple the bulk dispenser 60 to the washing machine 901.

An aperture 920 can be disposed in the washing machine 901. The ring 904 can be sized to be received in the aperture 920. The ring 904 can align with the pump 906 to guide insertion of the spigot 902 at the ring 904 to couple the spigot 902 to the pump 906 by coupling the outlet 910 to the female receptacle 918. The ring 904 and spigot 902 can be colored similar to one another to identify the appropriate spigot 902 to be connected to the complementary pump 906. For example, the washing machine 901 can have a pump 906 for supplying a volume of detergent. The ring 904 and spigot 902, for example, can both be colored blue. When a user is attaching a bulk dispenser 60 to the connection system 900, they can properly identify which treating chemistry is provided to the proper pump 906 by attaching the colored spigot 902 to the similar pump 906 at the similar colored ring 904. As such, if a washing machine 901 includes pumps for multiple treating chemistries, a user can properly provide the treating chemistries to the washing machine 901 such that the loads are properly treated.

Referring to FIG. 28, the ring 904 can have an annular portion 922 and a flange 923. Slits 924 can be disposed in the annular portion 922. During manufacture of the washing machine 901, the rings 904 can be inserted into the aperture 920. The slits 924 permit depression of the annular portion 922 for insertion into the aperture 920, and expansion to secure the ring 904 within the aperture 920. Thus, the pumps 906 for receiving a volume of treating chemistry from a bulk container or dispenser can be properly identified by the manufacturer to facilitate proper use and performance of the washing machine 901 by the consumer.

Additionally, it is contemplated that the ring 904 or the pump 906 can be communicatively coupled to the controller 96. Upon interconnection of the connection system 900, the washing machine 901 can signal the user that the connection is proper or improper. Examples of such signals can include but are not limited to a light on the user interface or display, an audible sound, or the similar sensor signals. In another example, if the connection is improper, the washing machine 901 may prevent starting of a requested cycle of operation until a proper connection is made.

Such improper or proper connections can be measured in multiple ways. In one example, an electrical connection can be made upon connecting the spigot 902 to the pump 906. Upon making the electrical connection, a circuit can be completed. Such completion can be communicated to the controller identifying the proper or improper connection of the system 900.

FIG. 29 illustrates a bottom view of a top wall 926 having an access opening 928 and a pump system 930. The pump system 930 includes at least one pump 932 and at least one nozzle 934, illustrated as two pumps 932 and two nozzles 934. The pump system 930 can further include a manifold 936. The pumps 932 can be any pump described herein, such as the pumps of FIGS. 17-19. The nozzles 934 can be any nozzle described herein, such as the nozzles of FIGS. 24-26. The nozzles 934 can be disposed underneath a fascia 938 for providing a volume of liquid to a treating chamber of the washing machine 901, while protecting the nozzles 934 from damage. A system of conduits 940 can couple the manifold 936 to the pumps 932 and nozzles 934, or the pumps 932 to the nozzles 934.

Figure 30:
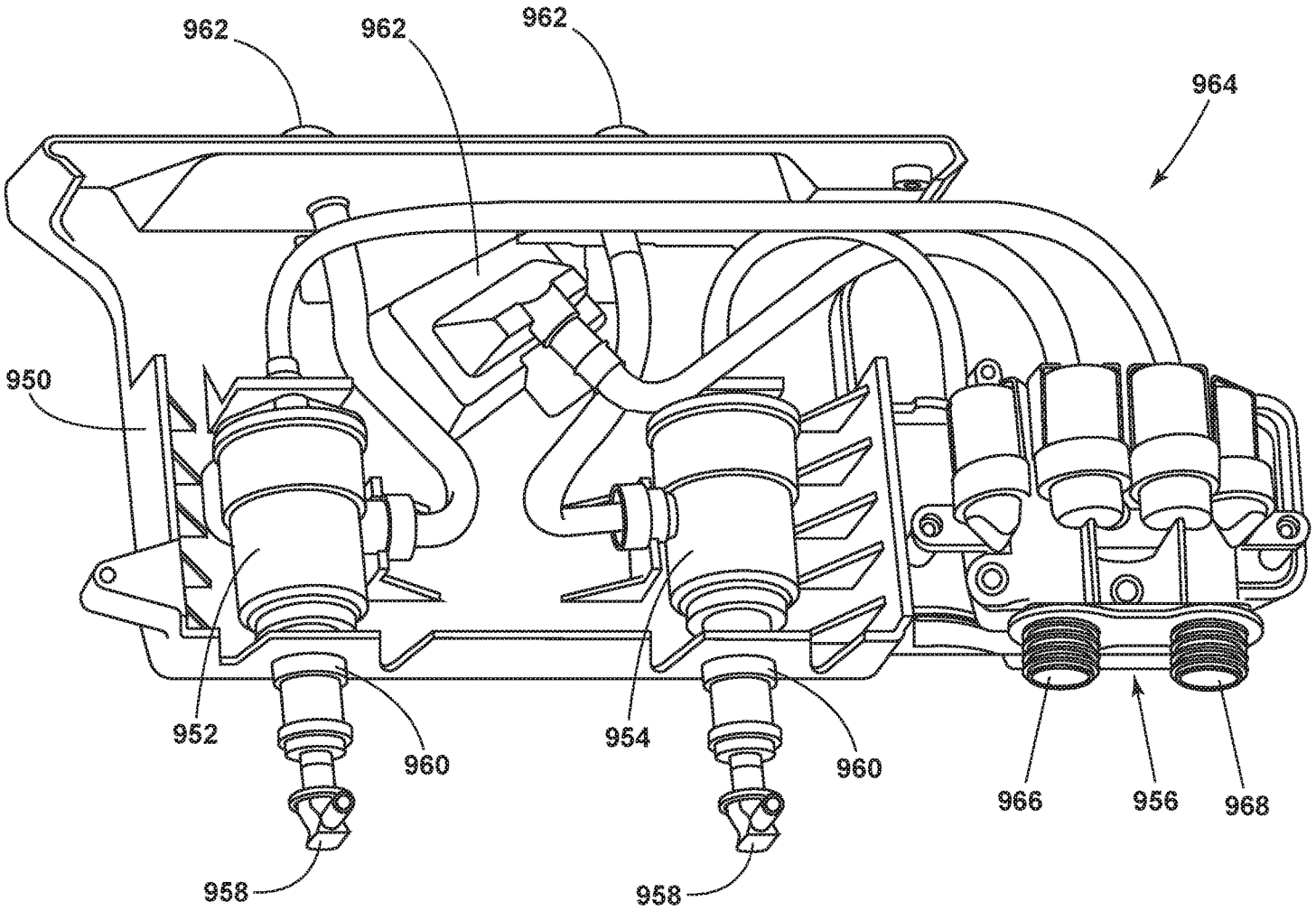
FIG. 30 illustrates the dispensing system of FIG. 29 including a tubed design.

Referring to FIG. 30, the pump system 930 can include a housing 950. A first pump 952 and a second pump 954 mount within the housing 950. A manifold 956 can mount to the side of the housing 950. Optionally, a spigot 958 can mount to the pumps 952, 954 through apertures 960 in the housing 950. Such an example is illustrated in FIGS. 27 and 28. Three nozzles 962 (FIGS. 24-26) can mount to the housing 950. A plurality of conduits 964 can interconnect the nozzles 962, pumps 952, 954, and the manifold 956.

The manifold 956 can include a hot water inlet 966 and a cold water inlet 968. The manifold 956 can provide a supply of water to the nozzle 962 through a conduit 964 for providing water to the treating chamber. Similarly, the manifold 956 can supply water to the pumps 952, 954. The pumps 952, 954 can utilize the water along with a volume of treating chemistry from the spigots 958 to create a mixture. Such a mixture can be provided from the pumps 952, 954 to a nozzle 962 for dispensing into the treating chamber for treating a load.

The housing 950 can be utilized to create a modular design for providing a supply of water and treating chemistry to a washing machine 10 while incorporating a bulk dispensing system.

Figure 31:
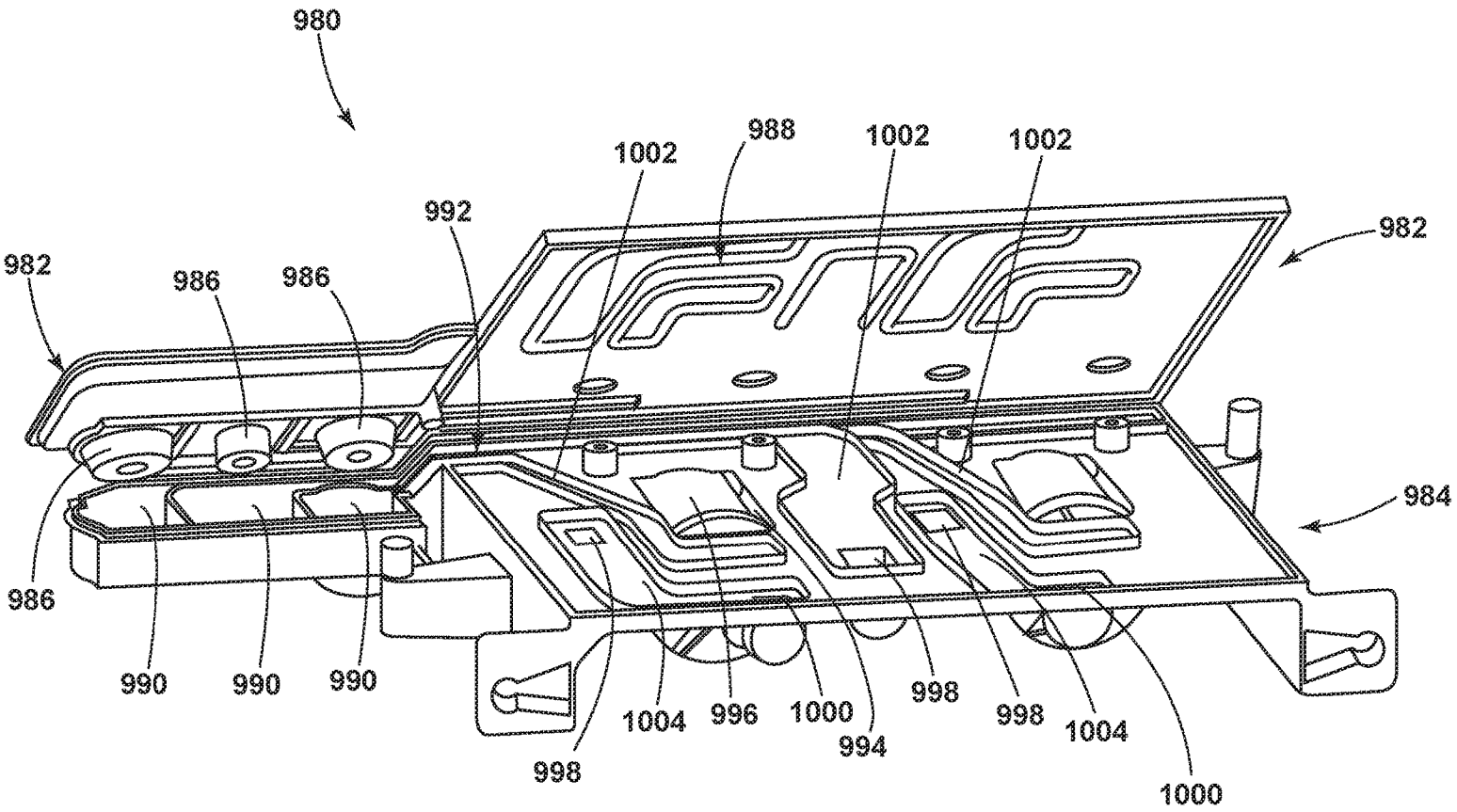
FIG. 31 illustrates the dispensing system of FIG. 29 including a tubeless design.

FIG. 31 illustrates an alternate tubeless housing 980. Tubeless should be understood to mean that the flow paths for any fluids is integrated into the housing 980 to define the flow paths, as opposed to dedicated tubed conduits. The housing 980 includes an upper portion 982 and a lower portion 984, which can be thought of as an un-hinged clamshell configuration. The upper portion 982 includes three spouts 986 and a system of seals 988. The lower portion 984 includes three receptacles 990 and a system of channels 992. The system of channels 992 is complementary to the system of seals 988. The lower portion 984 further includes two apertures 994. A pump 996, which can be the pumps of FIGS. 17-19, can be included in each aperture 994. The lower portion 984 also five outlets 998 and two inlets 1000. The nozzles of FIGS. 24-26, for example, can mount at the outlets 998 to direct a flow of fluid exiting the outlets 998.

The system of channels 992 includes three water channels 1002 and two mixed channels 1004. The water channels 1002 fluidly couple the receptacles 990 to three outlets 998. Two of the outlets 998 can couple to pumps 996, while the third outlet 998 can provide a flow of water directly to the treating chamber of the washing machine 10. The two mixed channels 1004 fluidly couple two inlets 1000 to two outlets 998.

In operation, the upper portion 982 can fasten to the lower portion 984 to seat the seals 988 at the channels 992, fluidly sealing the channels 992. A flow of water is provided to the spouts 986, such as from the manifold of FIG. 30. From the spouts 986, the water enters the receptacles 990 and is provided to the three water channels 1002. One water channel 1002 can provide for delivering the water directly to the treating chamber. The other two channels 1002 can provide a supply of water to the pumps 996. The pumps 996 can mix the volume of water with a supply of treating chemistry to create a mixture. The mixtures from the pumps 996 can be returned to the housing 980 via the inlets 1000 from the pumps 996. From the inlets 1000, the mixtures can be provided to the remaining outlets 998 where the treating chemistry and water mixtures can be applied to the treating chamber, such as from the nozzles.

Figure 32:
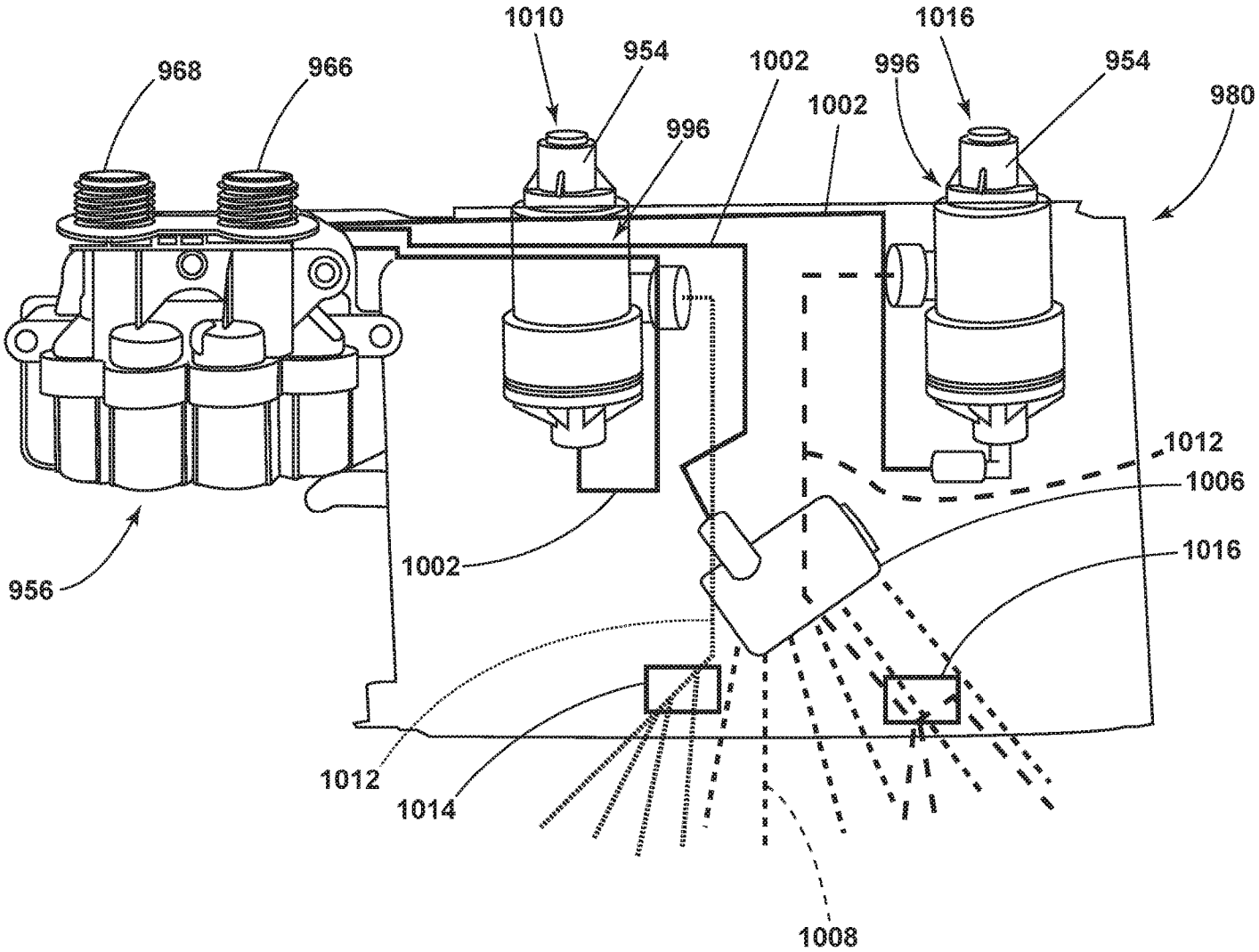
FIG. 32 illustrates a flow path for the dispensing system of FIG. 31.

FIG. 32 illustrates a top view of the housing 980 of FIG. 31, illustrating the flow paths through the housing 980. A supply of water is provided to the manifold 956 from the pumps 996 or to a water outlet nozzle 1006. The water outlet nozzle 1006 sprays a volume of water 1008 to the treating chamber, such as in the pattern of FIGS. 21-23. A volume of treating chemistry can be supplied to the pumps 996 at pump inlets 1010. The pumps 996 can combine the supply of treating chemistry with the supply of water to provide a mixture 1012 to a first nozzle 1014 or a second nozzle 1016. Thus, separate treating chemistries, such as a detergent and a fabric softener, can be supplied to the washing machine 10 at the same internal housing 980. The mixtures 1012 can be sprayed out the first and second nozzles 1014, 1016 in patterns such as those illustrated in FIGS. 21-23.

FIGS. 29-32 can include a bulk dispenser system including a distribution header including a housing, such as the housings 964, 980 of FIGS. 30-31. The housings can include multiple conduits, being tubed, tubeless, or otherwise, such as water conduits or treating chemistry conduits with at least one pump mount provided on the housing. The conduits can be the conduits 940, 1002, 1004, or other conduits for fluidly coupling a water supply, chemistry supply, or mixture thereof. A pump, such as pumps 954, 996, can be coupled to the bulk dispenser including a water inlet coupled to a water conduit, a treating chemistry inlet coupled to a treating chemistry conduit, and a wash liquid output for emitting a mixture of the water and the treating chemistry to form the wash liquid for the cycle of operation of the laundry treating appliance.

The housing can have at least one water supply connector or bulk chemistry connector for fluidly coupling to a water supply or a bulk treating chemistry supply. Additionally, the housing can include on or more nozzles for dispensing the liquids into the treating chamber. The nozzle, for example, can couple to the wash liquid output, and can be a spray nozzle. The nozzle can couple to a nozzle fitting on the housing, and be releasable mounted to the nozzle fitting. Additionally, the pump mount can be releasable to have the pump removably mounted to the housing.

The appliance can further include a valve assembly, such as any suitable combination of valves, carried by the housing for introducing a supply of water, treating chemistry, bulk treating chemistry, or other fluids. The valve assembly, for example, can include at least one of a water supply valve or a treating chemistry supply valve. Furthermore, the housing can include two separate halves, such as that shown in FIG. 31.

FIGS. 33-37 illustrate different locations of the bulk container 120 in both the horizontal axis and vertical axis washing machine 10 environments. It is to be understood that the location of the bulk container 120 as illustrated is not limited to the particular washing machine selected for the environment.

Figure 33:
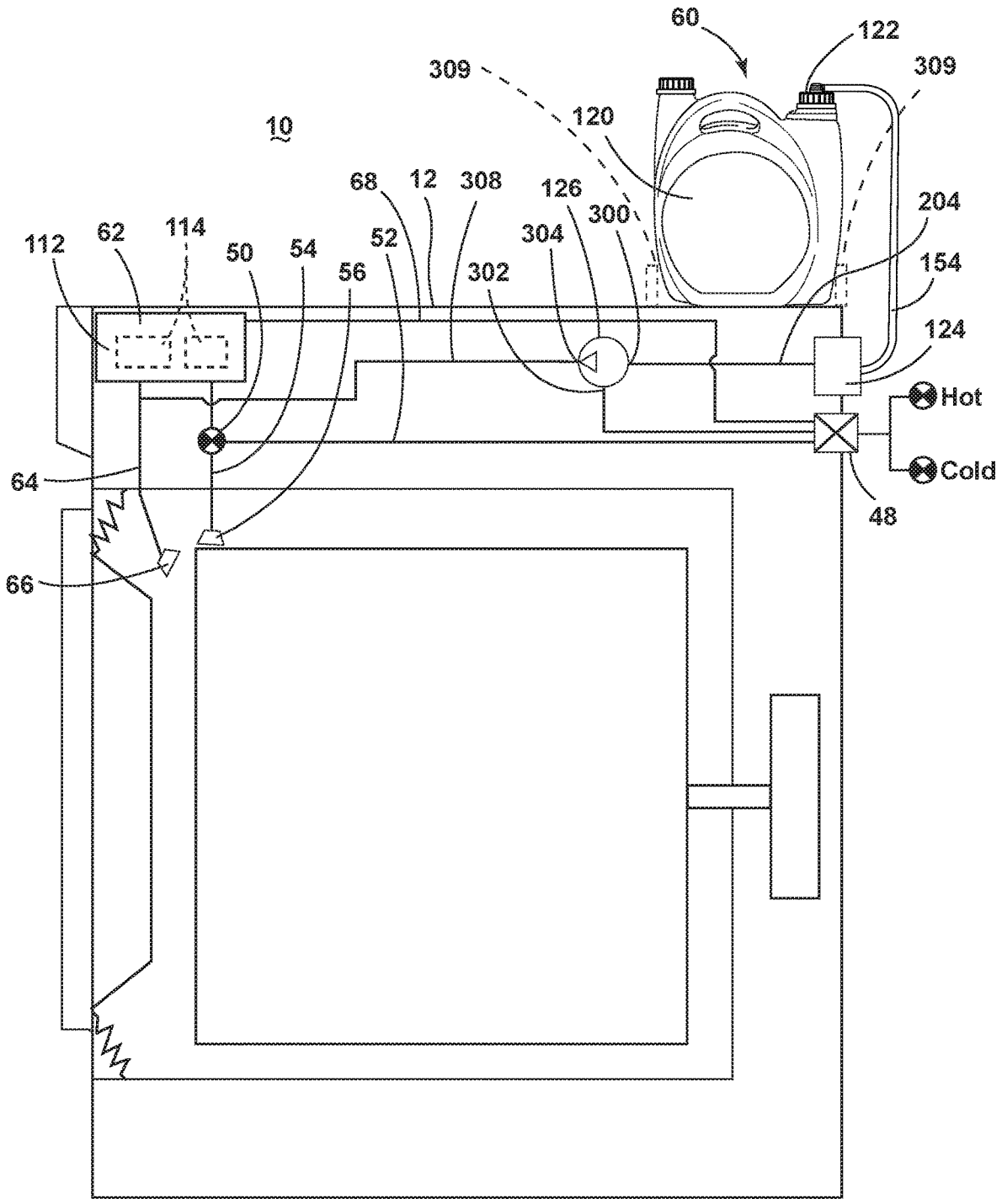
FIGS. 33-37 illustrate different locations for the bulk container relative to the washing machine.

FIG. 33 illustrates the bulk container 120 placed on top of the washing machine 10. The bulk container 120 can be placed at any location on the top of the washing machine 10. It is contemplated that it can be placed near the rear of the cabinet 12. Optionally, the washing machine 10 can include detents, recessed portions, or other physical features, such as guides 309 or other geometries to keep the bulk dispenser 60 in place. Additionally, such a guide 309 can indicate the proper storage position to the user.

Figure 34:
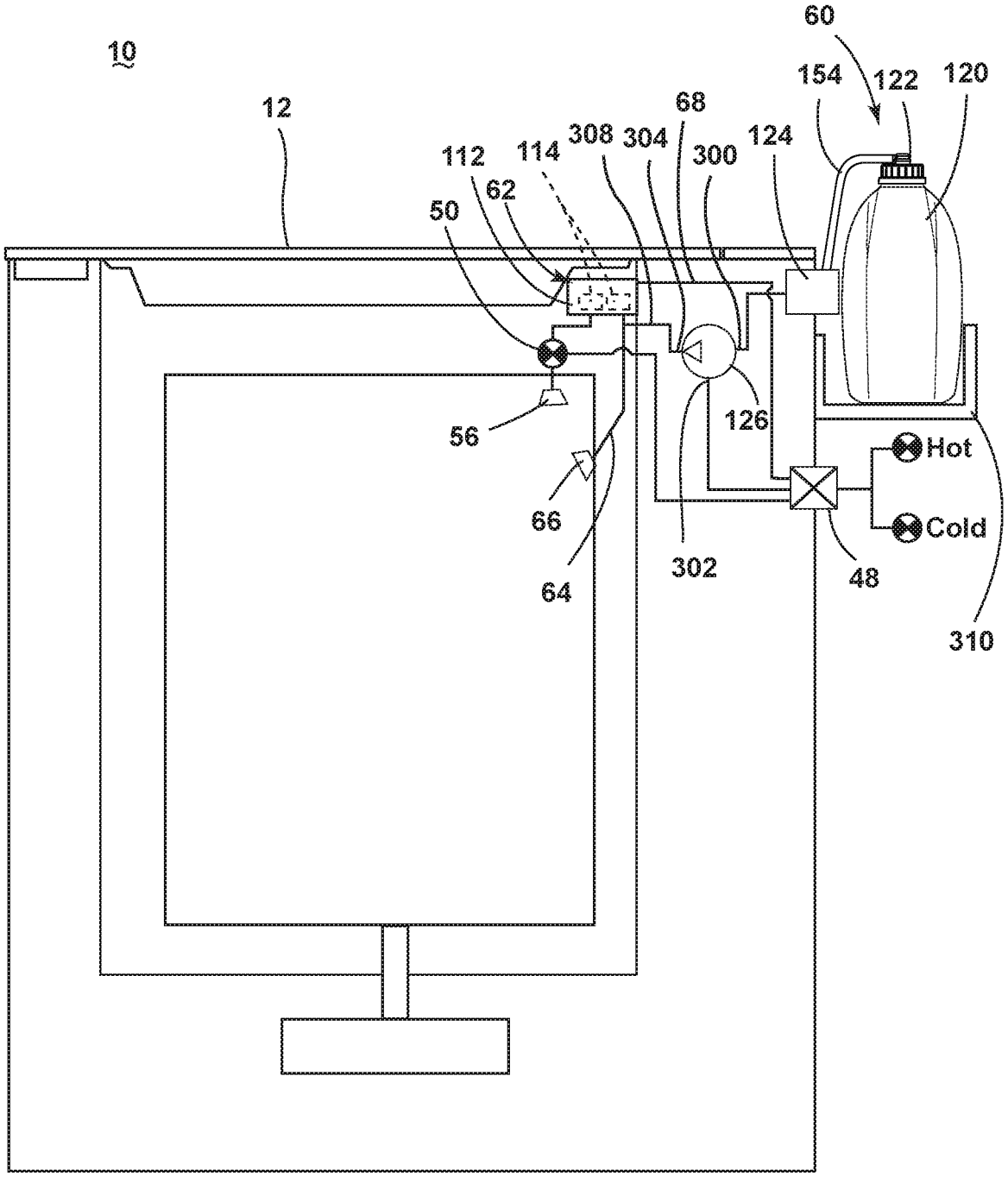

FIG. 34 illustrates the bulk container 120 placed on a shelf 310 mounted to the cabinet 12, and in particular the rear of the cabinet 12. The shelf 310 can be located below the top of the cabinet 12 to better hide the bulk container 120 from view.

Figure 35:
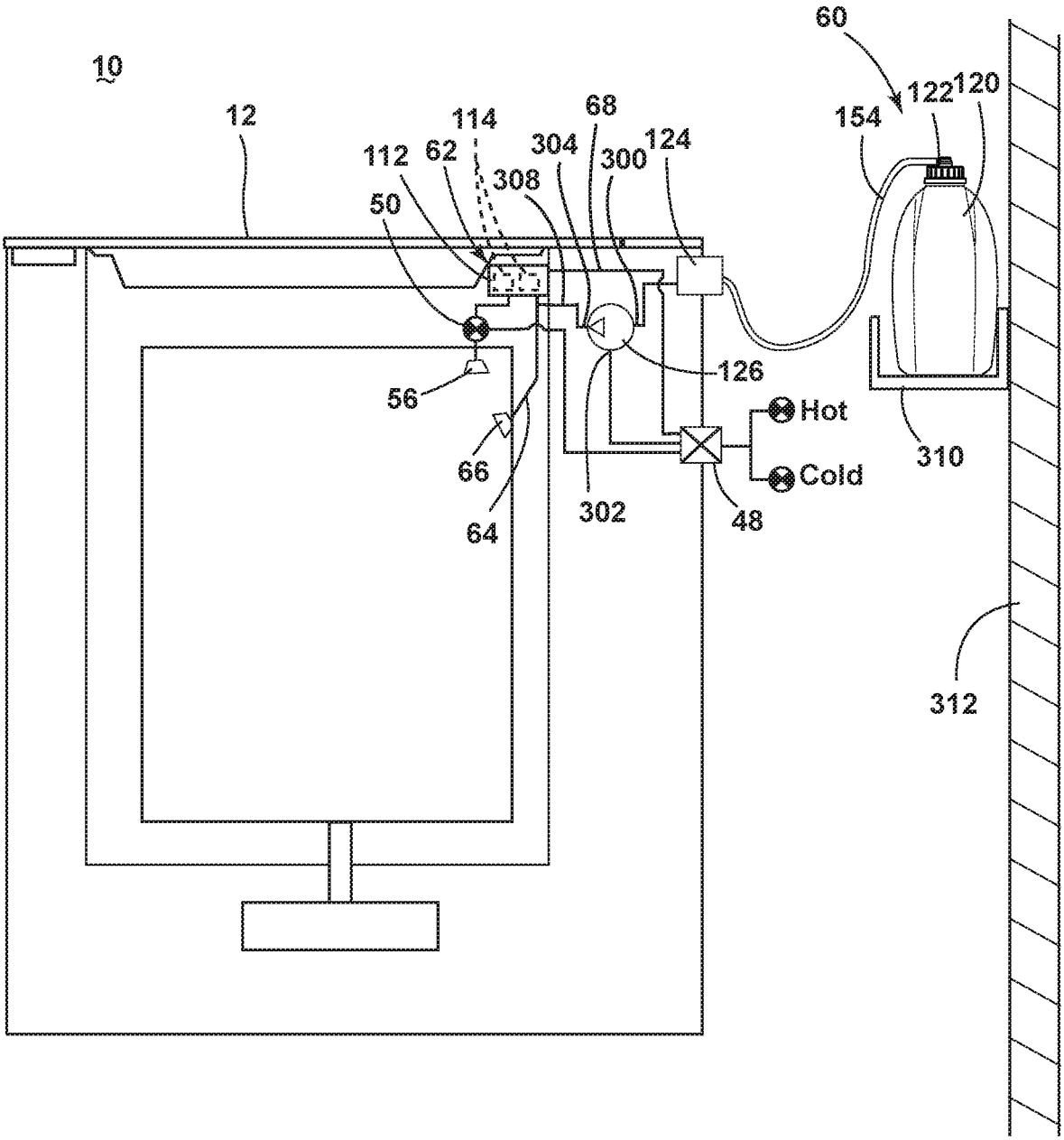

FIG. 35 illustrates the bulk container 120 in the shelf 310, which is now mounted to a wall 312, instead of the cabinet 12.

Figure 36:
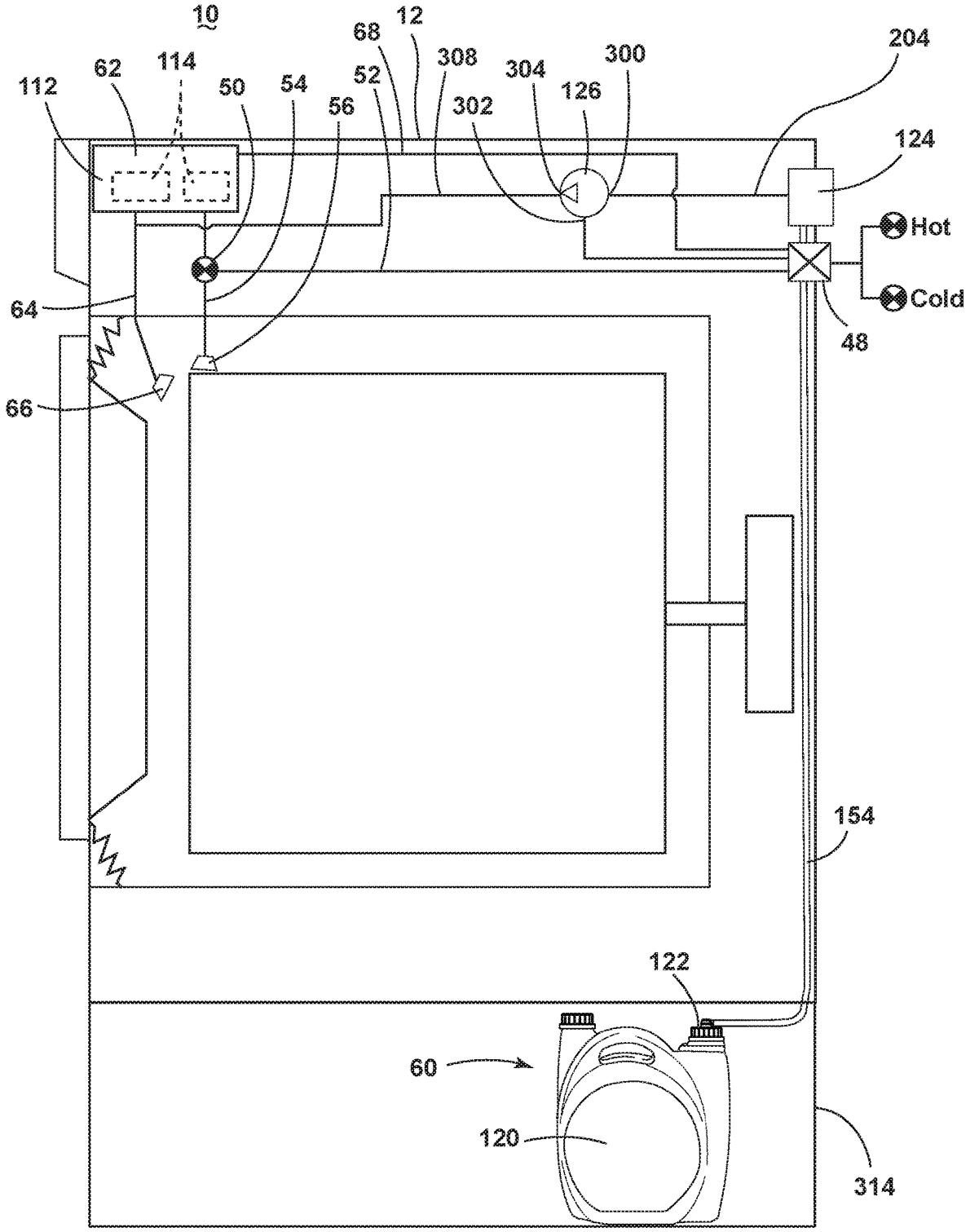
Figure 37:
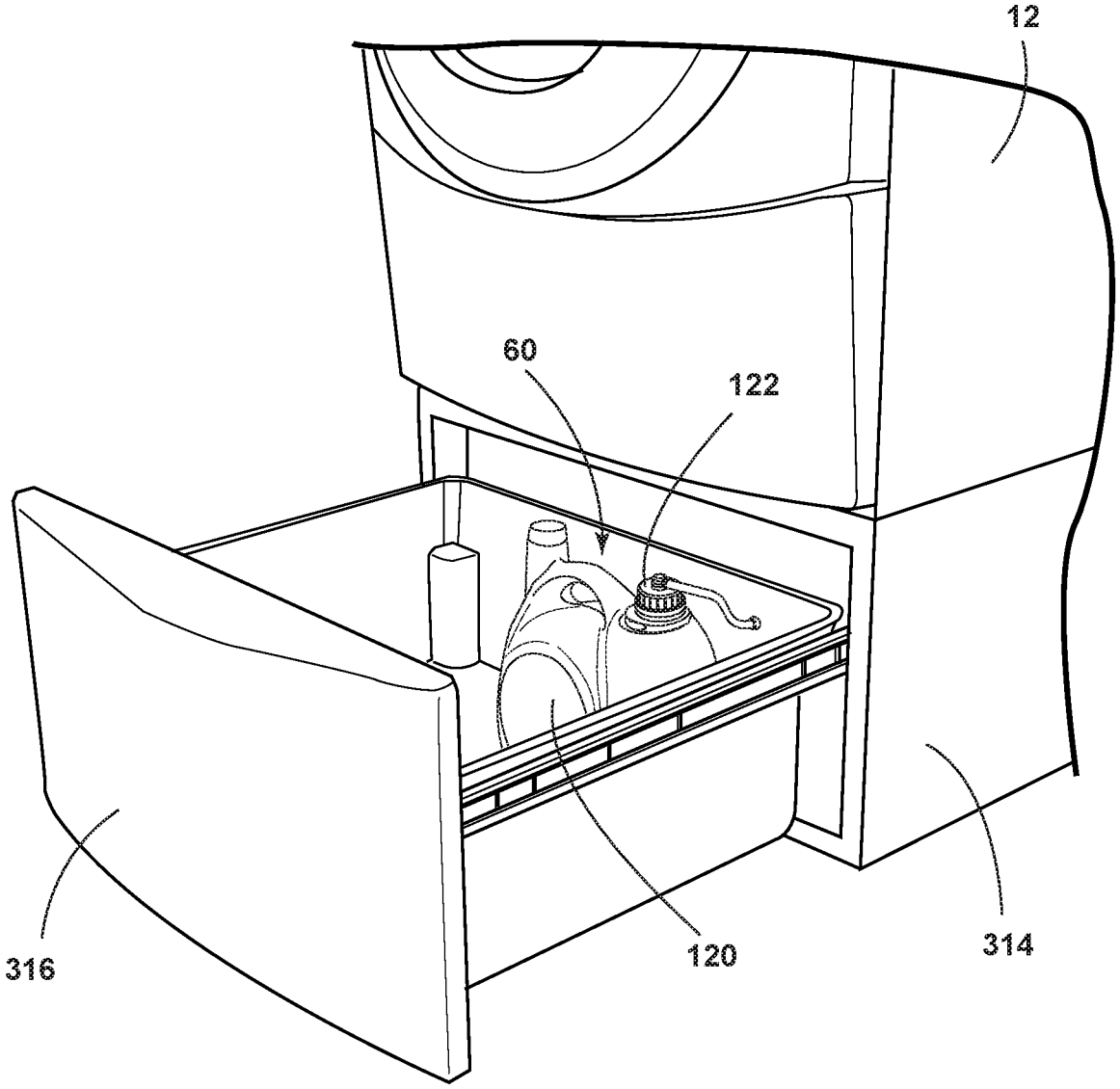

FIG. 36 illustrates the bulk container 120 located within a pedestal 314 supporting the washing machine 10. FIG. 37 illustrates the pedestal 314 with a drawer 316 in an open position to show the location of the bulk container 120. The pedestal 314 can be of any suitable size, especially height, to accommodate the bulk container 120. It is contemplated that the height of the pedestal can be about 15.5 inches to accommodate most off-the-shelf bulk containers in an upright position with the container adapter 122 mounted to the bulk container 120. Fifteen and a half inches is taller than most commercially available pedestals, which most commonly 12 inches.

While the different embodiments are illustrated using a single bulk container 120, it is contemplated that multiple bulk containers 120 can be used, with the controller selecting the bulk container 120 for the particular phase of the cycle of operation. For example, one bulk container 120 could hold detergent, another could hold bleach, and another could hold fabric softener, and yet another could hold special detergent, such as for babies clothing. The multiple bulk container 120 implementation can be accomplished by providing a liquid interface 124 and pump 126 for each of the different bulk containers 120. A sensor 206 can be provided for each of the bulk containers 120 and can be used to also identify the type of treating chemistry in the corresponding bulk container 120 and provide that data to the controller for subsequent use.

It is possible to fluidly couple all of the bulk containers 120 to a single pump 126 by locating a multiplexing valve or multi-spigot tube between the multiple liquid interfaces and the pump 126, for example. However, given that many of the contemplated treating chemistries are deleterious to each other's functionality when mixed, a special flushing cycle for the pump 126 would need to be executed prior to switching chemistries to avoid contamination.

While a bubble detection sensor was described for determining when the bulk container 120 is empty or nearing empty, an alternative would be to use one of the weight sensors 104, such as a plate, on which the bulk container 120 is placed. Such a weight sensor could be located at a predetermined portion of the cabinet top, in the shelf 310, or in the drawer 316 of the pedestal 314.

FIGS. 38-43 illustrate a washing machine 338 having two reservoir bulk containers 340. The bulk containers 340 can be tailored to the particular washing machine 338 and positioned behind the user interface 98. The washing machine 338 as described in FIGS. 38-43 is a vertical axis washing machine, while it is contemplated that the bulk containers 340 can be incorporated in a horizontal axis washing machine in similar fashion. The bulk containers 340 are not off-the-shelf containers, like bulk containers 120. The bulk containers 340 are custom designed for one or more specific washing machines, washing machine model, or washing machine product line.

Figure 38:
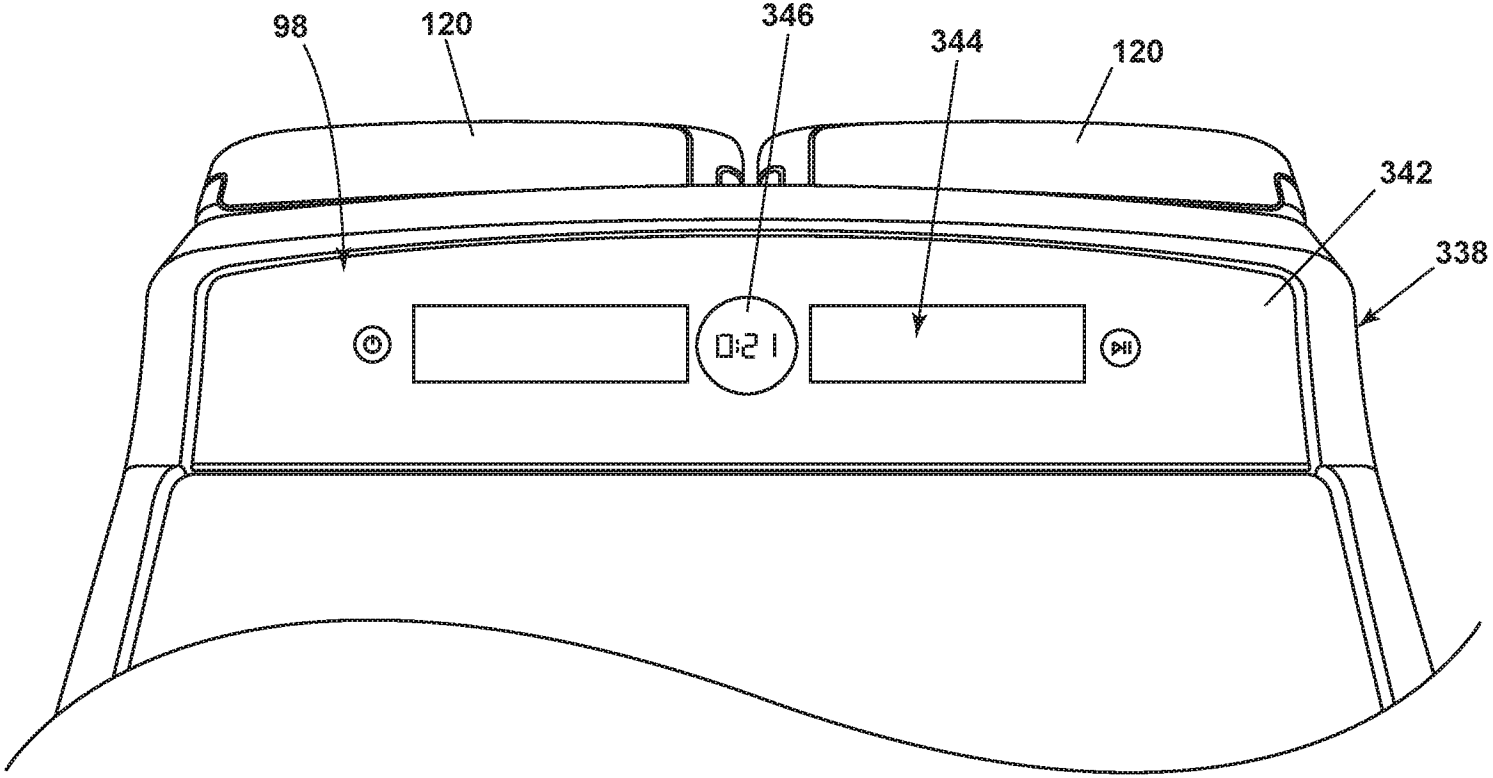
FIGS. 38-39 illustrate a bulk container disposed behind a user interface on the washing machine.

FIG. 38 illustrates two bulk containers 340 disposed behind the user interface 98. The bulk containers 340 are at least partially hidden, and can be fully hidden, behind user interface 98 for an aesthetically pleasing design while providing access for a user to interact with the bulk containers 340. The user interface 98 as shown is exemplary, including a touch screen display 342 with a plurality of buttons 344 and a time display 346.

Figure 39:
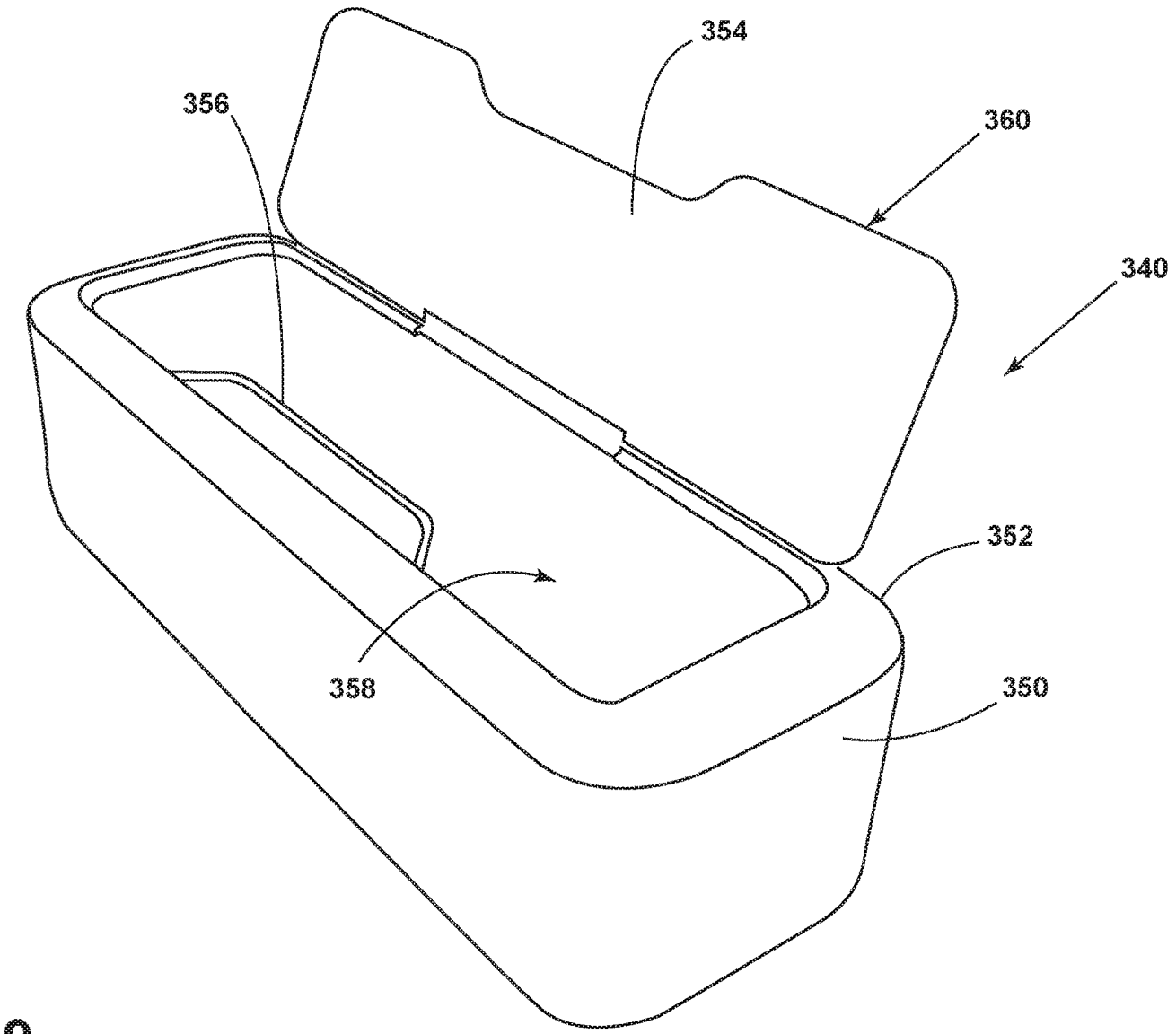

FIG. 39 illustrates one example of the custom reservoir bulk container 340. The bulk container 340 includes a housing 350, a cap 352 including a lid 354 and a handle 356. An interior 358 is defined within the housing 350. Indicia 360 can be disposed on the lid 354. The cap 352 mounts onto the housing 350 to enclose the interior 358. The lid 354 can selectively provide access to the interior 358 for filling the bulk container 340 with a volume of treating chemistry. The handle 356 can be grasped by the user for moving the bulk container 340, such as for filling and replacing on the washing machine 338. The indicia 360 can identify the particular treating chemistry associated with the particular bulk container 340. As such, multiple bulk containers 340 can be used to store different treating chemistries for the same washing machine 338.

Figure 40:
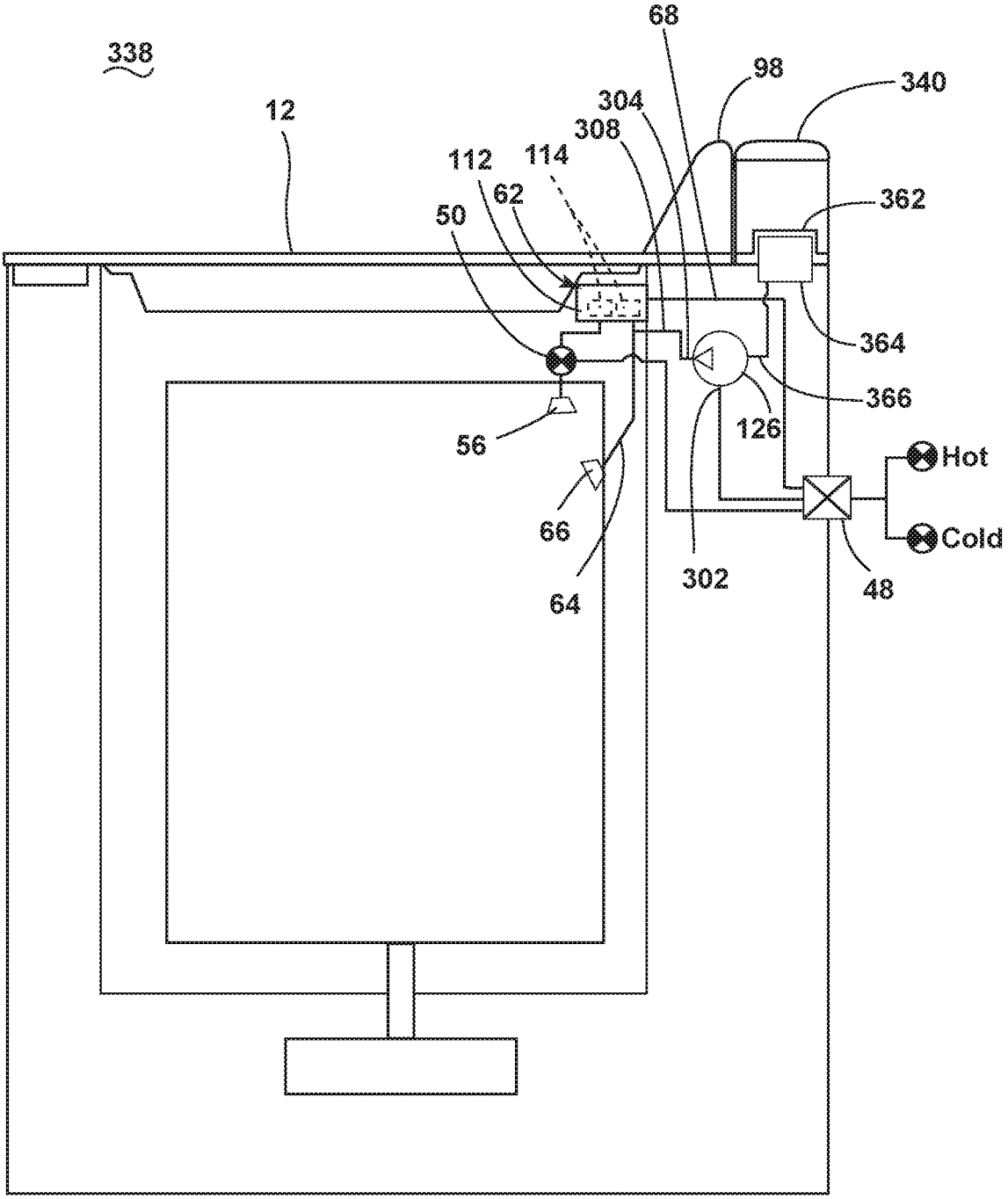
FIGS. 40-41 illustrate the bulk container of FIGS. 38-39 utilizing a valve connection integrated into the washing machine.

FIG. 40 illustrates the bulk container 340 mounted onto the washing machine 338 as a vertical axis washing machine. FIG. 40 can be substantially similar to FIG. 34 and similar numbers will be used to identify similar elements. A valve 362 can be integrated into the bulk container 340. A washing machine seat 364 can be provided on the washing machine 338 where the bulk container 340 is stored having a container conduit 366. The seat 364 can receive the bulk container 340, aligning the valve 362 to fluidly couple the bulk container 340 to the pump 126.

Figure 41:
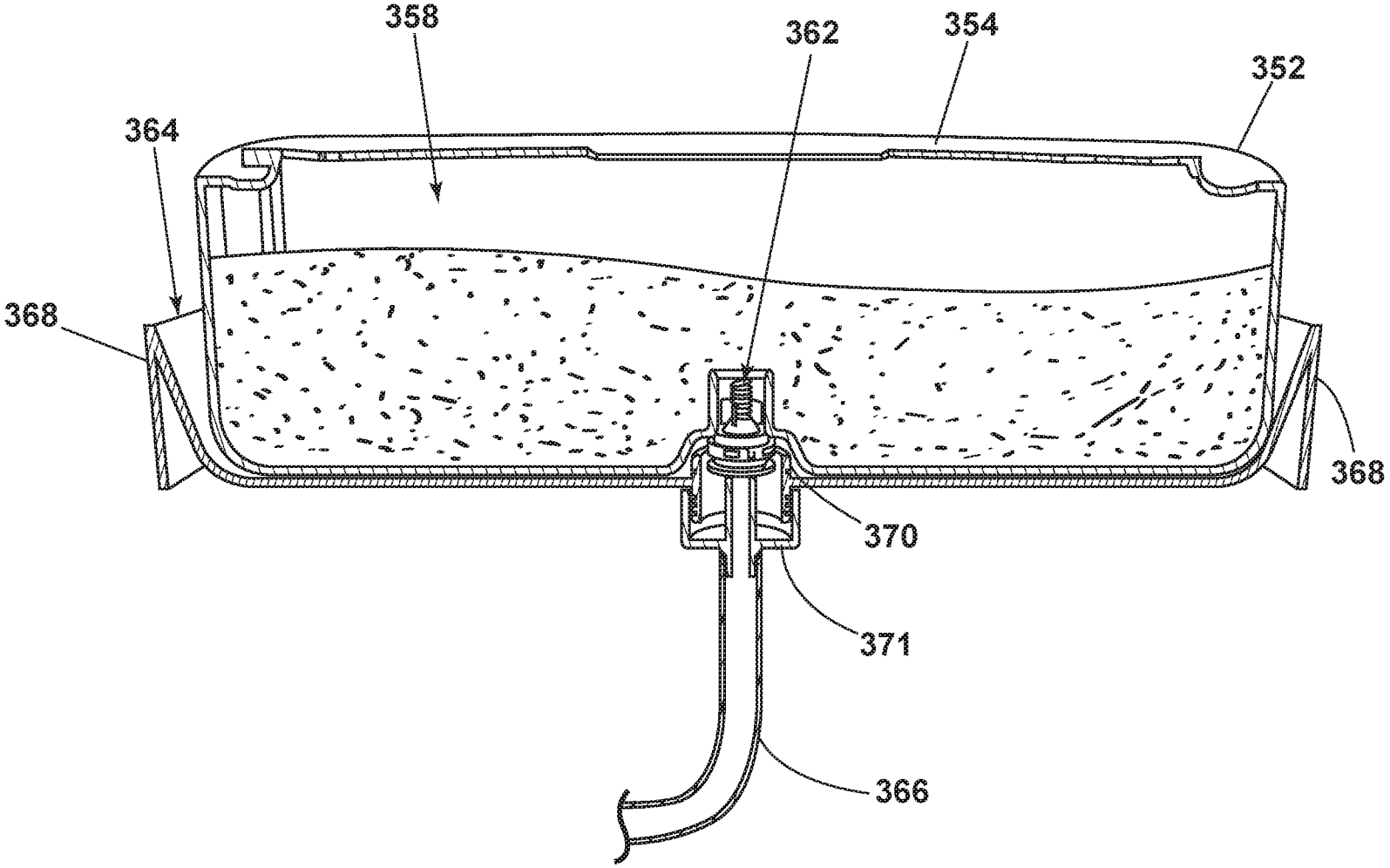

FIG. 41 illustrates a rear view of the bulk container 340 in a docking embodiment. The seat 364 can comprise a docking tray 368. The docking tray 368 can rest on the washing machine 338 for holding and aligning the bulk container 340. A docking seat 370 can be formed as part of the docking tray 368. The valve 362, as shown, is integrated into the bulk container 340, while it is contemplated that the valve 362 can alternatively be integrated into the docking tray 368, at the docking seat 370. The docking seat 370 can be shaped to receive the valve 362 to align the valve 362 with the container conduit 366. The docking seat 370 can fit within a washing machine receptacle 371 to align the docking tray 368 to the washing machine 338, aligning the bulk container 340 to the container conduit 366. Furthermore, placing the docking seat 370 within the receptacle 371 can form a reservoir for any treating chemistry that might leak at the valve 362, providing for easy cleaning when removing the bulk container 340 and the docking tray 368.

Figure 42:
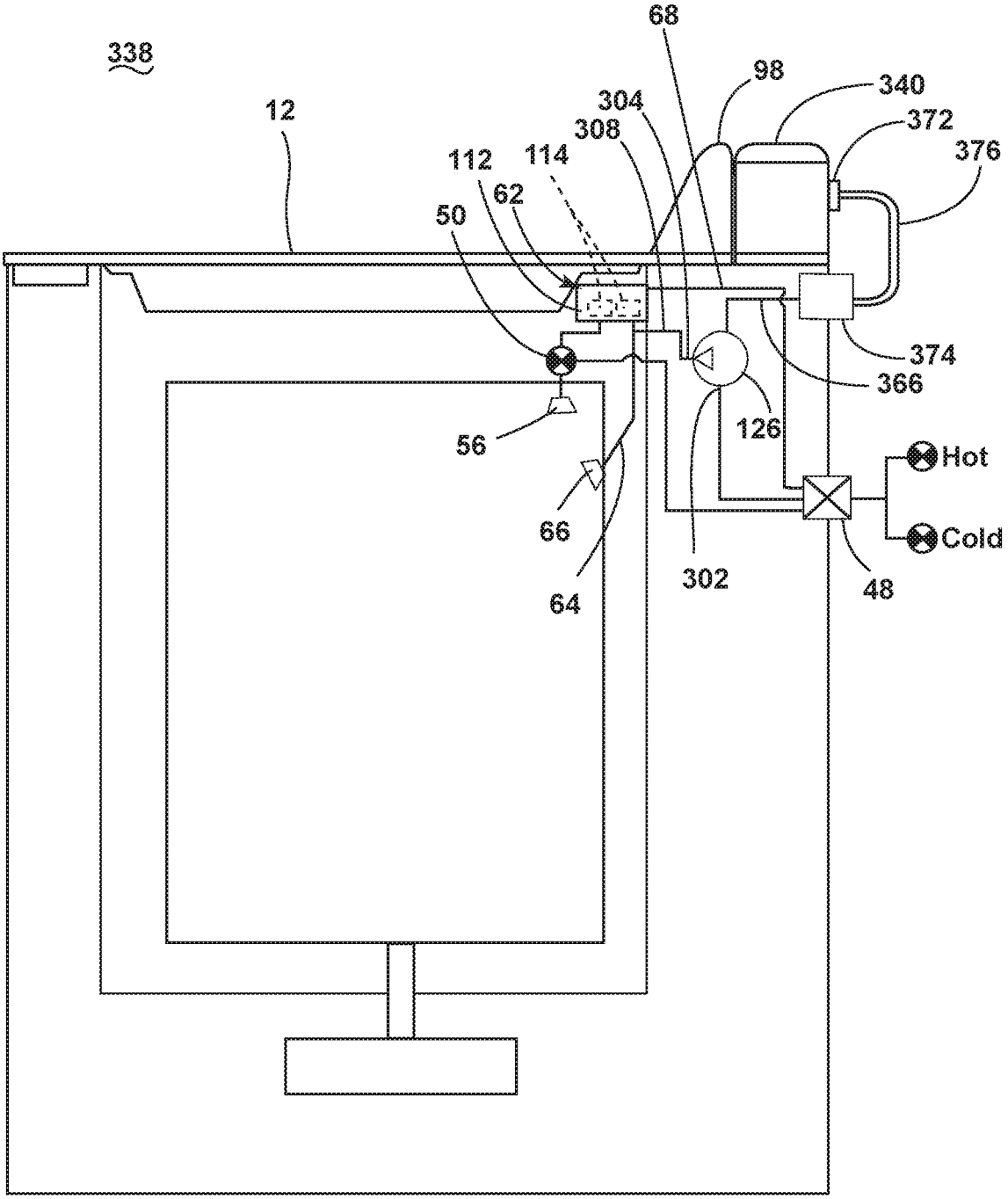
FIGS. 42-43 illustrate the bulk container of FIGS. 38-39 with an outlet for connecting the bulk container to the washing machine.
Figure 43:
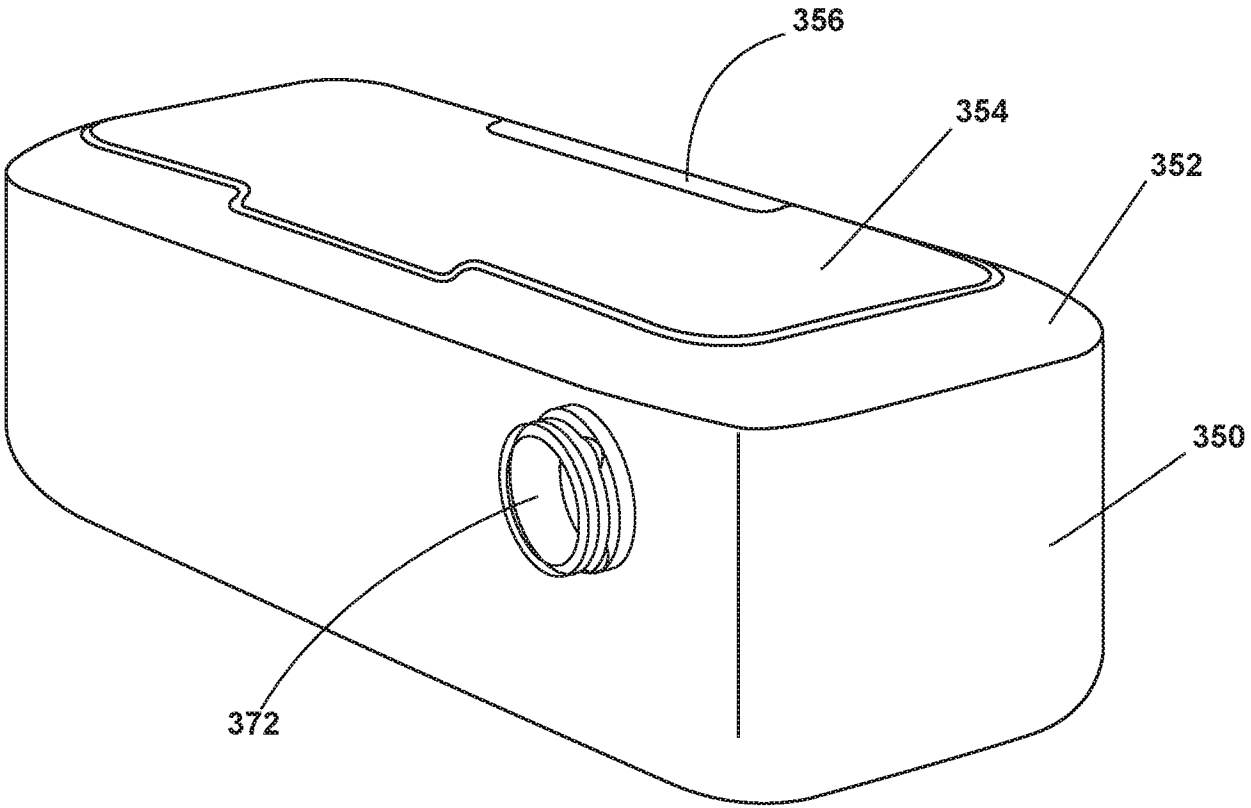

FIG. 42 illustrates the bulk container 340 in a non-docking embodiment. FIG. 43 can be substantially similar to FIG. 34 and similar elements are identified by similar numerals. In the non-docking embodiment, the bulk container 340 can include an outlet 372. The washing machine 338 can include an inlet 374 with a conduit 376. The conduit 376 can couple to the bulk container 340 to the outlet 372 at the inlet 374. The inlet 374 couples the conduit 376 to the container conduit 366 to provide a volume of treating chemistry from the bulk container 340 to the pump 126.

FIG. 43 illustrates a rear view of the non-docking bulk container 340, best illustrating the outlet 372. The outlet 372 can have threads providing for a threaded connection to the conduit 376. It should be appreciated that the outlet 372 can be located on any wall of the non-docking bulk container 340, including the lid. It should further be appreciated that the conduit 376 could be the same as or similar to the container adapter 122. It should yet further be appreciated that the non-docking bulk container 340 can be positioned in different places relative to the washing machine 338. Such places can be any place illustrated herein, or mounted to any place on the washing machine 338, or on a wall, cabinet, counter, floor, or other appliance near the washing machine 338.

Figure 44:
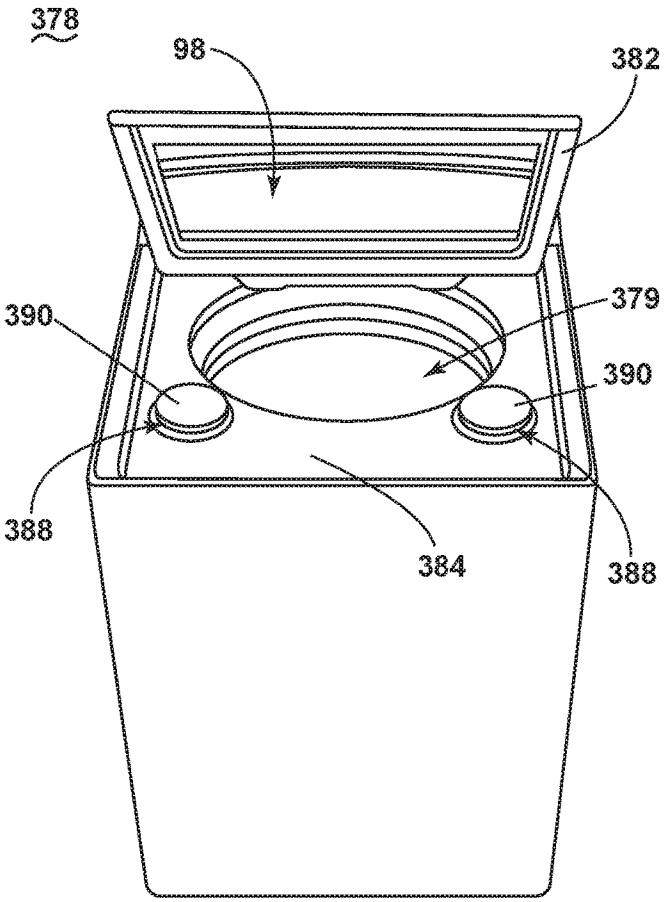
Figure 46:
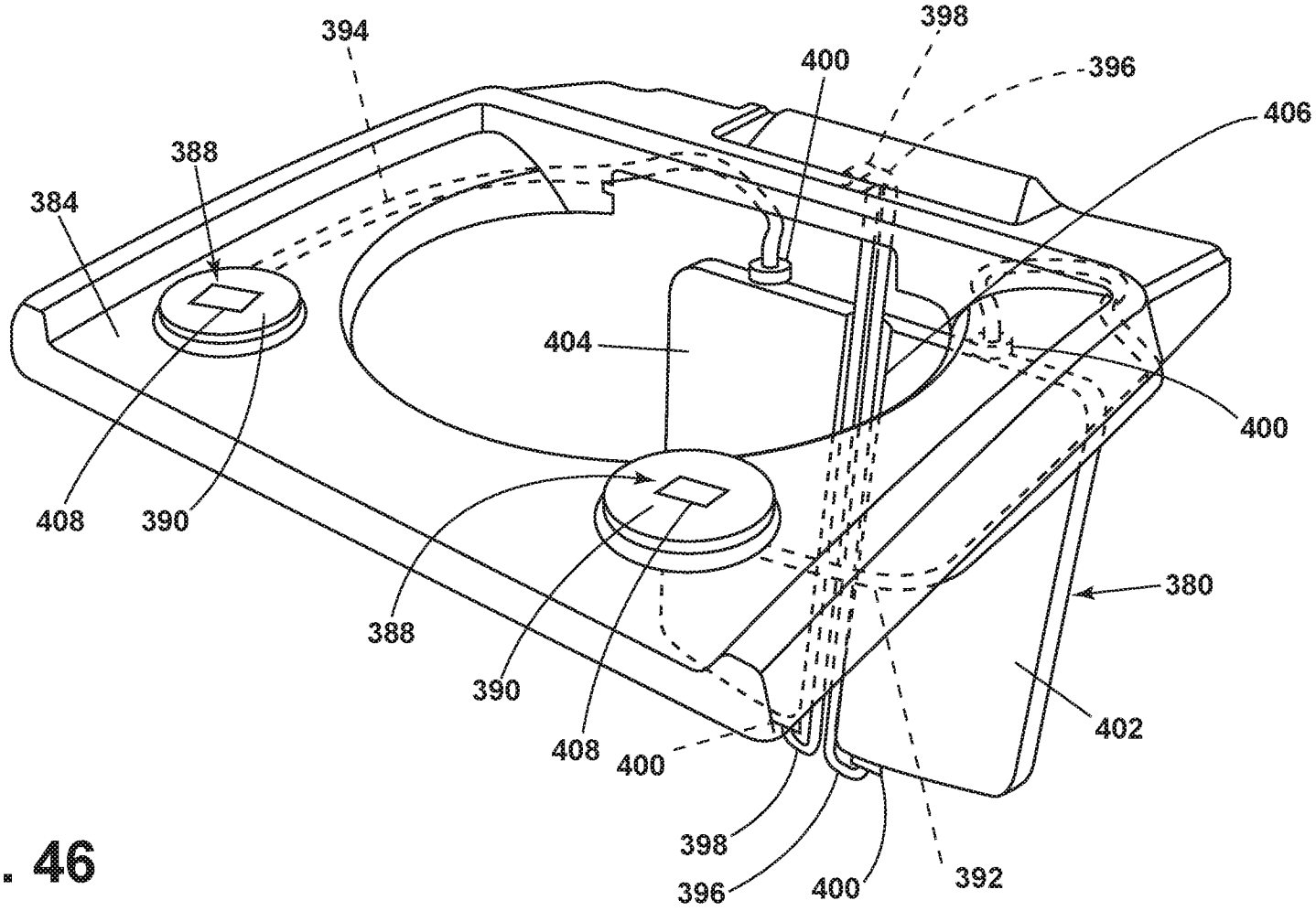

FIGS. 44-46 illustrate another embodiment for a bulk container 380 for storing and providing treating chemistry to the washing machine 378. It should be understood that while FIGS. 44-46 are directed toward a vertical axis washing machine 378, it will have equal applicability to a horizontal axis or other washing machine 378.

FIG. 44 illustrates the washing machine 378 having a treating chamber 379 and user interface 98. A lid 382 mounts to selectively open and close the treating chamber 379 for selectively opening the treating chamber 18. A top wall 384 is disposed underneath the lid 382. An aperture 386 defined in the top wall 384 provides access to the treating chamber 379 by opening the lid 382. Two inlets 388 are disposed in the top wall 384. A cap 390 can threadably mount at each inlet 388 to selectively open each inlet 388. It should be understood that the cap 390 can selectively provide access to a bulk container located underneath the inlets 388 adjacent to the top wall 384. A user can easily remove the cap 390, pour a volume of treating chemistry into the bulk dispenser through the inlet 388 for quick filling of bulk treating chemistry.

Alternatively, the bulk container 380 can be disposed on the rear wall 391 of the washing machine 378. FIG. 45 illustrates the bulk container 380 mounted on the rear wall 391 of the washing machine 378. The bulk container 380 includes a first inlet conduit 392 a second inlet conduit 394, a first outlet conduit 396, a second outlet conduit 398, and four coupling caps 400. The first and second outlet conduits 396, 398 extend along the rear of the washing machine 378 from the bottom of the bulk container 380 toward the top of the washing machine 378. The bulk container 380 can be divided into sections, illustrated as a first half 402 and a second half 404. It should be understood that the bulk container 380 as illustrated is exemplary, and can include any number of sections being one or more. For example, the bulk container 380 could be separated into four sections. As such, the top wall 384 would include four inlets 388, having four inlet conduits coupled to the bulk container 380 with four outlet conduits coupled to the washing machine 378.

FIG. 46 is an isolated view of the system interconnecting the bulk container 380 to the inlets 388. The inlets 388 can supply a volume of treating chemistry to the bulk container 380 through the first and second inlet conduits 392, 394. The first and second outlet conduits 396, 398 can supply a volume of the treating chemistry from the bulk container 380 to the washing machine 378, such as to the pumps (FIGS. 17-19) or internal housing (FIGS. 29-32) described herein. The caps 400 threadably couple the conduits 392, 394, 396, 398 to the bulk container 380.

The bulk container 380 further includes a channel 406 extending longitudinally along the bulk container 380. The channel 406 provides room for the first and second outlet conduits 396, 398 to extend from the bottom of the bulk container 380 to the top of the washing machine 10. Additionally, the channel 406 can effectively separate the bulk container 380 into the first and second halves 402, 404.

Indicia 408 can be disposed on the caps 390 disposed on the top wall 384. Such indicia 408 can identify the proper treating chemistry to be supplied to the proper section of the bulk container 380.

The bulk container 380 provides for storage of a large volume of treating chemistry, while requiring a minimal amount of space external of the washing machine 10, as well as being hidden from view of the consumer.

It should be appreciated that while FIG. 46 illustrates the cap system of FIG. 44 in combination with the bulk storage unit on the rear wall 391 of FIG. 45, the two can be used independent of one another. For example, the cap 390 of FIG. 44 can be used to pour a bulk volume of treating chemistry into a different bulk container immediately adjacent the cap 390 and inlet 388. Alternatively, the bulk dispenser 380 can be supplied from chemistry inlets disposed in alternatively places than that of FIG. 44 to fill the bulk dispenser 380.

Figure 47:
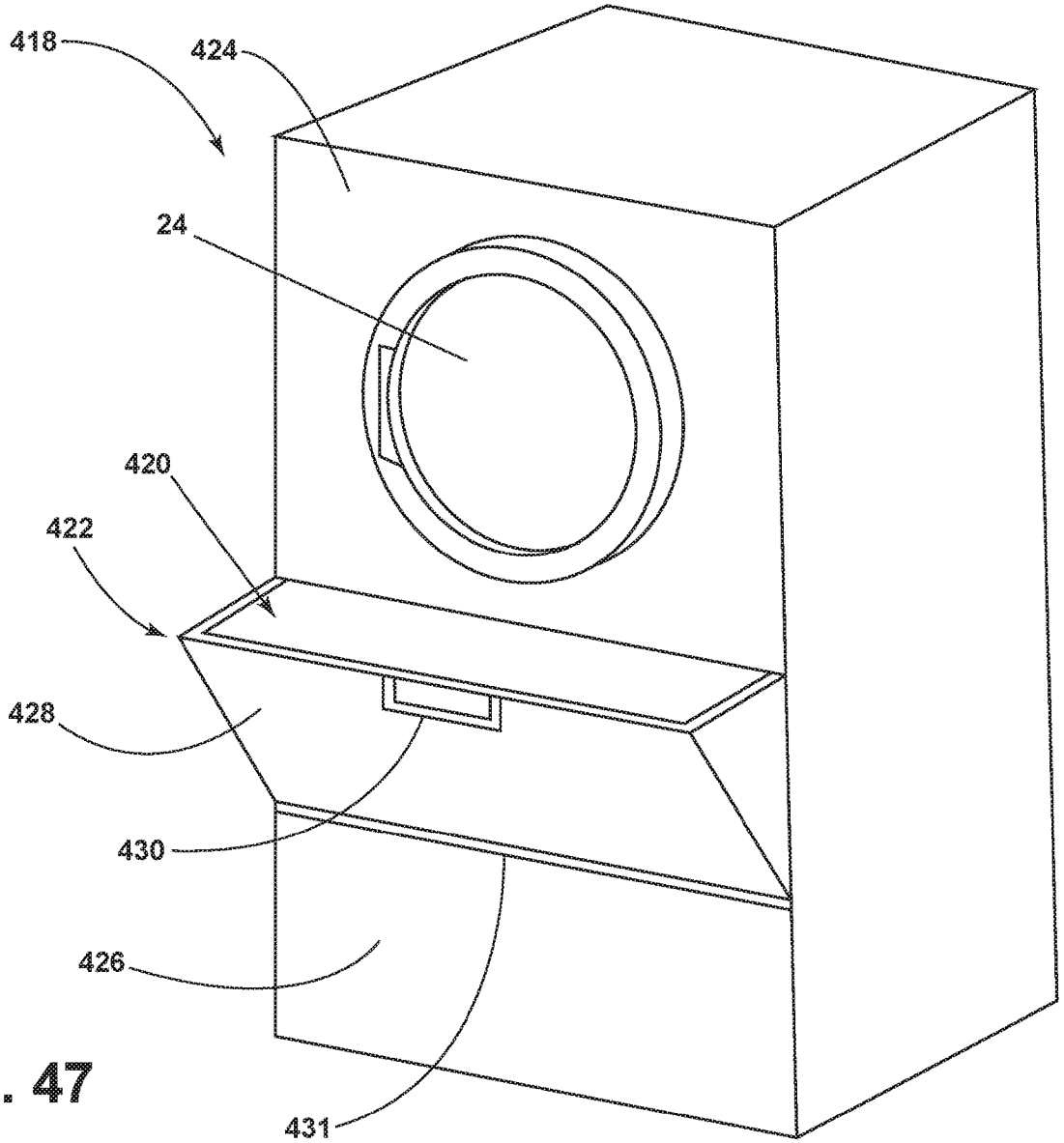
FIG. 47 illustrates a tip out panel for storing and connecting a bulk container to a washing machine.

FIGS. 47-50 illustrate another implementation for a bulk container 420 within a tip out panel 422 for accessing the bulk container 420. Referring to FIG. 47 in particular, the washing machine 418 is a heightened unit, including a drum portion 424 positioned above the tip out panel 422 and a toe kick panel 426. Alternatively, the toe kick panel 426 can be a pedestal or pull out drawer having various uses such as a secondary treating chamber or a storage space. The drum portion 424 includes the door 24 for selectively accessing the treating chamber 18. The tip out panel 422 includes a panel door 428 having a handle 430. The panel door 428 can be selectively opened and closed via a hinged connection 431 to access the bulk container 420.

Figure 48:
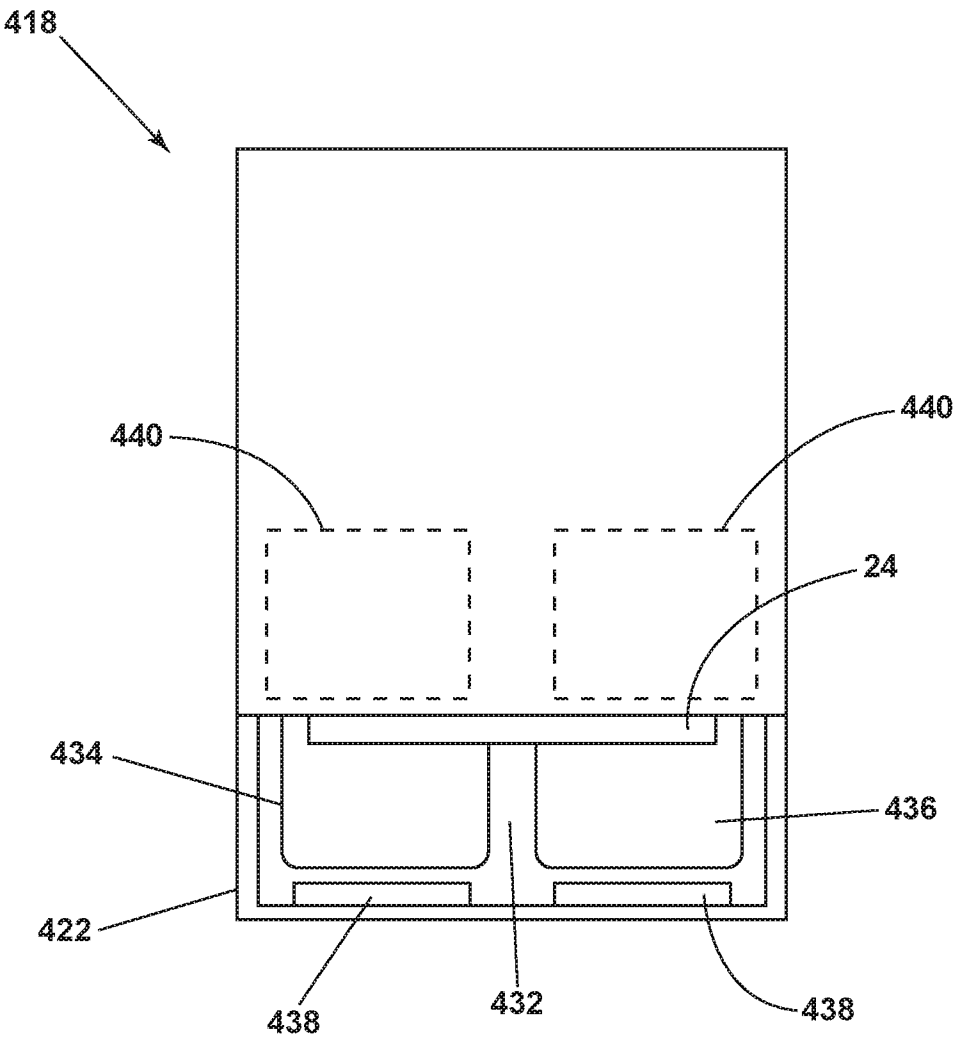
FIG. 48 illustrates a top view of the tip out panel of FIG. 47 having apertures for receiving a bulk volume of treating chemistry.

FIG. 48 illustrates a top view of the washing machine 418 with the tip out panel 422 in the open position. The bulk container 420 includes an internal dividing structure 432 defining a first pour aperture 434 and a second pour aperture 436. Indicia 438 can be disposed adjacent to the first and second pour apertures 434, 436. The indicia 438 can label the pour apertures 434, 436 such that a user can properly dispense treating chemistry into the proper aperture 434, 436. The pour apertures 434, 436 can define reservoirs for holding a volume of treating chemistry, which can be selectively supply to or drawn by the washing machine 418 for a cycle of operation.

Alternatively, as shown in FIG. 48, two reservoirs 440 can be disposed within the washing machine 418, shown in dashed line. The reservoirs 440 can be located behind the tip out panel 422 in the washing machine 418. In operation, treating chemistry can be poured from a bulk dispenser 60 or other large volume of treating chemistry into the first and second pour apertures 434, 436. The volume of treating chemistry is provided from the apertures 434, 436 and stored in the reservoirs 440. The volume of treating chemistry stored in the reservoirs 440 can be provided from the reservoirs 440 to the treating chamber for treating a load. During a cycle of operation, a controller can pump the treating chemistry from the reservoirs 440 for providing the appropriate amount of treating chemistry based upon the particular cycle of operation.

It should be appreciated that the washing machine 418 having the tip out panel 422 disposed above the toe kick panel 426 provides a geometry that is beneficial to locating the treating chamber higher off of the ground than traditional treating chambers. Such a position provides an ergonomic position for the door facilitating loading and unloading of the washing machine 418 by a user. Similarly, the heightened position of the tip out panel 422 facilitates loading of treating chemistry into the washing machine 418, rather than requiring a user to remove a bulk dispenser or bend or stoop to fill or install a new bulk container or dispenser. A typical horizontal axis washing machine has a door position that requires a user to bend over or stoop to load. The heightened treating chamber allows a user to load and unload the washing machine 418 without bending or stooping. While the tip out panel is well suited for a configuration where the treating chamber is higher off the ground than normal, the tip out panel can be used with a traditional height treating chamber. In another example, it is contemplated that the washing machine 418 does not include a toe kick panel 426 and that the tip out panel 422 is disposed at the bottom of the washing machine 418 adjacent the floor or other resting surface.

Figures 49, 50:
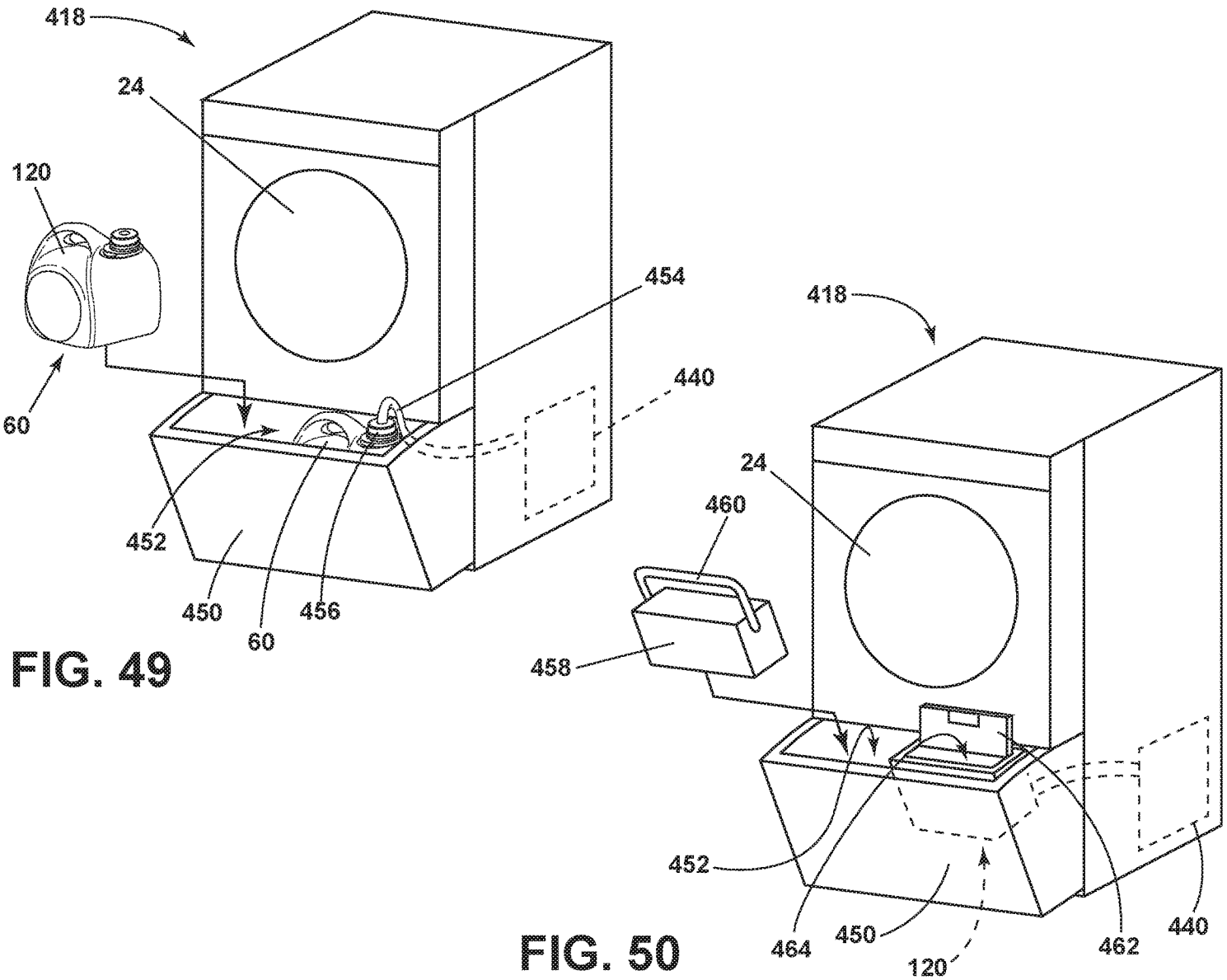
FIGS. 49-50 illustrate examples of storing a bulk dispenser or bulk container in the tip out panel.

FIG. 49 illustrates a variation on the washing machine 418 of FIG. 48, having the tip out panel 450 adapted to receive the bulk dispenser 60 or the bulk container 120. The tip out panel 422 includes a panel interior 452 with one or more conduits 454 having a complementary cap 456. Bulk dispensers 60 can be placed in the panel interior 452 for loading. The cap 456 can be the cap of FIGS. 4-11, for example. The cap 456 can screw onto the bulk dispensers 60. The conduit 454 fluidly couples the bulk dispenser 60 to the washing machine 418 for providing a volume of treating chemistry to the reservoir 440 in the washing machine 418 during a cycle of operation. Alternatively, the conduit 454 can couple directly to a pump for providing the treating chemistry to the treating chamber without the intermediate reservoir 440.

FIG. 50 illustrates a variation on FIG. 49, having the tip out panel 422 with dedicated bulk dispensers 458. The dedicated bulk dispensers 458 include a handle 460 with a lid 462. An interior 464 can be defined within the bulk dispenser 458 and accessed by opening the lid 462. The interior 464 can be filled with a volume of treating chemistry. During operation, the treating chemistry can be provided to the internal reservoir 440 via the conduit 454, or alternatively can couple to a pump for providing the treating chemistry directly to the treating chamber during a cycle of operation. The dedicated bulk dispensers 458 are removable from the panel interior 452 for easy filling or cleaning external from the washing machine 418.

FIGS. 51-55 illustrate embodiments of bulk container 120 integrated in the door 24 or at a seat where the door 24 closes the treating chamber. While the embodiments are illustrated in the door 24 of a horizontal axis washing machine, the embodiments have equal applicability to a lid enclosing a vertical axis washing machine.

Figure 51:
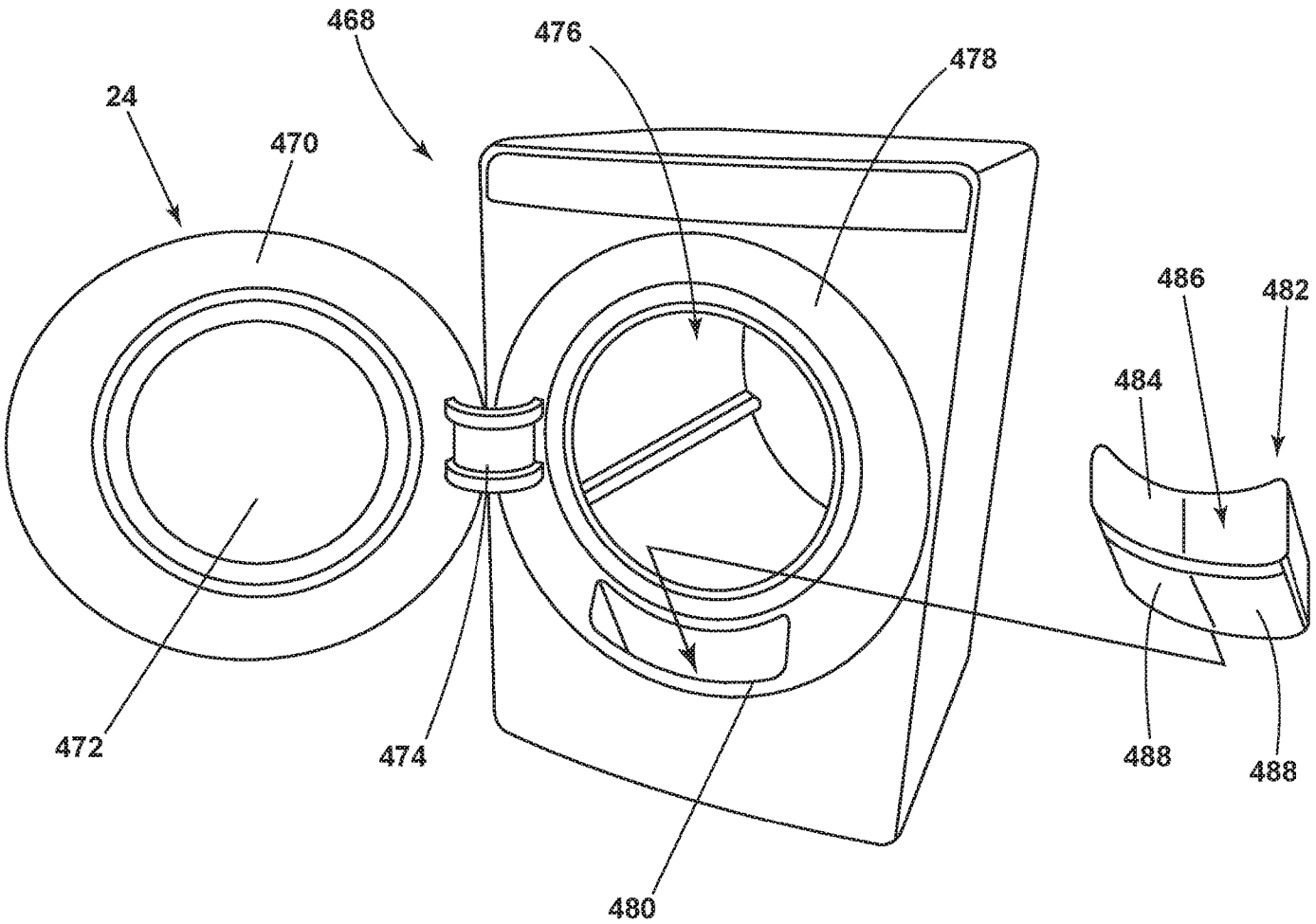
FIG. 51 illustrates a slot in a seat at the door for receiving a bulk container in the slot.

FIG. 51 illustrates a washing machine 468 having a front load door 24. The door 24 includes a frame 470 and a window 472. A hinge 474 connects the door 24 to the washing machine 468. The washing machine 468 further includes a seat 478 defining an access opening 476. A slot 480 is disposed in the seat 478. A bulk container 482 defining an interior 486 is sized complementary to the slot 480 and includes a lid 484. The interior 486 can be separated into chambers 488 for holding different treating chemistry for use in a cycle of operation.

Figure 3:
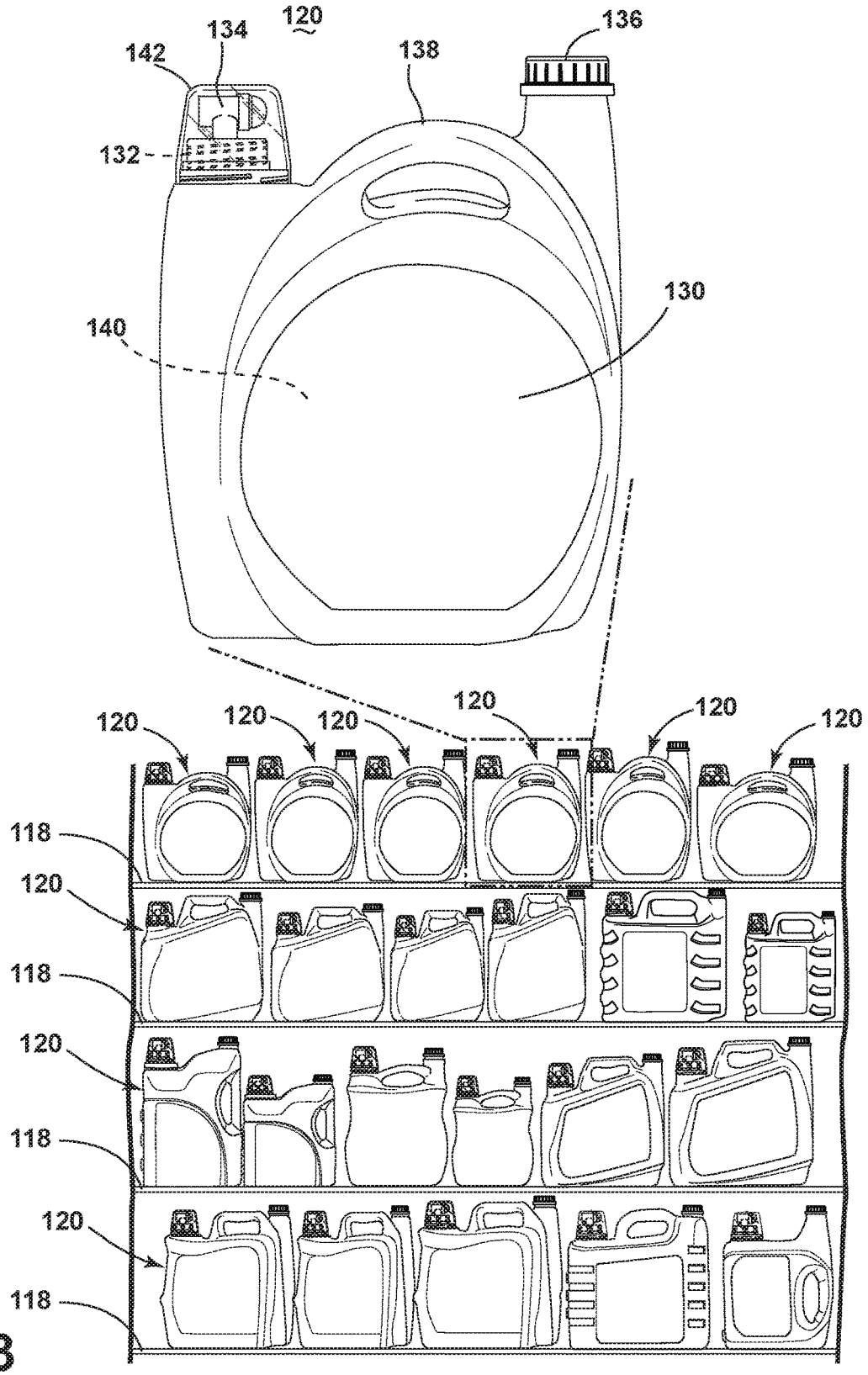
FIG. 3 is a schematic view of a contemporary retail store shelf offering a variety of off-the-shelf bulk containers suitable for use in the bulk dispenser, with one of the bulk containers enlarged for detail.

In use, the bulk container 482 can be filled with a volume of one or more treating chemistries. The bulk container 482 can be removed from the slot 480 for filling. Upon removal of the bulk container 482, the lid 484 is opened providing access to the chambers 488. The different treating chemistries can be poured or otherwise placed in the chambers 488 to keep them separate, such as from the bulk dispenser 60 (FIG. 3).

The bulk container 482 can include a valve (not shown). Such a valve can be similar to the valve 362 of FIG. 41. Each chamber 488 can have a dedicated valve for separately providing treating chemistries to the washing machine 468. The valve couples the bulk container 482 to the washing machine 468 for providing the treating chemistry to the washing machine 468 during a cycle of operation. A pump (FIGS. 17-19) can selectively draw a volume of the treating chemistry from the bulk container 482 for providing the chemistry to the treating chamber.

Alternatively, the bulk container 482 can operate as a storage unit within the washing machine 468. When a user requires a volume of treating chemistry, the bulk container 482 can be removed from the slot 480 where a user can collect a volume of treating chemistry from the bulk container 482 and dispense it to the washing machine 468 for a cycle of operation. For example, the bulk container 482 can hold a large volume of detergent where a user can selectively provide the detergent to the washing machine 468. In another example, the bulk container 482 can hold stain treating chemistry, where a user can selectively provide the stain treating chemistry to an article for pre-treatment as may be desired.

Figure 52:
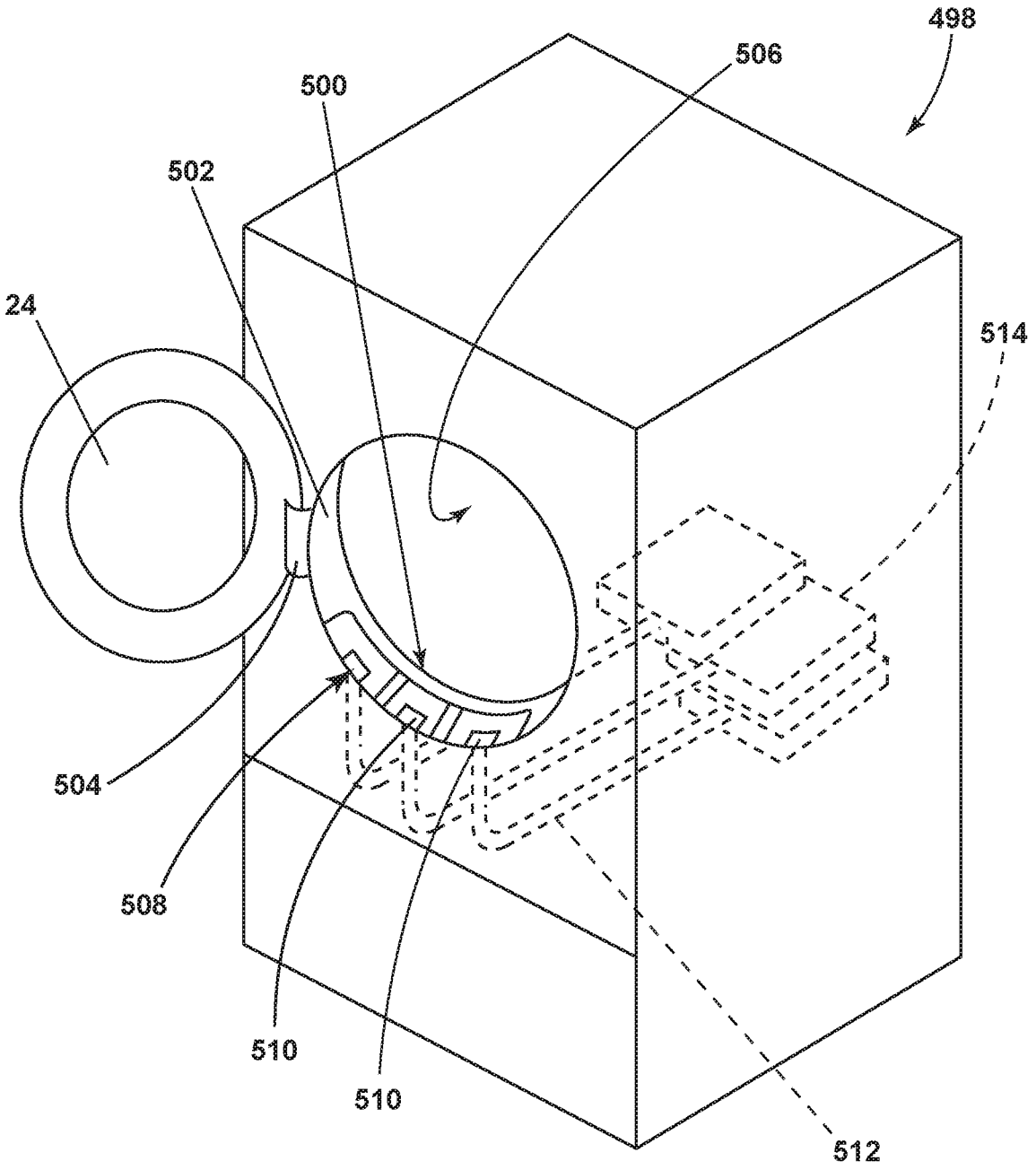
FIG. 52 illustrates inlets in a seat for receiving a door to close a treating chamber, having bulk reservoirs fluidly coupled to the inlets.

FIG. 52 illustrates yet another embodiment having a washing machine 498 with a bulk receptacle 500 disposed in a door seat 502. The door 24 includes a hinge 504 to mount to the washing machine 498. An access opening 506 is defined by the door seat 502. The bulk receptacle 500 includes one or more inlets 508. The inlets 508 can have an optional lid 510 to selectively open and close the inlets 508. The washing machine 498 can further include one or more conduits 512 and complementary reservoirs 514. The conduits 512 fluidly couple the inlets 508 to the reservoirs 514.

In operation, the door 24 can be opened to provide access to the bulk receptacle 500. The user can pour treating chemistry into the inlets 508. The treating chemistry passes into the reservoirs 514 through the conduits 512. The inlets 508 can be labelled with indicia (not shown) to instruct a user to input the proper treating chemistry into the proper reservoir 514. Additionally, it is contemplated that a fill-level for the reservoirs 514 can be communicated to the user, such as through visual or audible communication at the user interface, in one non-limiting example.

Figure 53:
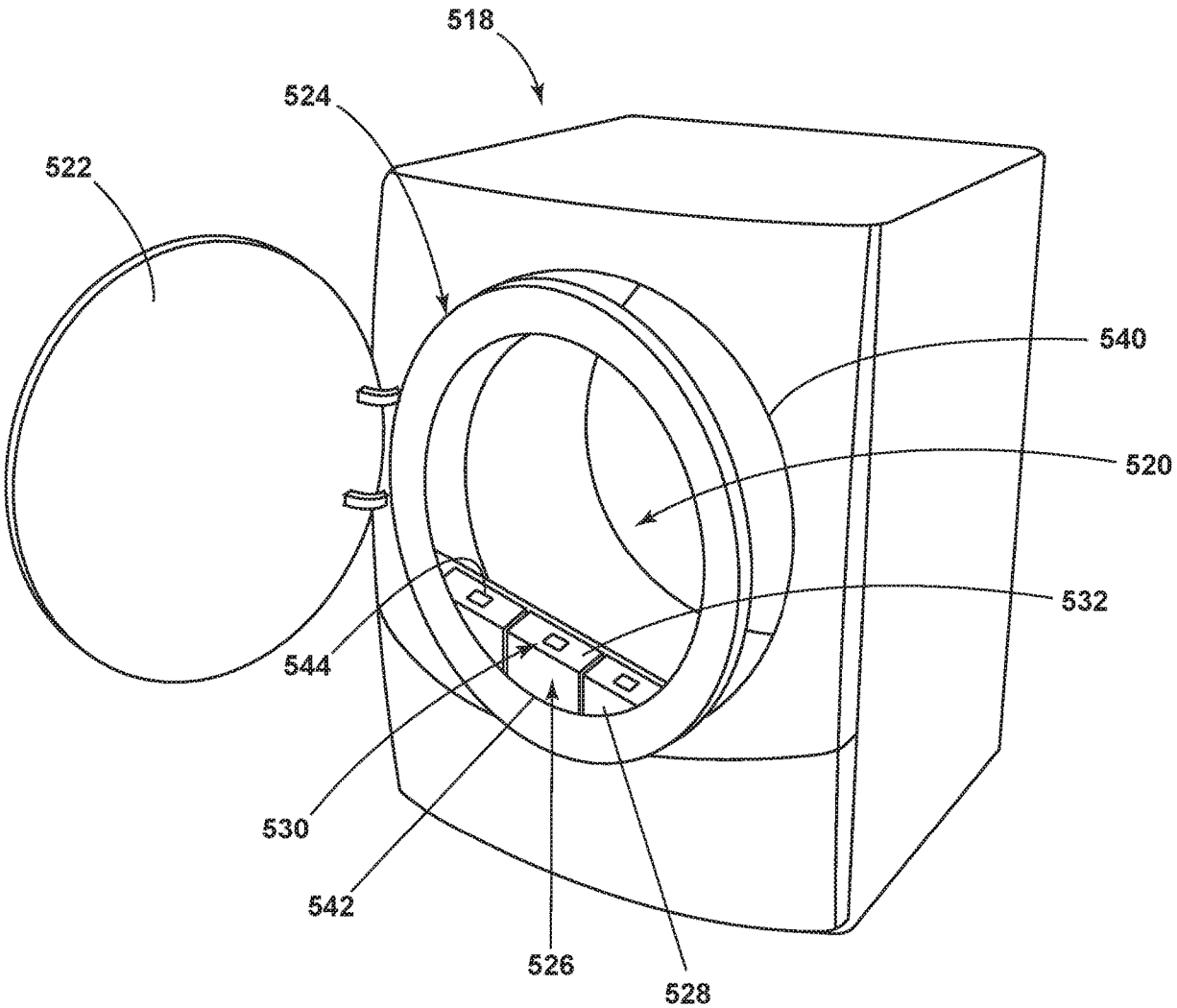
FIGS. 53-55 illustrate a bulk container integrated into a washing machine door.

FIG. 53 illustrates an alternative embodiment of FIG. 52, having a two-door system. A washing machine 518 includes an access opening 520 having a first door 522 and a second door 524. The first door 522 can selectively provide access to the second door 524. The second door 524 includes a bulk container 526. The bulk container 526 can be separated into multiple chambers 528. An interior 530 is defined within each chamber 528. A lid 532 can be located on each chamber 528. The lids 532 selectively open and close the chambers 528 providing access to the interior 530.

The second door 524 can selectively open and close the access opening 520 at a seat 540. One or more inlets (not shown) can be disposed at the seat 540 complementary to the chambers 528. The inlets can fluidly couple the chambers 528 of the bulk receptacle 500 to the washing machine 518 for providing a volume to treating chemistry to the washing machine 518 during a cycle of operation.

The second door 524 closes the access opening 520 to the washing machine 518. The first door 522 is selectively opened to access the bulk container 526. In operation, a user opens the first door 522 and can fill the bulk container 526 with a volume of treating chemistry. The second door 524, in combination with the first door 522, can be closed to enclose the access opening 520. In the closed position, the treating chemistry from the individual chambers 528 can be drawn by the washing machine 10 for use during a cycle of operation.

Alternatively, the bulk container 526 can be separated by chamber 528 into individual bulk containers 542. Each individual bulk container 542 can include a handle 544 for removal for filling and replacing. As such, the washing machine 10 can draw a volume of treating chemistry directly from the bulk containers 542 without requiring an internal reservoir for holding the treating chemistry.

Figure 54:
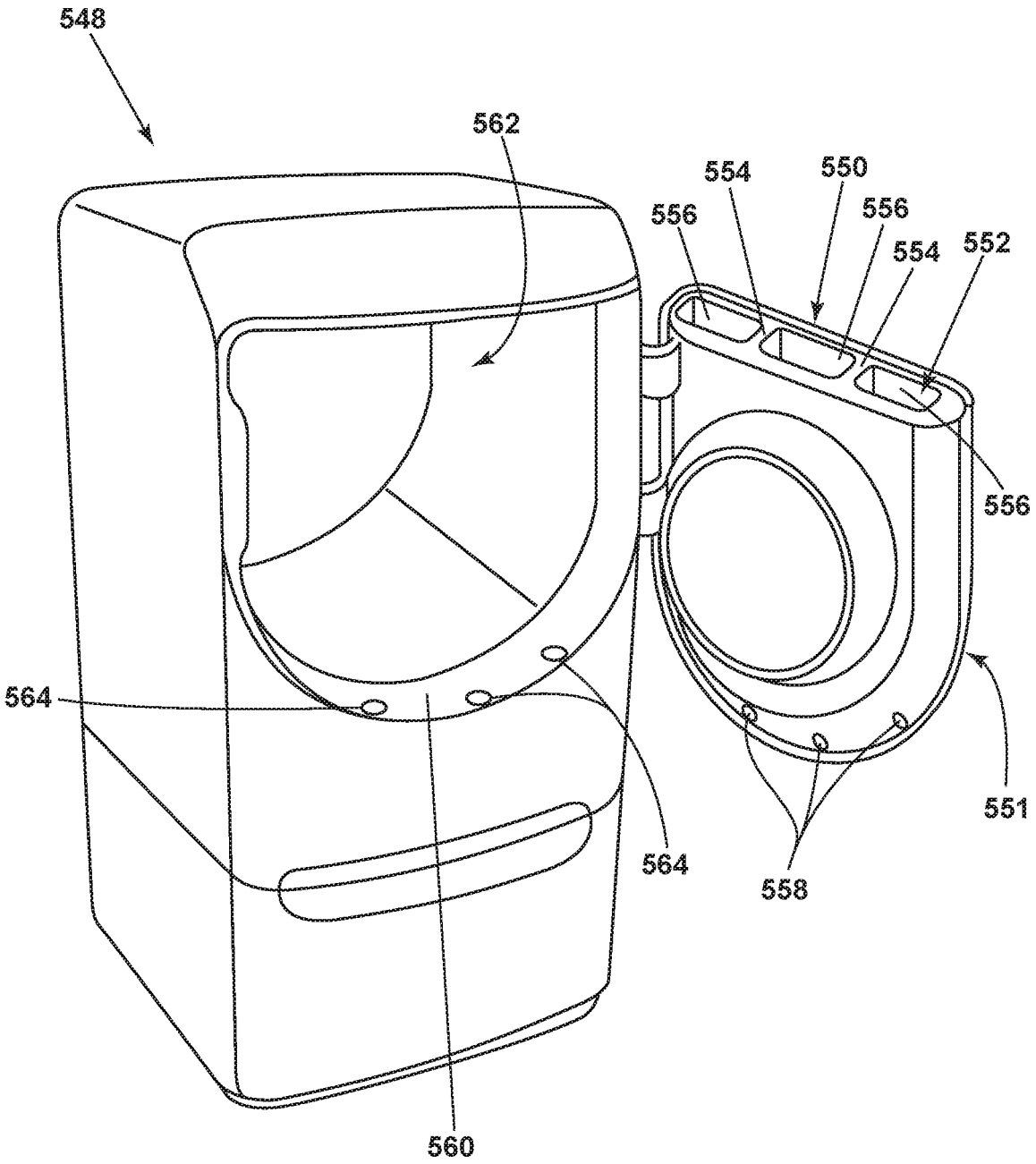

FIG. 54 illustrates another embodiment of a washing machine 548 having a bulk container 550 formed in a door 551. An inlet 552 is included in the door 551 in communication with the bulk container 550. One or more partitions 554 can separate the inlet 552 into multiple openings 556. Indicia can be used to identify each opening 556. Outlets 558 can be disposed on the bottom of the door 551, complementary to the number of openings 556. A seat 560 can define an access opening 562 for the washing machine 548. Receptacles 564 can be disposed in the seat 560 complementary to the outlets 558.

A user can fill the bulk container 550 with a volume of treating chemistry, storing the treating chemistry in the door 551. During operation, the door 551 is closed, sealing the access opening 562. The outlets 558 align with the receptacles 564 for drawing a volume of treating chemistry from the bulk container 550 for use during a cycle of operation. Drawing of the treating chemistry can be performed by a pump, such as the pumps of FIGS. 17-19.

Figure 55:
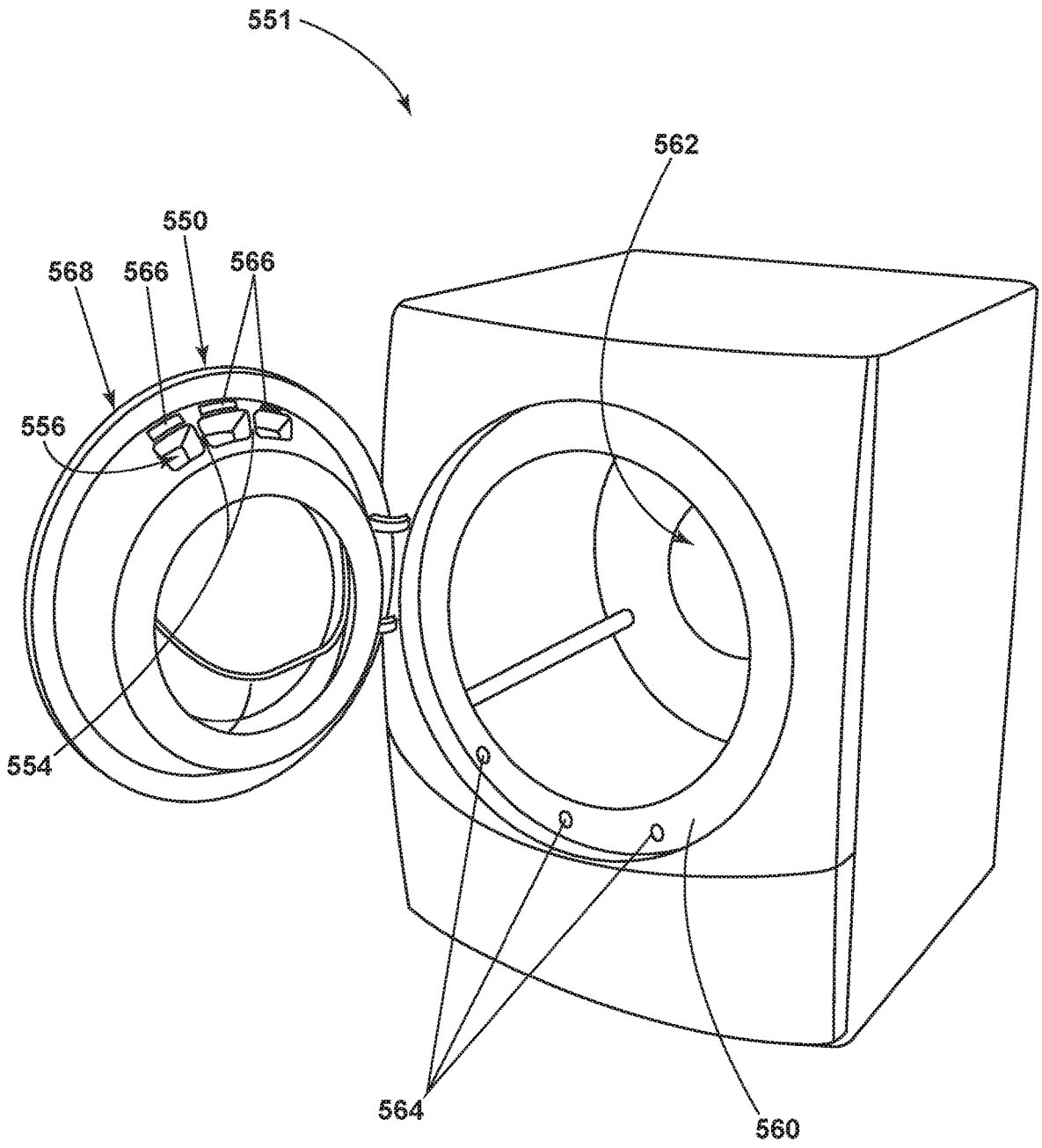

FIG. 55 illustrates another embodiment of the bulk container 550, having a round door 568 with an arcuate top. The embodiment of FIG. 55 can be substantially similar to that of FIG. 56. As such, similar numerals will be used to describe similar elements. As is appreciable, the openings 556 include indicia 566 to identify the particular treating chemistry to be placed into each opening 556. The round door 568 can include a bulk container 550 similar to that of FIG. 54.

Figure 56:
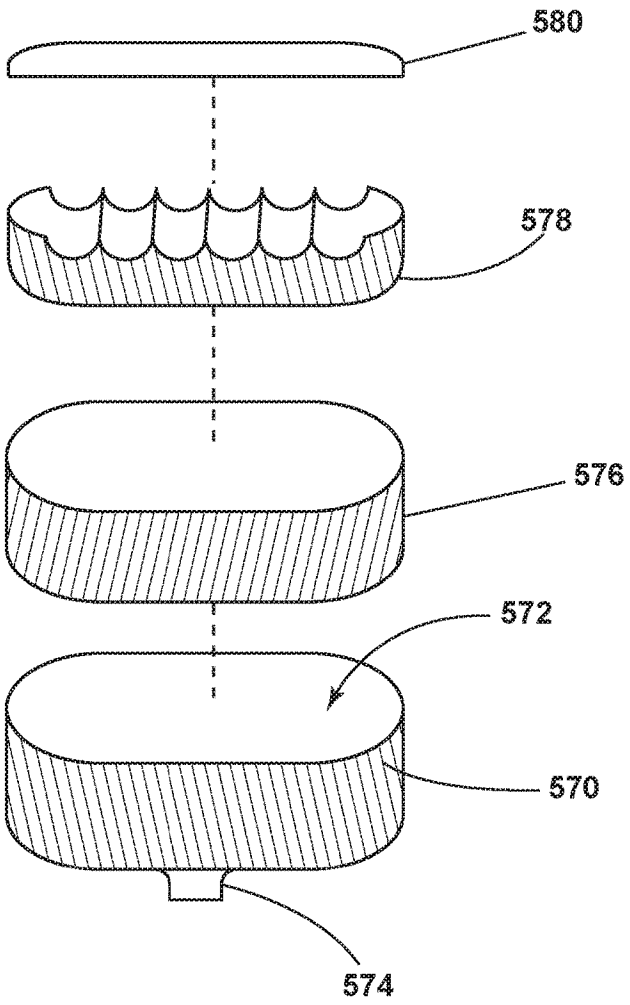
FIG. 56 illustrates a hyper-slippery coating or surface for the bulk containers described herein.

FIG. 56 illustrates a hydrophobic or hyper-slippery surface utilized with any of the bulk containers or bulk dispensers described herein. A bulk container 570 includes an interior 572 and an outlet 574. A hyper-slippery coating 576 is disposed in the interior 572. A volume of treating chemistry 578 is placed in the interior 572. A lid 580, for example, can selectively open and close the bulk container 570. The hyper-slippery coating 576 can be any suitably material having a low coefficient of friction. Such a hyper-slippery coating 576 can be formed for the particular bulk container 570, such as by molding or extrusion in non-limiting examples. In other, non-limiting examples, the hyper-slippery coating 576 can be coated onto the interior 572 of the bulk container 570, such as by spraying, brushing, pouring, or any other method. The hyper-slippery coating 576 prevents build-up of treating chemistry within the bulk container 570 and facilitates cleaning. Additionally, any interior pumps, conduits, or other connections through which the treating chemistry passes can be coated with the hyper-slippery coating 576 to prevent internal build-up. Such hyper-slippery coating 576 minimizes required maintenance and cleaning of the bulk container 570 or the particular washing machine. Additionally, a hydrophobic coating can prevent the build-up of any material and provide for full usage of treating chemistry by the user. Additionally, costs can be minimized by eliminating the need to flush the system. Furthermore, during operation, the hyper-slippery coating facilitates use of nearly all of the treating chemistry within the bulk container or dispenser, rather than leaving a portion of the treating chemistry at the bottom of the container which may be otherwise inaccessible by the particular washing machine. In one example, such a hyper-slippery or hydrophobic coating can be made available by LIQUIGLIDE™ of Cambridge, Mass.

Figure 57:
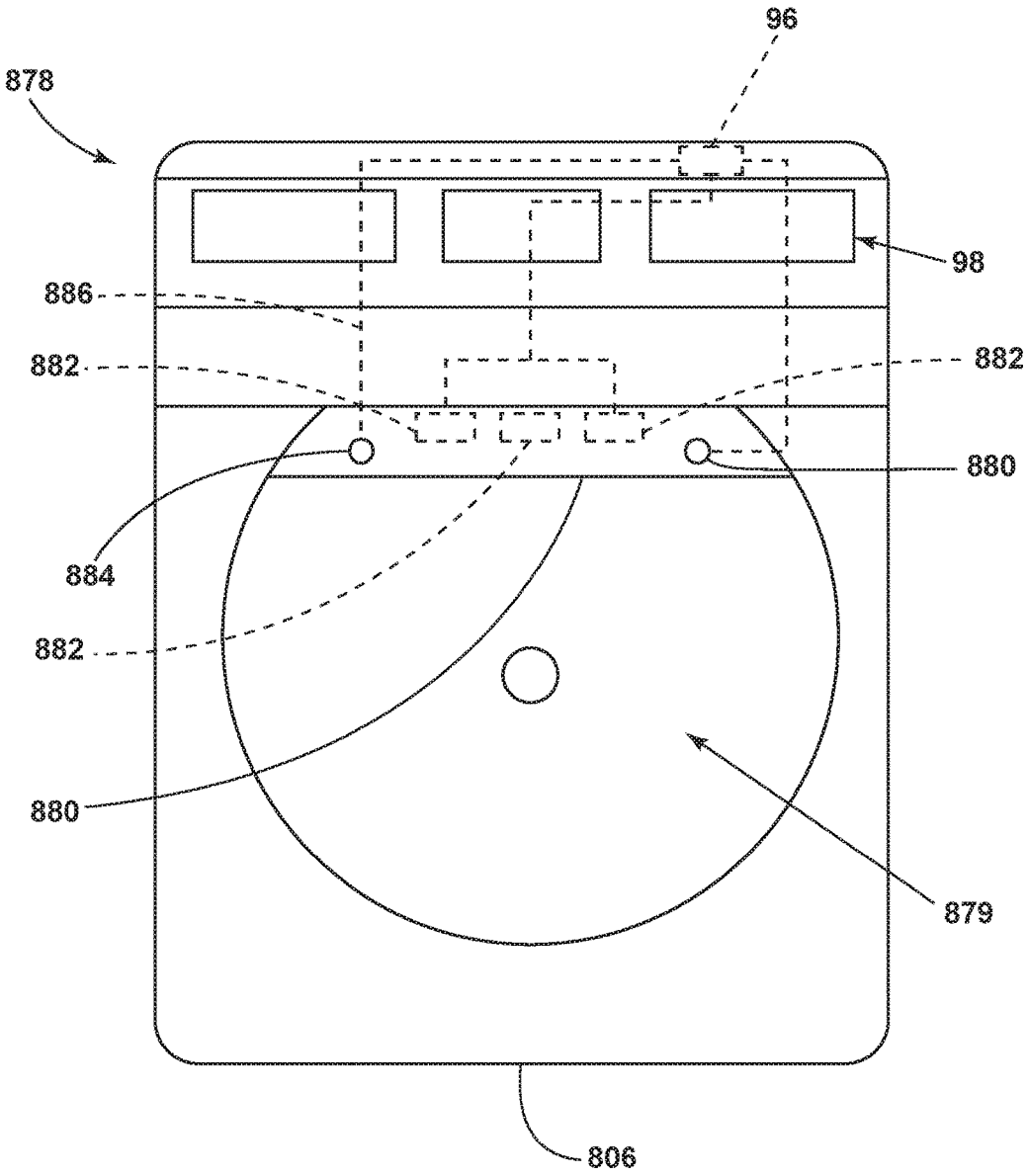
FIG. 57 illustrates a fascia for protecting the nozzles of FIGS. 24-26.

Referring to FIG. 57, a washing machine 878 having a treating chamber 879 includes a bezel or fascia 880 that can be used to protect a set of nozzles 882. The nozzles 882 can be exemplary, and can be any of the nozzles described herein and can be communicatively coupled with the controller 96 (FIG. 1) via conduits 886. The fascia 880 can extend partially over the treating chamber 879 to cover the nozzles 882 during loading of the washing machine 878. Thus, the fascia 880 protects the nozzles 882 from user damage. The protected nozzles 882 can be made of any material, and need not be a rubber or flexible material, which can reduce nozzle cost. The fascia 880 can include indicia, such as stickers, indicating to a consumer that that washing machine 878 is bulk enabled. Such information is beneficial for informing customers of the features of the washing machine 878 on a showroom floor. The fascia 880 can further include buttons 884. The buttons 884 can be in communication with the controller 96. Activating the buttons 884 can selectably dispense a portion of treating chemistry from the nozzles 882 as may be desirable. The buttons 884 in combination with the nozzles 882 collectively form a pre-treating station, where stains or other spots on laundry can be treated prior to wash.

For example, a user may have an article of laundry for treatment which requires additional stain treatment. The user can place the article underneath the fascia 880 and press one of the buttons 884. The controller 96, being in communication with the button 884, can provide a portion of treating chemistry from the nozzles 882 related to the particular button 884 to treat the particular article. Additionally, the controller 96 can record the amount of treating chemistry applied to the article and subtract that from the total amount of treating chemistry applied to the load during a cycle of operation. As such, excessive use of the treating chemistry is prevented, minimizing sudsing or overtreating of the laundry. It should be understood that as used herein, sudsing is the phenomenon where excessive soap bubbling occurs, which can spill out from the washing machine making a mess. Additionally, it is contemplated that nozzles can be utilized to dispense stain treatment chemistry, as opposed to utilizing detergent to treat the articles, permitting a full dosage of detergent during the cycle of operation.

Figure 58A:
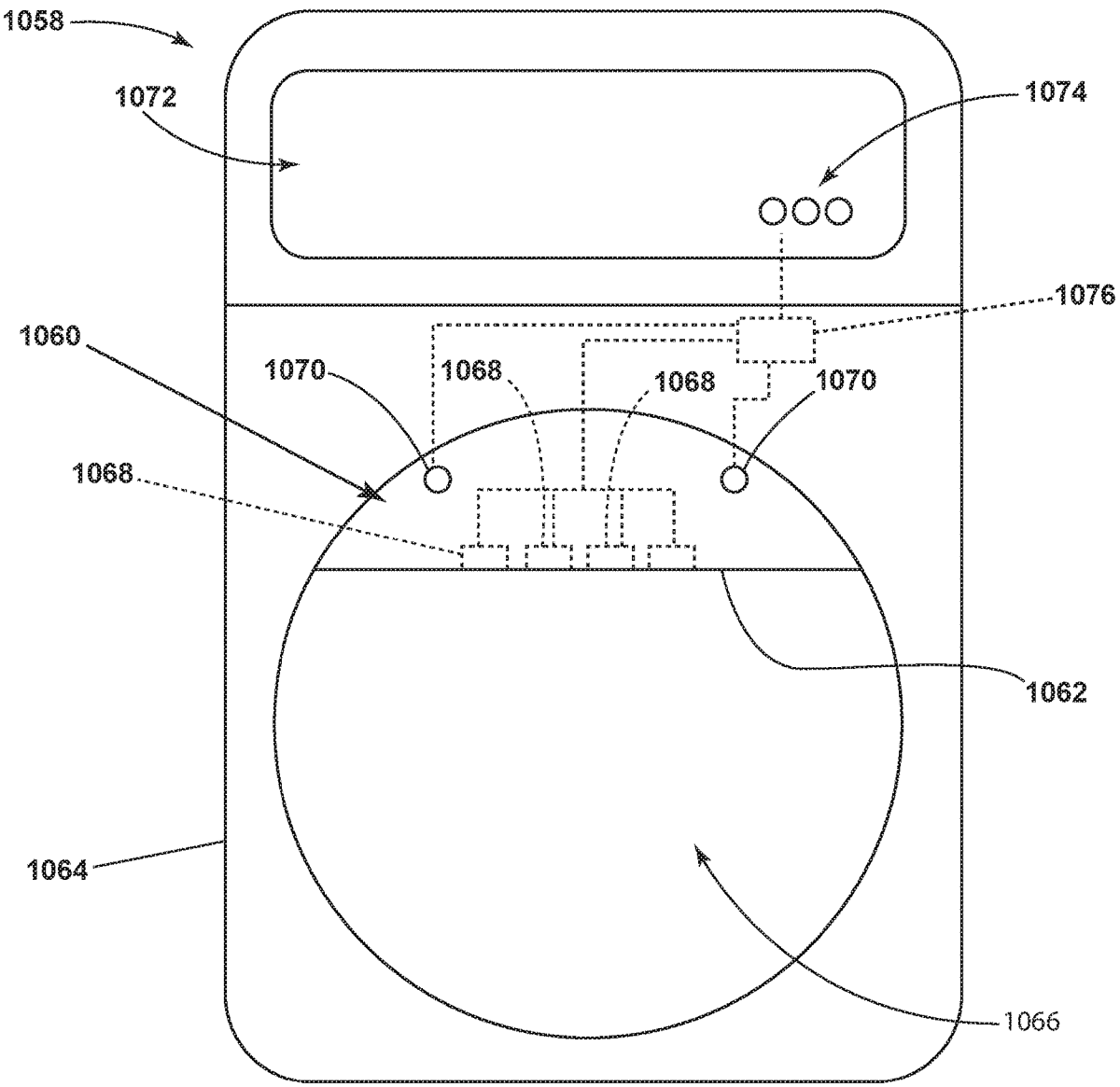
FIGS. 58A-58B illustrates a stain station for selectively treating an article prior to a washing cycle.

FIG. 58A includes the washing machine 1028 including a stain station 1060 including a fascia 1062. The fascia 1062 mounts to a chassis 1064 having a treating chamber 1066 disposed within the chassis 1064. The stain station 1060 can be a treating chemistry station including one or more actuators 1070, such as buttons or manual pumps for dispensing treating chemistry. The fascia 1062 can include mounted nozzles 1068. One or more conduits can couple the nozzles to a pump 1076. While the pump is shown within the chassis 1064, it should be appreciated that the pump 1076 can mount to the fascia 1062 or the stain station 1060. The conduits can also couple to the actuators 1070 for pumping the treating chemistry into the treating chamber 1066 from the nozzles 1068.

The pump 1076 as well as the stain station 1060 can communicatively couple to a user inter face 1072 where a user can selectively control the stain station 1060 from a human machine interface (HMI) 1074.

Additionally, it is contemplated that a sensor can be included with the stain station 1060. For example, a sensor could detect the number of actuations of the actuator or could include a flow meter disposed on the conduits. As such, the sensor can make a measurement of the treating chemistry provided from the stain station 1060 to determine a sensor output representative of the treating chemistry dispensed.

In operation, the stain station 1060 can be used to dispense a volume of treating chemistry form the pumps 1068 into the treating chamber 1066 or onto an article of clothing that a user holds underneath the fascia 1062. The nozzles 1068 can be multiple nozzles 1068 coupled to multiple conduits for running multiple different fluids, such as hot or cold water, or different treating chemistries such as detergent, stain treatment, or fabric softener in non-limiting examples.

A method of operation can include a user selecting a cycle of operation at the HMI 1074. According to the selected cycle of operation, the laundry treating appliance 1028 can determine an amount of treating chemistry dispensed from the stain station 1060 during a pre-treating operation to define a determined amount of pre-treating chemistry. The machine 1028, such as a controller disposed therein, can reduce a predetermined amount of treating chemistry for the selected cycle of operation based on the determine amount of pre-treating chemistry to define a reduced treating chemistry amount. Then, dispensing the reduced treating chemistry amount during the execution of the selected cycle of operation. As such, the user can selectively pre-treat the clothing as is desirable, while the washing machine 1028 accurately records the amount used in order to prevent over treating of the laundry by excessive pre-treatment by the user. Thus, cleaning efficiency can be improved and clothing degradation through wash, minimized.

Figure 58B:
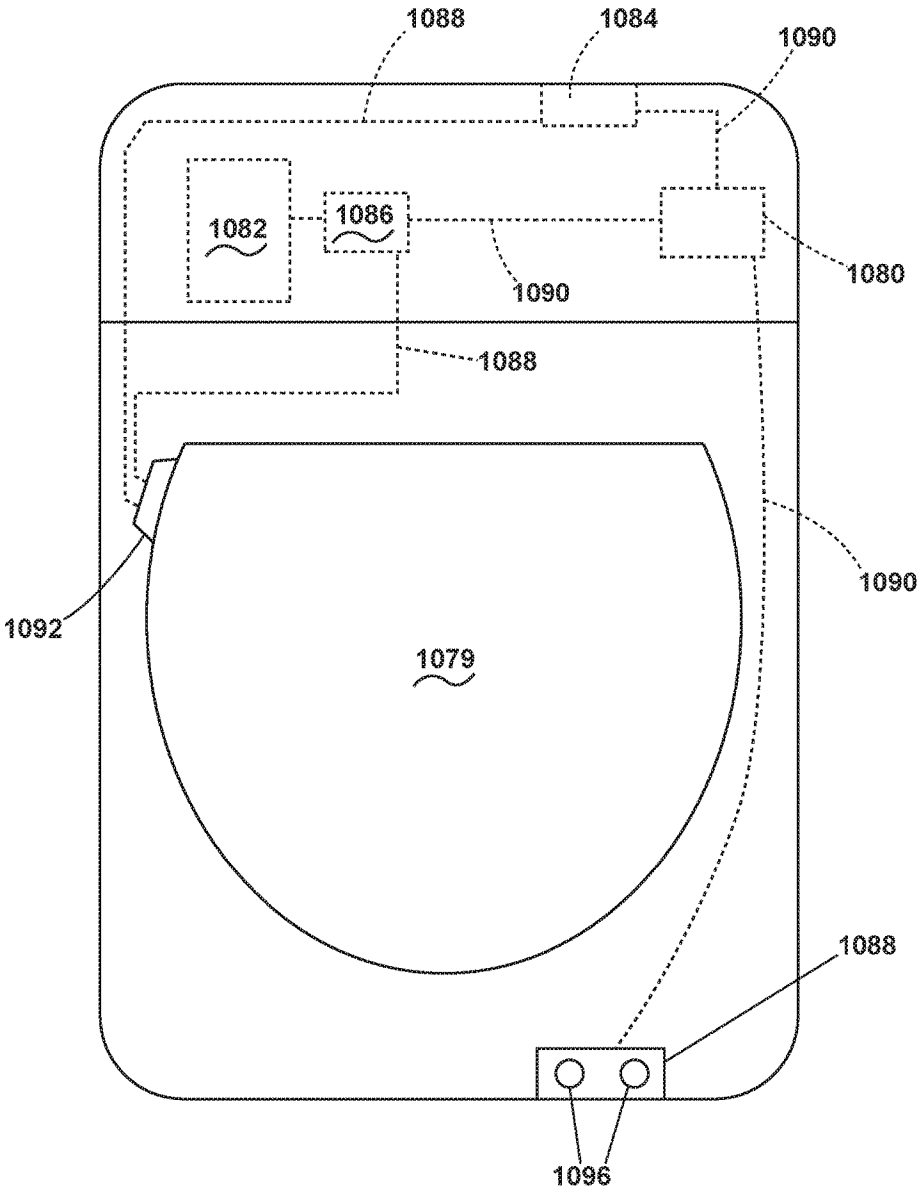

FIG. 58B includes an alternative washing machine 1078 including a treating chamber 1079 for treating articles according to a cycle of operation. A controller 1080 can communicatively couple to a user interface, such as any UI described herein for receiving instruction from a user for implementing the cycle of operation. The washing machine 1078 can further include a bulk container 1082, a water valve 1084 and a pump 1086. The controller 1080 can communicatively couple to the valve 1084 and the pump 1086 via communication conduits 1090, such as electronic wiring. As such, the controller 1080 can operate the valve 1084 or pump 1086 according to the cycle of operation. The pump 1086 can fluidly couple to the bulk container 1082 for drawing a volume of treating chemistry from the bulk container.

A nozzle 1092 can be disposed at the treating chamber 1079 for providing a volume of fluid to the treating chamber 1079. The nozzle 1092 can fluidly couple to the pump 1086 and the valve 1084 for receiving a volume of fluid, such as water and treating chemistry, for providing to the treating chamber 1079. One or more fluid conduits 1088 can fluidly couple the pump 1086 and the valve 1084 to the treating chamber 1079 or the nozzle 1092. The nozzle 1092 can mix the supply of water and treating chemistry for a mixed application to the treating chamber 1079 or a load disposed therein. Alternatively, the valve 1084 can fluidly couple to the pump 1086. The water and detergent can mix at the pump 1086, with the pump 1086 providing the mixture to the treating chamber 1079 via the nozzle 1092.

The washing machine 1078 can further include a stain station such as a stain panel 1094 including at least one button 1096. The stain panel 1094 can communicatively couple to the controller 1080 with a conduit 1088, similar to the valve 1084 and the pump 1086. The buttons 1096 can generate and provide a signal to the controller 1080 to selectively control the pump 1086, valve 1084, or combination thereof to dispense a volume of water and treating chemistry from the nozzle 1092. While only two buttons 1096 are shown, the panel 1094 can include any number of buttons 1096, being one or more, with each button relating to a different fluid, such as water, detergent, stain chemistry, or any other chemistry desirable for use in a washing machine 1078.

In operation, a user can operate the buttons 1096 to provide a signal to the controller 1080. The controller 1080 can operate the valve 1084 and the pump 1086 to provide a fluid to the treating chamber 1079 at the nozzle 1092. A user can place an article under or adjacent the nozzle 1092 to receive the fluid from the nozzle 1092 to treat, pretreat, or otherwise dispense the fluid to the article as is desirable.

Additionally, in operation, the mixture of detergent and water can be directly applied to the load form the nozzle, upon mixing the water and detergent, for immediate application of the mixture upon activation of the detergent in the water directly and evenly to the load. Such an application can be accomplished through slowly rotating the treating chamber. As such, application is improved through contact during initial activation of the detergent and even application among the load.

It should be further appreciated that the blend of water and detergent can be delivered directly to the article in a more concentrated form, yielding a detergent-rich prewash with the washing machine 1078 of FIG. 58B. As such, cleaning can be enhanced as the detergent can soak through a load from the top down, as opposed to pre-activating the detergent, such as within the washing machine sump, prior to contact with the clothing. Additionally, the detergent can be dosed over time throughout the cycle or operation, directly to the load, evenly applying the detergent upon initial activation, as opposed to a single bulk dose initially contacting only a portion of the load, or diluting in the water supply. Finally, the user can provide a particular stain or spot treatment to an article via the nozzle 1092 by actuating the buttons 1096. The stain treatment can be improved with activation of the treating chemistry at the nozzle 1092 upon direct application to the article. Additionally, the controller 1080 can record the volume of treating chemistry supplied during the stain or spot treatment to prevent excessive detergent in the wash cycle, which can lead to sudsing.

Figure 59:
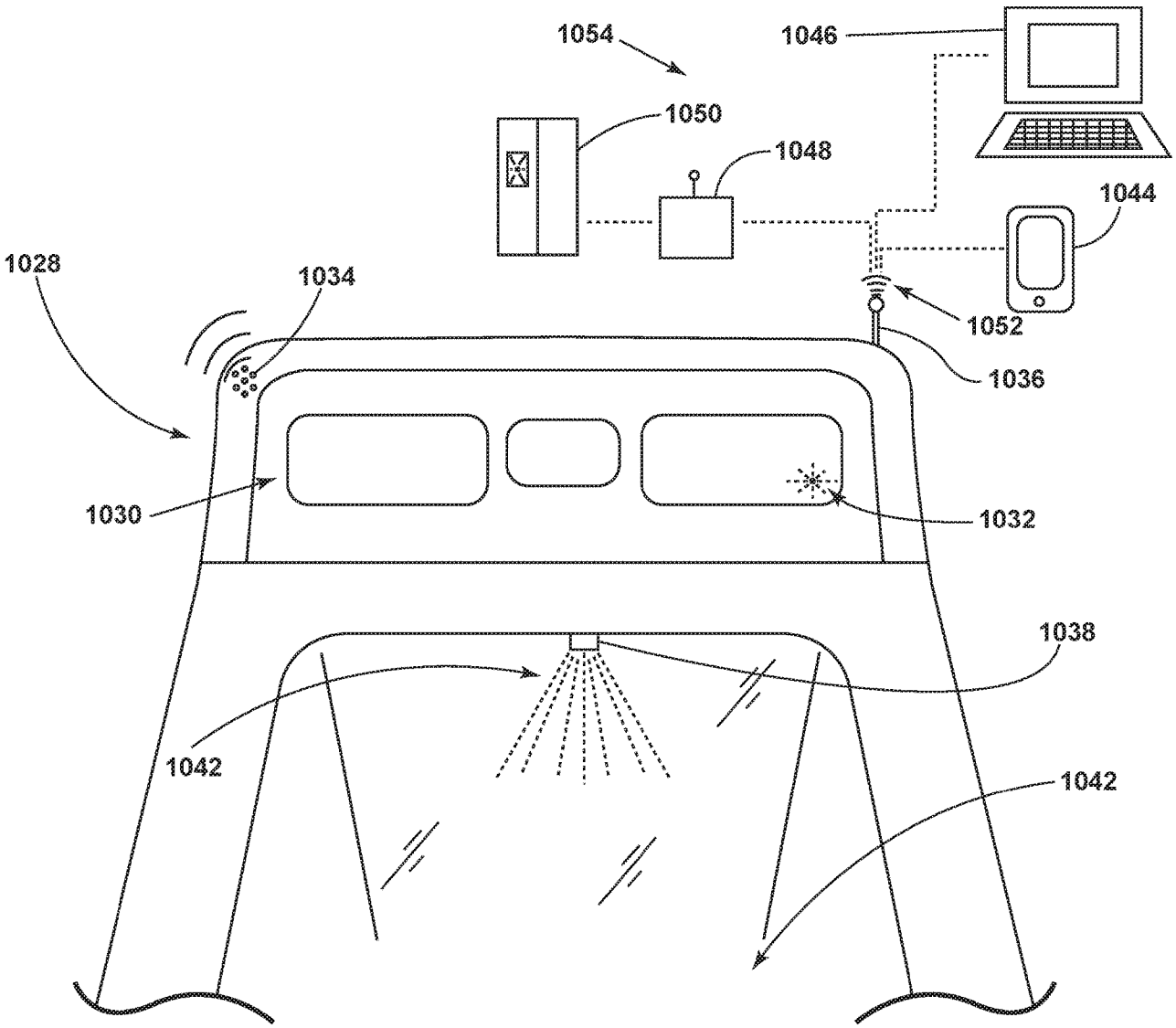
FIG. 59 illustrates multiple methods for providing feedback to a user indicating proper dispensing of treating chemistry.

FIG. 59 illustrates a washing machine 1028 including multiple methods for alerting a user regarding the treating chemistry. The washing machine 10 includes a user interface 1030 with a light 1032, a speaker 1034, and a wireless module 1036. It should be understood that while the wireless module 1036 is illustrated as an antenna, the wireless module 1036 can be housed within the user interface 98. The washing machine 10 also includes at least one nozzle 1038 for dispensing a volume of treating chemistry, water, or a mixture thereof 1040 into a treating chamber 1042.

During dispensing of the treating chemistry, water, or mixture 1040, a volume of treating chemistry can be provided from a bulk dispenser 60 or a bulk container 120, such as those of FIG. 3 or 33-55. The washing machine 10 can alert the user when the dispensing of the treating chemistry 1040 is proper or improper. For example, light 1032 or similar visual indicator, can be illuminated on the user interface 1030 indicating the status of the dispensing of the treating chemistry 1040. If the treating chemistry 1040 is being improperly dispensed, the light 1032, for example, can illuminate a refill dispenser indicia, informing the user that the treating chemistry 1040 may be low.

In another example, the speaker 1034 or other audible indicator, can indicate when the treating chemistry 1040 is properly or improperly being dispensed. For example, the treating chemistry 1040 is being improperly dispensed, a beeping or buzzing noise can alert the user that the bulk dispenser may need to be refilled. Additionally, the audible indicator can be a short phrase, such as "Please Refill Detergent." Such a phrase can be tailored to a particular status of the dispensing of the treating chemistry. For example, the audible indicator can direct the user to refill a bulk dispenser or container, or check the connection of the bulk dispenser to the washing machine.

In yet another example, the wireless module 1036 can inform the user of the status of dispensing of the treating chemistry 1040. The wireless module 1036 can be in communication with, for example, a mobile device 1044, remote enabled computing device 1046 such as a desktop computer, network device 1048, or another appliance 1050 in non-limiting examples. Such devices can be connected over a network 1054, such as a local area network (LAN), home area network (HAN), wireless area network (WAN), or the internet in non-limiting examples. Additionally, a wired connection is contemplated.

Connection of the washing machine 10 to these devices can provide information related to proper or improper dispensing of the treating chemistry 1040 over a wireless signal 1052. For example, the washing machine 10 can send the wireless signal 1052 to the mobile device 1044 indicating the status of the dispensing of the treating chemistry 1040. In one particular example, the signal 1052 can include cycle status, informing the user of the current stage in the cycle and that the detergent has been properly dispensed. In another particular example, the signal 1052 can include that the detergent has been improperly dispensed, such that the detergent may need to be replaced or refilled. The signal 1052 can be transmitted over the network 1054 to the mobile device 1044, the remote enabled computing device 1046, the appliance 1050, or any other device connected to the network 1054 where the signal can be received and communicated to the user representative of the status of the dispensing of the treating chemistry 1040.

Additionally, such a communication can be representative of the bulk system being properly interconnected prior to the beginning of a cycle of operation. For example, if the spigot (FIGS. 27-28) is not properly connected to the pump, the light 1032, speaker 1034, wireless module 1036, or any other method can alert a user that the bulk container or dispenser has not been properly connected. One or more sensors (not shown) can be used within the system to determine improper or proper connection of the system, which can be communicated to the user.

Figure 60:
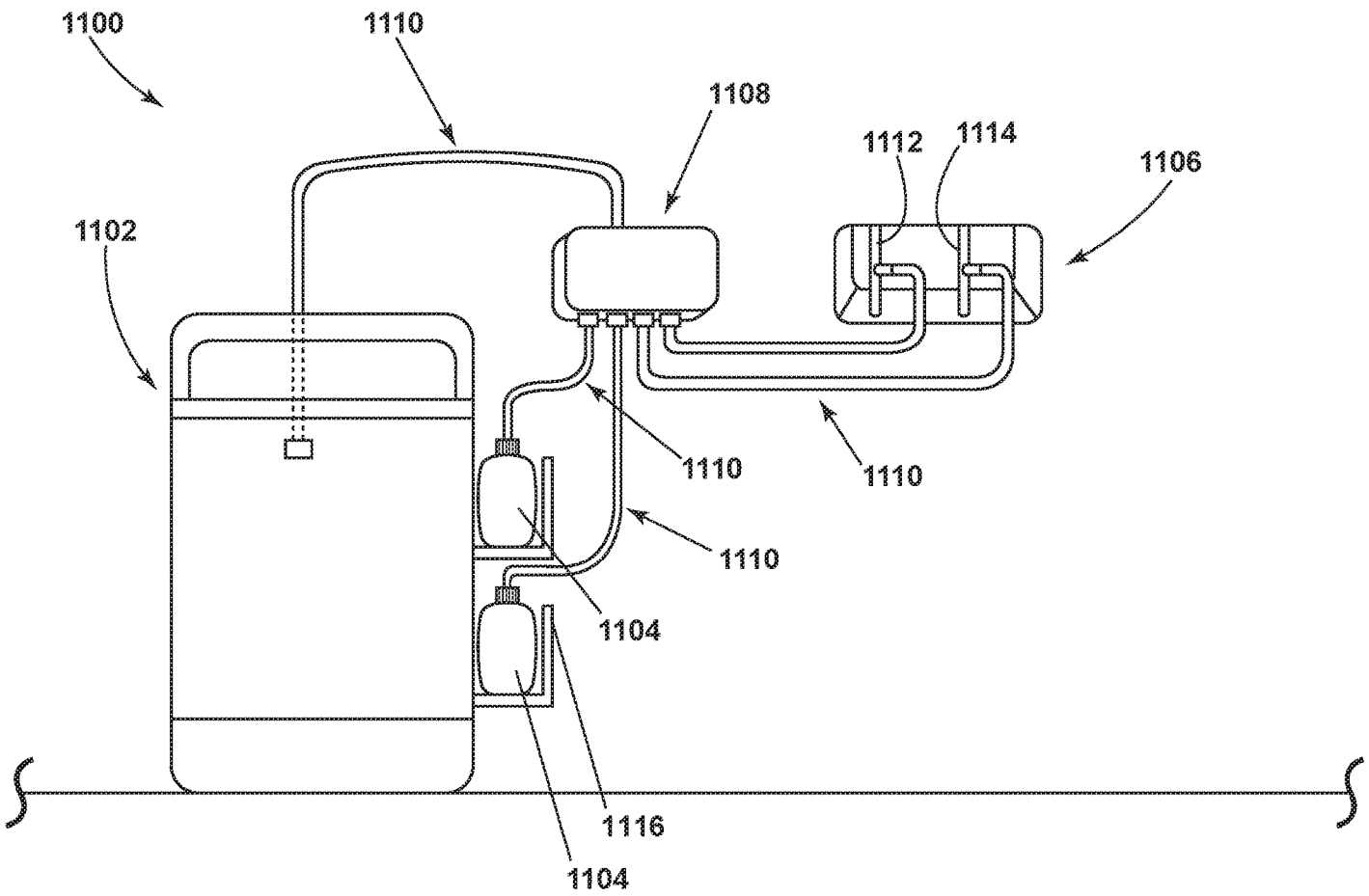
FIG. 60 illustrates a bulk dispensing system for fitting a washing machine for bulk dispensing.

FIG. 60 illustrates a stand-alone bulk dispenser system 1100. The system 1100 includes a washing machine 1102, bulk dispensers 1104, a household water supply 1106, and a retro-fit unit 1108. A system of conduits 1110 interconnects the parts of the system 1100. The household water supply 1106 can include a hot water supply 1112 and a cold water supply 1114. The hot and cold water supplies 1112, 1114 couple to the retro-fit unit 1108 with conduits 1110. The bulk dispensers 1104 can be a plurality of dispensers for supplying different treating chemistries to the retro-fit unit 1108. One or more mounts 1116 can be incorporated with the washing machine 1102 for holding the bulk dispensers 1104. Alternatively, the bulk dispensers 1104 can be incorporated with any method described herein, such as shown in FIGS. 33-55. Such bulk dispensers 1104 can couple to the retro-fit unit 1108 via the conduits 1110. The retro-fit unit 1108 then couples to the washing machine 1102 with one or more conduits 1110.

The retro-fit unit 1108 can be a single unit mountable to a wall or building structure, for example, or can be placed on a shelf. The retro-fit unit 1108 provides for receiving a flow of water from the household water supply 1106 and receiving a volume of one or more treating chemistries from the bulk dispensers 1104. The retro-fit unit 1108 can selectively intermix the treating chemistries from the bulk dispensers 1104 with the water supplies 1112, 1114 and provide such a mixture to the washing machine 1102 for use in a cycle of operation. Additionally, the retro-fit unit 1108 can provide a supply of water 1112, 1114 to the washing machine 1102 without integrating any treating chemistry into the supply. Thus, a washing machine 1102 without bulk dispensing capabilities can be retrofitted to have bulk dispensing capabilities.

Figure 61:
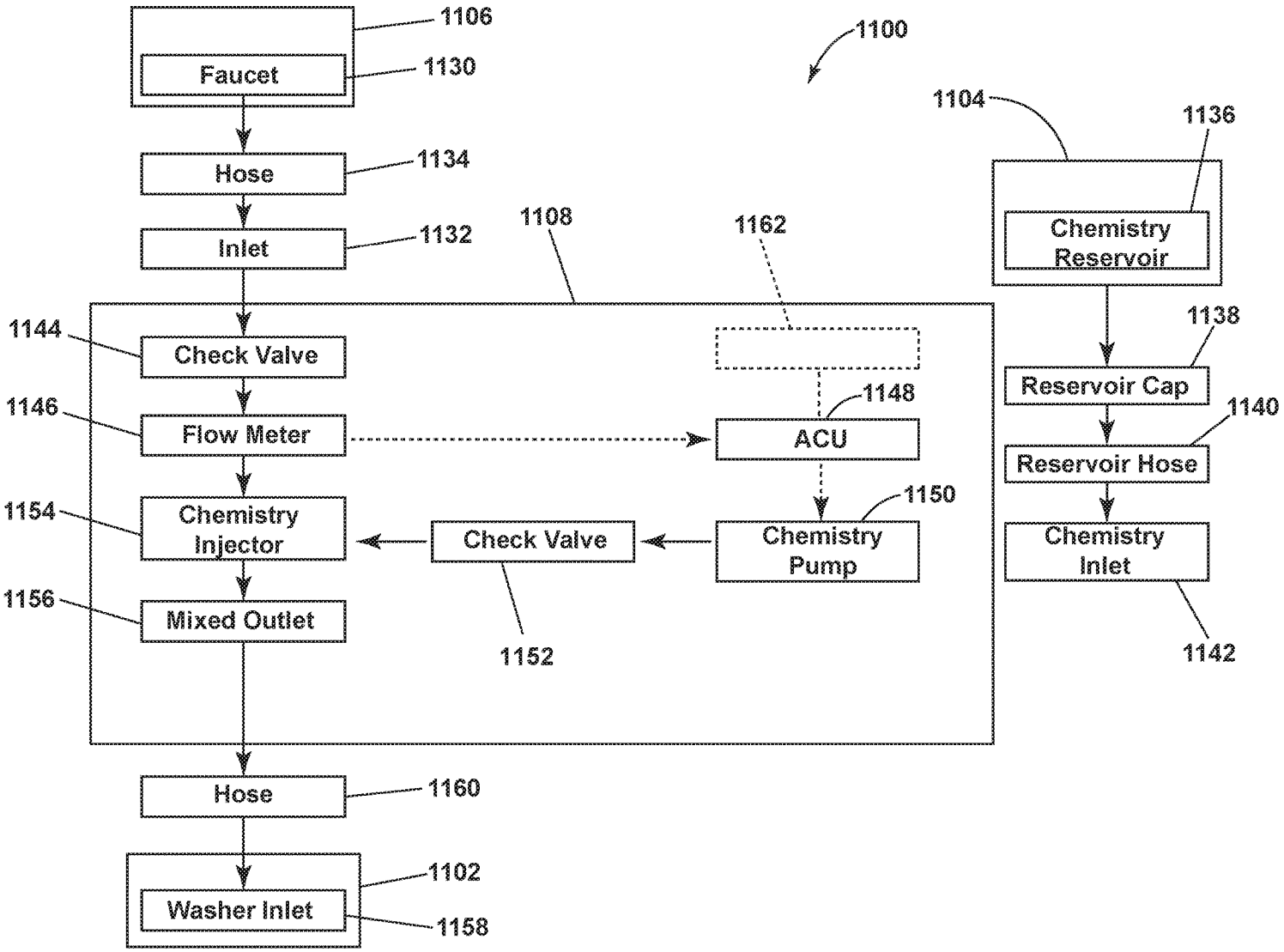
FIG. 61 illustrates a connection chart detailing the elements of the bulk dispensing system of FIG. 60.

FIG. 61 illustrates a flow chart schematic showing the movement of liquids, such as the household water supply 1106 and treating chemistries within the system 1100 of FIG. 60. The household water supply 1106 includes one or more faucets 1130. The retro-fit unit 1108 can include one or more water inlets 1132 complementary to the faucets 1130. A water hose 1134 fluidly couples the faucets 1130 to the inlets 1132 for supplying a volume of water to the retro-fit unit 1108 from the household water supply 1106.

The bulk dispenser 1104 defines a reservoir 1136 for storing treating chemistry. In an example using a bulk dispenser 1104 as an off-the-shelf consumer product, a reservoir cap 1138 can be applied to the bulk dispenser 1104 having a reservoir hose 1140. At a chemistry inlet 1142 on the retro-fit unit 1108, the reservoir hose 1140 can couple the bulk dispenser 1104 to the retro-fit unit 1108 for providing a volume of treating chemistry from the reservoir 1136.

The retro-fit unit 1108 contains a water check valve 1144, a flow meter 1146, an appliance control unit (ACU) 1148, a chemistry pump 1150, a chemistry check valve 1152, a chemistry injector 1154, a mixed outlet 1156. The water check valve 1144 provides for permitting a one-directional flow of water from the water inlet 1132, preventing any back flow of water. The flow meter 1146 can measure the flow rate or water pressure provided from the water supply 1106. The ACU 1148 is in communication with the flow meter 1146 to determine a rate, volume, duty cycle, or similar measured value of treating chemistry to be provided from the bulk dispenser 1104 based upon the measurements of the flow meter 1146. The chemistry pump 1150 selectively provides a volume of treating chemistry from the chemistry inlet 1142. The chemistry pump 1150 can be a water pressure pump, such as the pumps of FIGS. 17-19. Such a pump can integrate a flow of treating chemistry into a water supply as a mixed flow. The chemistry check valve 1152 permits one-directional flow of the treating chemistry, preventing any back flow. The chemistry injector 1154 provides the volume of treating chemistry from the chemistry pump 1150 into the household water supply 1106. The chemistry pump 1150 can be a typical pump for providing a controlled volume of treating chemistry to the chemistry injector 1154. The chemistry injector 1154 can selectively supply a volume of treating chemistry to the water supply. Alternatively, the combined chemistry pump 1150, the check valve 1152, and the chemistry injector 1154 can be combined as the water pressure pump, such as the pumps of FIGS. 17-19. Such a water pressure pump can automatically control and optimize the volume of treating chemistry supplied based upon a measured water pressure or flow rate. The mixed outlet 1156 supplies a liquid from the retro-fit unit 1108, such as a supply of water, treating chemistry, or a mixture thereof to the washing machine 1102.

A washer inlet 1158 can be any inlet on the washing machine 1102 for receiving a supply of liquid. An outlet hose 1160 can couple the mixed outlet 1156 to the washer inlet 1158.

Optionally, the retro-fit unit 1108 can have a user interface 1162. The user interface 1162 can be communicatively coupled to the ACU 1148. A user can interact with the retro-fit unit 1108 at the user interface to provide information to the retro-fit unit 1108 regarding the particular washing machine 1102 or a cycle of operation to be performed by the washing machine 1102. As such, operation of the retro-fit unit 1108 can be tailored to the particular washing machine 1102 or the particular cycle of operation to be performed by the washing machine 1102. Such tailoring can improve performance of both the retro-fit unit 1108 and the washing machine 1102, while minimizing consumption of treating chemistry.

In order to set up the system 1100, the water hose 1134 can couple the faucet 1130 to the inlet 1132, such as by threaded connections. The reservoir cap 1138 can be screwed onto the bulk dispenser 1104, having the reservoir hose 1140 coupled to the reservoir cap 1138. The remaining end of the reservoir hose 1140 can couple to the chemistry inlet 1142, such as by a threaded connection. The outlet hose 1160 couples the retro-fit unit 1108 to the washing machine 1102, such as with similar threaded connections.

In operation, a cycle of operation is selected on the washing machine 1102 by a user. Optionally, such information can be provided to the retro-fit unit 1108 at the user interface 1162. The washing machine draws a volume of liquid from the retro-fit unit 1108 for performing the cycle of operation. A volume of water is drawn from the water supply 1106 into the retro-fit unit 1108. If the current phase of the cycle of operation only requires water, such as a rinse phase, the water flows through the water check valve 1144, the flow meter 1146, the chemistry injector 1154, and out the mixed outlet 1156 to the washing machine 1102 at the washer inlet 1158. The washing machine 1102 dispenses the water into the treating chamber of the washing machine 1102.

If the current phase of the cycle of operation requires treating chemistry, such as a wash phase or fabric softener phase in non-limiting examples, the water is drawn from the water supply 1106 into the retro-fit unit 1108. The water flow rate or pressure is measured by the flow meter 1146 and such measurements are provided to the ACU 1148. The ACU 1148 instructs the chemistry pump 1150 to provide a volume of treating chemistry to the chemistry injector 1154 through the chemistry check valve 1152. The rate at which the treating chemistry is provided to the chemistry injector can be determined by the ACU 1148 based upon the measurements of the flow meter 1146. As such, the chemistry pump 1150 can provide a volume of treating chemistry to the injector 1154 to mix the water and treating chemistry in order to maximize efficiency of the system 1100. Additionally, the volume of treating chemistry can be accurately dispensed, rather than providing too much or too little treating chemistry, typical to user dispensed treating chemistry or single dose dispensing.

The chemistry injector 1154 mixes the treating chemistry with the water and provide the mixture to the washing machine 1102 form the mixed outlet 1156, through the outlet hose 1160 and into the washer inlet 1158.

As such, a user can easily interconnect the bulk dispenser 1104, washing machine 1102, and household water supply 1106 with the retro-fit unit 1108. Such interconnection can be easily accomplished by fastening threaded connections interconnecting the system of conduits 1110. The retro-fit unit 1108 provides for incorporating a bulk dispensing system into the washing machine 1102. Such a washing machine can be a new washing machine equipped to receive the liquid supply from the retro-fit unit 1108, or can be an existing washing machine being retrofitted to receive treating chemistry and water from a bulk dispenser 1104.

It should be appreciated that while FIG. 61 is described as being connected to a single faucet 1130 and a single bulk dispenser 1104, interconnection among multiple faucets 1130 and multiple bulk dispensers 1104 is contemplated. Furthermore, it is contemplated that the retro-fit unit 1108 can be interconnected with a plurality of washing machines 1102, such as in a setting having multiple simultaneous users. Such a system could provide water, treating chemistries, or a mixture thereof to multiple washing machines 1102 or wash units from a single bulk treating chemistry source.

Figure 62:
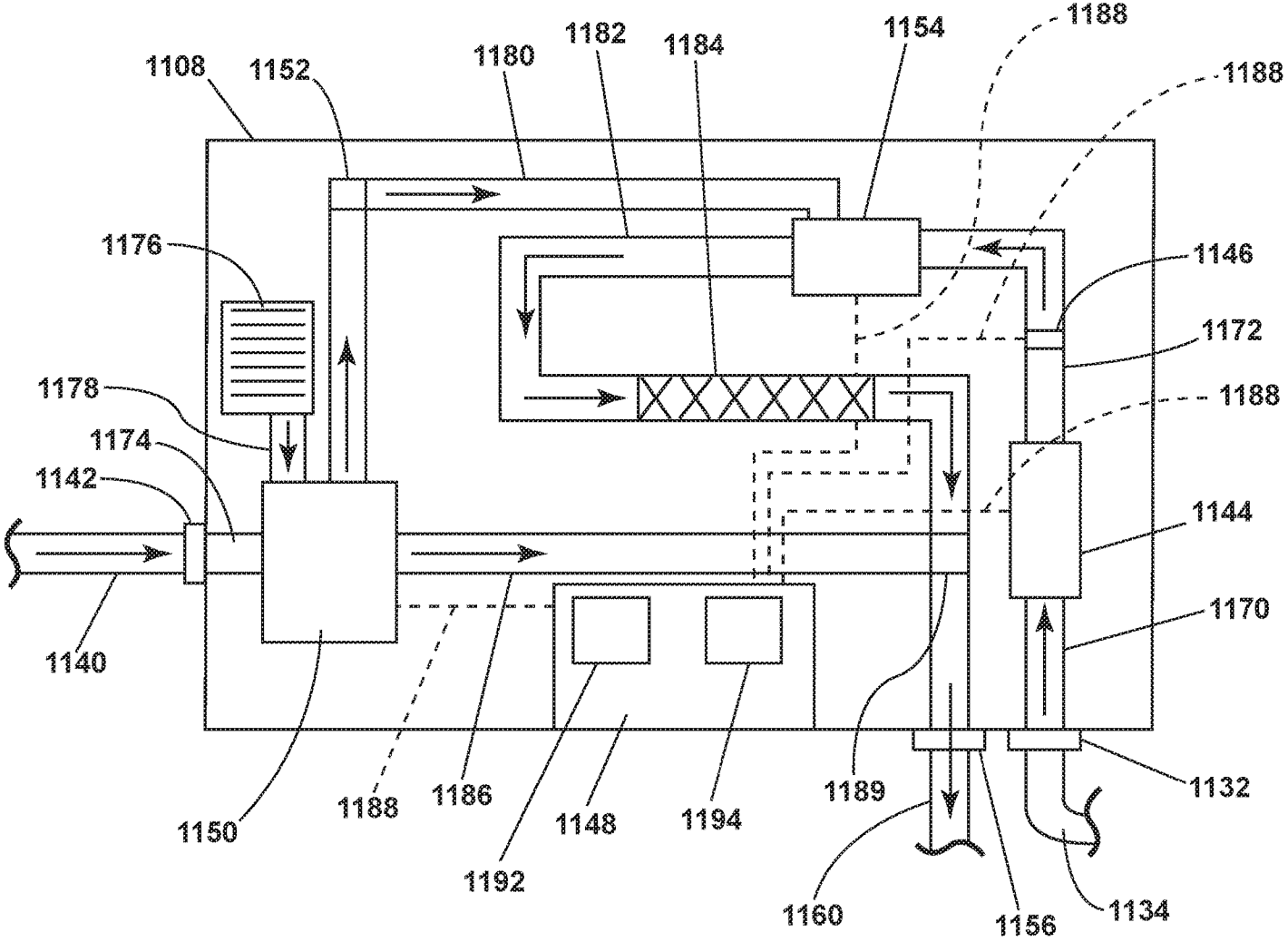
FIG. 62 illustrates a schematic of a wall mounted bulk dispensing unit for the bulk dispensing system of FIGS. 60-61.

FIG. 62 illustrates an example schematic of the retro-fit unit 1108 of FIG. 61. The water hose 1134 couples to the retro-fit unit 1108 at the inlet 1132, such as by threaded connection. A first water conduit 1170 couples the inlet 1132 to the water check valve 1144. A second water conduit 1172 includes the flow meter 1146 and couples the water check valve 1144 to the chemistry injector 1154.

The reservoir hose 1140 couples to the retro-fit unit 1108 at the chemistry inlet 1142. A first chemistry conduit 1174 couples the chemistry inlet 1142 to the chemistry pump 1150. Optionally, an air intake 1176 can be in communication with the pump 1150 via an air conduit 1178 for providing a supply of air in the case where the pump 1150 is a venturi-type pump. A second chemistry conduit 1180 contains the chemistry check valve 1152 and couples the chemistry pump 1150 to the chemistry injector 1154.

The chemistry injector 1154 can selectively integration a volume of treating chemistry into the water supply. A mixed conduit 1182 couples the chemistry injector 1154 to the mixed outlet 1156. A mixer 1184 can be included in the mixed conduit 1182 for intermixing the chemistry and the water downstream of the chemistry injector 1154. The mixed outlet 1156 couples to the outlet hose 1160 for providing liquid from the retro-fit unit 1108 to the washing machine.

Optionally, the chemistry pump 1150 can couple directly to the mixed conduit 1182 with a third chemistry conduit 1186. A valve 1189 can couple at the junction between the mixed conduit 1182 and the third chemistry conduit 1186. As such, chemistry can be directly provided to the washing machine without intermixing with the water supply. Alternatively, the third chemistry conduit 1186 can couple to a dedicated chemistry outlet (not shown) for providing a volume of un-mixed treating chemistry to the washing machine.

A plurality of communication conduits 1188 can communicatively couple the ACU 1148 to the chemistry pump 1150, the flow meter 1146, and the chemistry injector 1154. The ACU 1148 can be a printed circuit board, in one example, and can include a CPU 1192 and a memory 1194. The memory 1194 can include stored software or data relating to providing liquid to the washing machine and the CPU 1192 can operate such software. Optionally, a communication conduit can communicatively couple the user interface (not shown) where the retro-fit unit 1108 includes the user interface. Such a user interface can couple to the CPU to particularly control the retro-fit unit 1108.

It should be appreciated that the retro-fit unit 1108 operates as a stand-alone unit for integrating a water supply and a bulk dispenser external of a washing machine. Such a unit can be utilized to save internal space of the washing machine, permitting increased capacity. As such, the retro-fit unit 1108 can be tailored to the particular washing machine. Additionally, the retro-fit unit 1108 can be used to retrofit current washing machines. The retro-fit unit 1108 can allow of utilizing bulk dispensing with current washing machines. The retro-fit unit 1108 not only makes using the washing machine easier, but can accurately dispense a volume of treating chemistry for optimally treating a load of laundry without over-treating or under-treating the load.

It should be appreciated that the concepts described herein relate to utilizing bulk dispensing of treating chemistry. One or more of the concepts described can be utilized with one another within a single washing machine. As such, it is contemplated that such concepts can be integrated into a washing machine with one another as may be possible.

Figure 63:
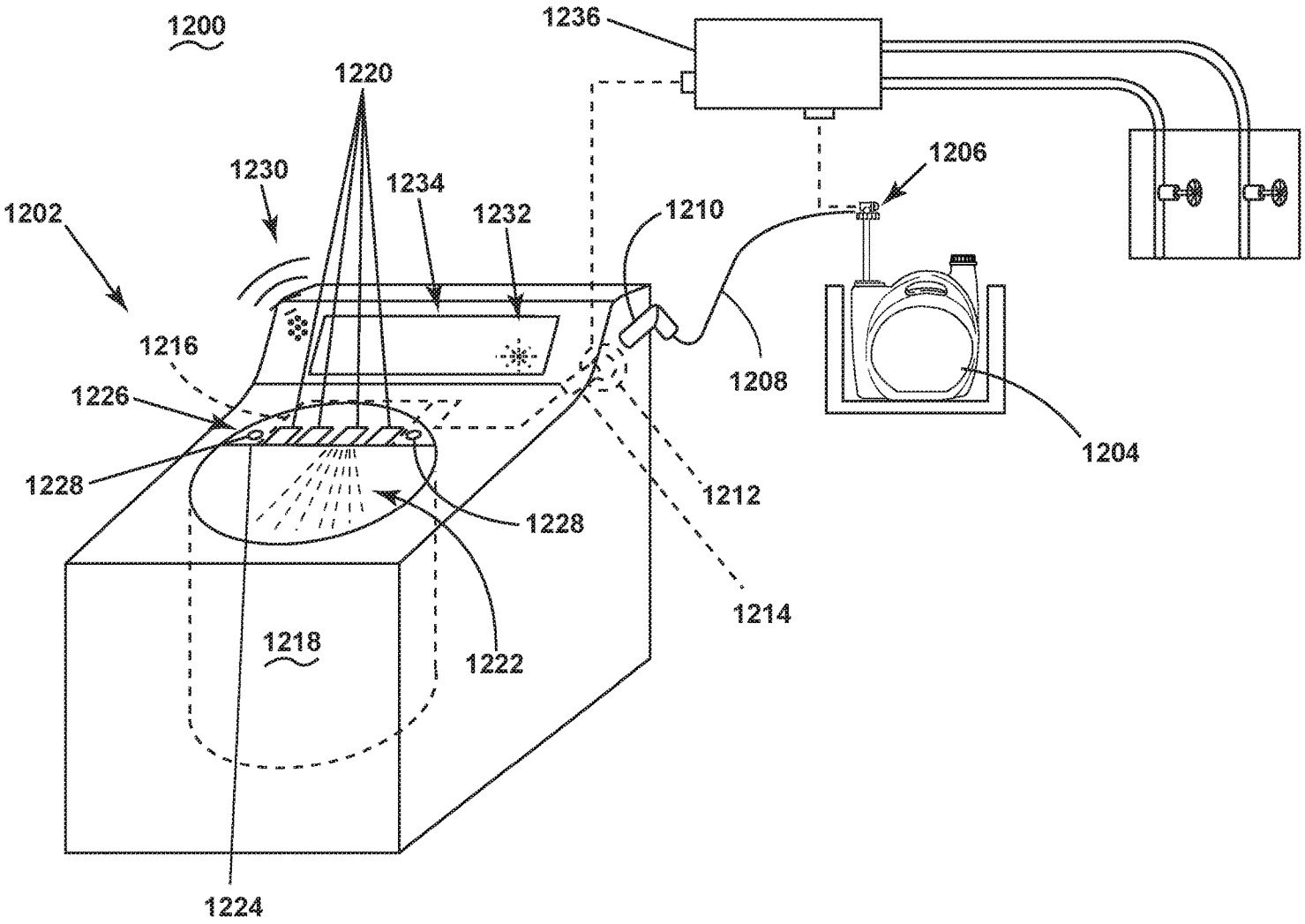
FIG. 63 illustrates an overview of a bulk washing system incorporating multiple elements from FIGS. 1-62.

One such example is illustrated in FIG. 63, showing a bulk dispensing system 1200. FIG. 63 utilizes an exemplary washing machine 1202 that can be any washing machine described herein, such as a vertical or horizontal axis washing machine in non-limiting examples. A bulk dispenser 1204 or bulk container can store a volume of treating chemistry. Such bulk dispensers 1204 can be off-the-shelf bulk dispensers 1204, such as those seen in FIG. 3. The bulk dispensers 1204 can be incorporated into the system 1200 in multiple ways, such as seen in FIGS. 33-37, and 49. Alternatively, the bulk dispensers 1204 can be integrated into the washing machine as bulk containers, such as those seen in FIGS. 38-48, and 50-55. Additionally, each integrated bulk container can be treated with a hyper-slippery chemistry, such as that of FIG. 56, facilitating cleaning and dispensing of the treating chemistry.

A dedicated cap 1206 can be used to couple the bulk dispenser 1204 to the washing machine 1202. The cap 1206 can be the cap of FIGS. 4-11. The cap 1206 can couple the bulk dispenser 1204 to the washing machine 1202 with a conduit 1208. The conduit terminates at a spigot 1210, which can be the liquid interface of FIGS. 12-16 or the spigot of 27-28. A ring 1212, such as the ring of FIGS. 27-28 can be used to identify proper connection of the bulk container to the washing machine for incorporating multiple treating chemistries. A pump 1214 can couple to the spigot 1210 for drawings a volume of treating chemistry into the washing machine 1202. Upon proper connection of the spigot 1210 to the pump 1214, the washing machine can provide feedback to the user indicating proper connection, such as an audible 1230 or visual 1232 response at a user interface 1234 in non-limiting examples. The pump 1214 can be the pump of FIGS. 17-19. The pump 1214 provides the treating chemistry to a housing 1216. While not shown, the pump 1214 can be integrated within the housing 1216, such as shown in FIG. 29-32. Within the housing 1216, a flow of water can be mixed with the treating chemistry from the pumps 1214 or at the pumps 1214 to provide a mixture of treating chemistry and water to a treating chamber 1218 within the washing machine 1202. Such a mixture, as well as only treating chemistry or only water, can be dispensed from one or more nozzles 1220.

The nozzles 1220 can be the nozzles of FIGS. 24-26. The nozzles 1220 can spray the liquid into the treating chamber 1218 in one or more patterns 1222 to facilitate even distribution of treating chemistry. Such patterns can be the patterns of FIGS. 20-23. Additionally, proper dispensing from the nozzles 1220 can be communicated to the user, such as audibly 1230 or visually 1232 from the user interface 1234. The nozzles 1220 can be protected from user damage while loading laundry by a fascia 1224. The fascia 1224 can be the fascia of FIG. 22-23 or 57. Additionally, the fascia 1224 can be a stain station 1226, having one or more buttons 1228 to selectively dispense additional treating chemistry from the nozzles 1220. The stain station 1226 can be the stain station of FIG. 58.

Alternatively, the washing machine 1202 can be connected with a universal bulk dispensing system 1236. The bulk dispensing system 1236 can utilize the retro-fit unit of FIGS. 60-62.

Thus, it should be appreciated that the concepts as described herein can be individually incorporated into a washing machine or laundry unit, or can be combined utilizing two or more of the concepts to integrate a bulk dispensing system into a laundry machine, such as the washing machine as described herein.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A bulk dispensing system for a laundry treating appliance, the bulk dispensing system comprising:

a housing comprising an upper housing portion and a lower housing portion that seat together to define at least one water conduit and define at least one treating chemistry conduit that is fluidly separate from the at least one water conduit, with at least one pump mount provided on the housing, the at least one treating chemistry conduit fluidly coupled to a bulk source of treating chemistry; and at least one pump mounted to the housing at the at least one pump mount and having a water inlet fluidly coupled to the at least one water conduit, a treating chemistry inlet fluidly coupled to the at least one treating chemistry conduit, and a wash liquid output, the at least one pump adapted to draw a volume of treating chemistry from the at least one treating chemistry conduit and emit a mixture of water and treating chemistry to form a wash liquid.

2. The bulk dispensing system of claim 1 wherein the housing further comprises at least one of a water supply connector fluidly coupled to the at least one water conduit or a bulk treating chemistry connector fluidly coupled to the at least one treating chemistry conduit.

3. The bulk dispensing system of claim 1 wherein the housing further comprises a nozzle fitting fluidly coupled to the wash liquid output.

4. The bulk dispensing system of claim 3, further comprising a spray nozzle connected to the nozzle fitting.

5. The bulk dispensing system of claim 4 wherein the housing further comprises a wash liquid conduit having a wash liquid inlet fluidly coupled to the wash liquid output of the pump and fluidly coupled to the nozzle fitting.

6. The bulk dispensing system of claim 5 wherein the nozzle fitting is a releasable fitting and the nozzle is releasably mounted to the nozzle fitting.

7. The bulk dispensing system of claim 6 wherein the at least one pump mount is a releasable mount and the pump is releasably mounted to the housing via the at least one pump mount.

8. The bulk dispensing system of claim 1, further comprising a valve assembly carried by the housing.

9. The bulk dispensing system of claim 8 wherein the valve assembly comprises at least one of a water supply valve or a treating chemistry supply valve.

10. The bulk dispensing system of claim 1, further comprising a controller communicatively coupled to the pump and wherein the controller controls the volume of treating chemistry drawn through the pump based upon an amount of water through the pump.

11. The bulk dispensing system of claim 1, further comprising seals disposed on the housing to further define the at least one water conduit and the at least one treating chemistry conduit.

12. The bulk dispensing system of claim 1 wherein the upper housing portion and the lower housing portion are an un-hinged clamshell configuration.

13. The bulk dispensing system of claim 1 wherein the upper housing portion further comprises a set of seals and the lower housing portion further comprises a set of channels that are complementary to the set of seals.

14. The bulk dispensing system of claim 13 wherein the upper housing portion is fastened to the lower housing portion and the set of seals are seated at the set of channels to fluidly seal the set of channels.

15. The bulk dispensing system of claim 1 wherein the at least one water conduit and the at least one treating chemistry conduit are defined by integrated flow paths in the housing formed by the upper housing portion sealing with the lower housing portion.

16. A bulk dispensing system for a laundry treating appliance, the bulk dispensing system comprising:

a housing comprising two assembled halves defining at least one water conduit and at least one treating chemistry conduit, that is separate from the at least one water conduit with at least one pump mount provided on the housing, the at least one treating chemistry conduit fluidly coupled to a bulk source of treating chemistry; and at least one pump mounted to the housing at the at least one pump mount and having a water inlet fluidly coupled to the at least one water conduit, a treating chemistry inlet fluidly coupled to the at least one treating chemistry conduit, and a wash liquid output, the at least one pump adapted to draw a volume of treating chemistry from the at least one treating chemistry conduit and emit a mixture of water and treating chemistry to form a wash liquid.

17. The bulk dispensing system of claim 16 wherein the two assembled halves are an un-hinged clamshell configuration.

18. The bulk dispensing system of claim 16 wherein a first of the two assembled halves further comprises a set of seals and a second of the two assembled halves further comprises a set of channels that are complementary to the set of seals.

19. The bulk dispensing system of claim 18 wherein the first of the two assembled halves is fastened to the second of the two assembled halves and the set of seals are seated at the set of channels to fluidly seal the set of channels.

20. The bulk dispensing system of claim 16 wherein the at least one water conduit and the at least one treating chemistry conduit are defined by integrated flow paths in the housing formed by a first of the two assembled halves sealing with a second of the two assembled halves.

* * * * *